US005441589A

United States Patent [19]

Groswith, III et al.

[11] Patent Number: 5,441,589

[45] Date of Patent: Aug. 15, 1995

[54] FLAT BED DAISY WHEEL HOT DEBOSSING STAMPER

[75] Inventors: Charles T. Groswith, III, Los Altos, Calif.; William A. Banks, Carrollton, Tex.; Eugene F. Duval, Menlo Park, Calif.; Roger M. Gray, Lewisville; Raymond D. Heistand, II, Flower Mound; Barry C. Kockler, Lewisville; Warren K. Shannon, Highland Village, all of Tex.; Robert E. Smith, Woodside, Calif.; William J. Usitale, Farmers Branch, Tex.

[73] Assignee: Taurus Impressions, Inc., Moutain View, Calif.

[21] Appl. No.: 78,792

[22] Filed: Jun. 17, 1993

[51] Int. Cl.[6] ..... B41J 1/30; B41J 3/28

[52] U.S. Cl. ..... 156/542; 400/24; 400/28; 400/29; 400/31; 400/118.1; 400/134.1; 400/144.2; 101/27; 101/29; 101/336

[58] Field of Search ..... 156/540, 541, 542; 400/24, 28, 29, 31, 120, 134.1, 144.2, 118.1; 101/27, 29, 336

[56] References Cited

U.S. PATENT DOCUMENTS

| | | | |
|---|---|---|---|
| 1,406,537 | 2/1922 | Choate | 400/120 |
| 1,979,640 | 11/1934 | Roberts, Jr. | 101/21 |
| 3,301,370 | 1/1967 | Miller | 400/120 |
| 4,037,532 | 7/1977 | Plaza et al. | 101/93.48 |
| 4,044,665 | 8/1977 | Kuhne et al. | 101/21 |
| 4,074,798 | 2/1978 | Berger | 197/53 |
| 4,147,438 | 4/1979 | Sandrone et al. | 400/144.2 |
| 4,308,794 | 1/1982 | Adamoli et al. | 101/93.03 |
| 4,373,436 | 2/1983 | Shenoha | 101/27 |
| 4,416,199 | 11/1983 | Davison | 101/193 |
| 4,462,708 | 7/1984 | Luartes et al. | 400/304 |
| 4,516,493 | 5/1985 | Schemenauer | 101/27 |
| 4,541,746 | 9/1985 | Bobart et al. | 400/144.2 |
| 4,542,690 | 9/1985 | Kikuchi | 101/27 |
| 4,544,289 | 10/1985 | McGourty et al. | 400/154.5 |
| 4,627,750 | 12/1986 | Kittel et al. | 400/144.2 |
| 4,678,352 | 7/1987 | Kittel et al. | 400/175 |
| 4,820,066 | 4/1989 | Link | 400/144.2 |
| 4,930,911 | 6/1990 | Sampson et al. | 400/28 |
| 4,983,055 | 1/1991 | Iwata | 400/144.2 |
| 5,004,360 | 4/1991 | Ahn | 400/144.2 |

FOREIGN PATENT DOCUMENTS 2152436 8/1985 United Kingdom .

OTHER PUBLICATIONS

Acromark Hot Stamping System brochure, the Acromark Company, Inc. pre-1986, 6 pages.

Franklin stamping machine brochures, Franklin Manufacturing Corporation, Model 115 11/83 and Super Regal Model 11/79, 2 pages each, pre-1986.

Kwikprint stamper brochure, Models 86, AA and 64, pre-1986 3 pages.

WEGO printer brochure, Precision Machine, Inc. pre-1986, 4 pages.

"Automark Marking Systems" ACEP-J1B Brochure, Defiance Machine and Tool Co., Inc., published Feb., 1985.

"Eastmark" Hot Foil Lettering Brochures, Didde Graphic Systems Corporation pre-1986, 9 pages.

*Primary Examiner*—David A. Simmons
*Assistant Examiner*—J. Sells
*Attorney, Agent, or Firm*—Skjerven, Morrill, MacPherson, Franklin, and Friel

[57] ABSTRACT

A dual station hot debossing stamper for a report or book cover includes a print engine having a character finger daisy wheel forcer and a logo die forcer which are actuatable independently by a common servo motor through respective gear trains. The print engine moves line-by-line and a platen moves character-by-character. A print wheel is inserted and locked into the engine in a character debossment operation with a motor driving the print wheel. When using a logo die, the print wheel and casing is removed and using a loader-unloader tool the die is articulated under the logo die forcer. Insertion of a logo transfer tape cartridge shifts the gears in the print engine. A second character tape cartridge is used with the print wheel. A dedicated personal computer and associated software and firmware programs control the stamping apparatus.

102 Claims, 58 Drawing Sheets

10
30
32
35
34
143
145
146
31
33
138
50
54a
54
53
51
52
60
40
8
20
21
22
23a
23

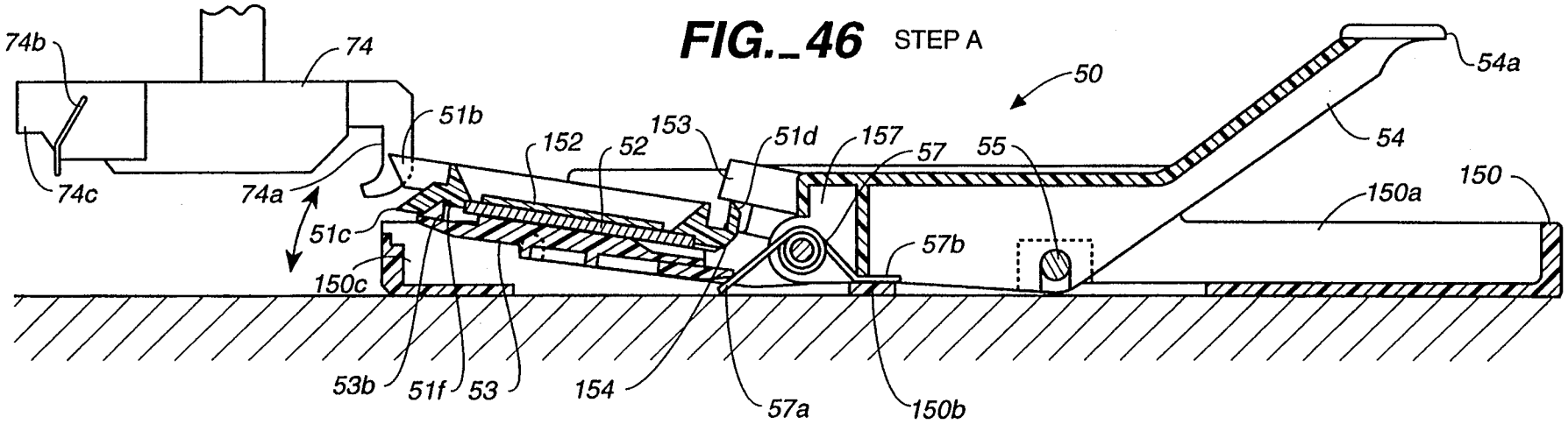
FIG._46 STEP A
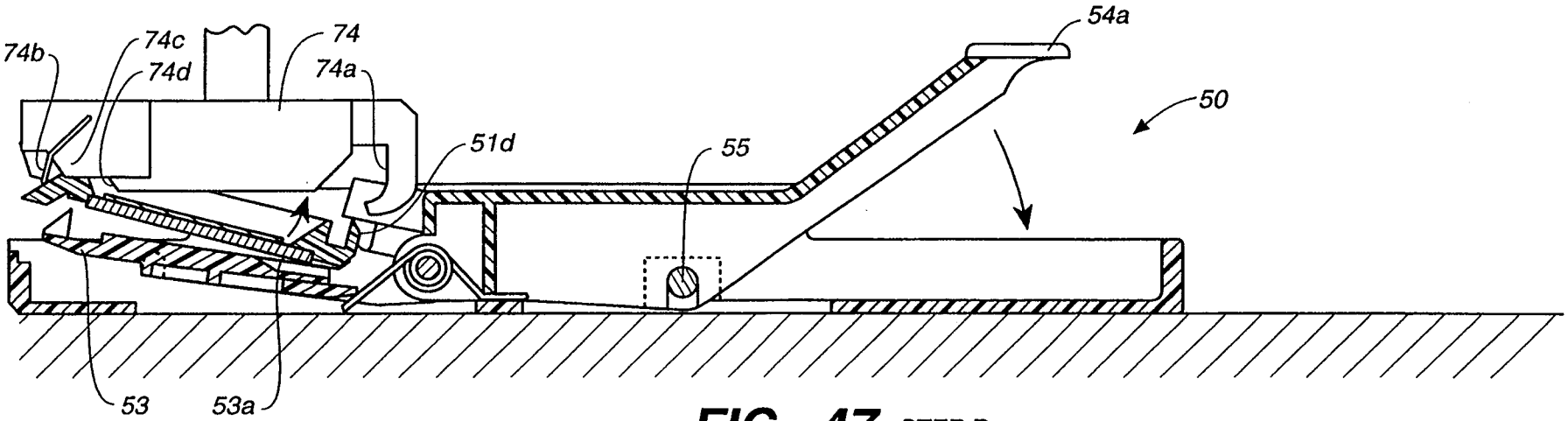
FIG._47 STEP B

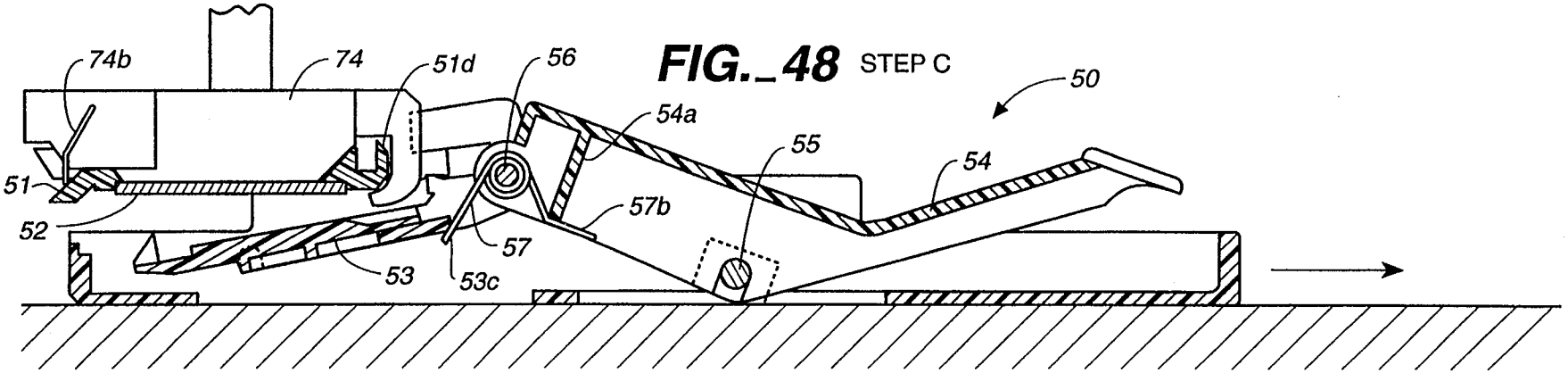
FIG._48 STEP C
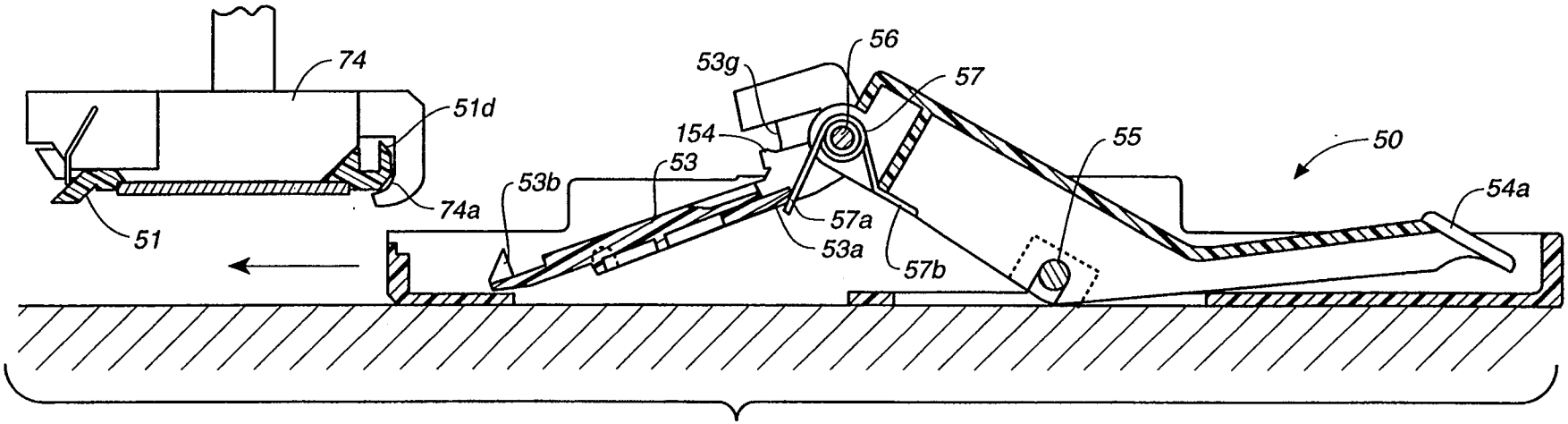
FIG._49 STEP D

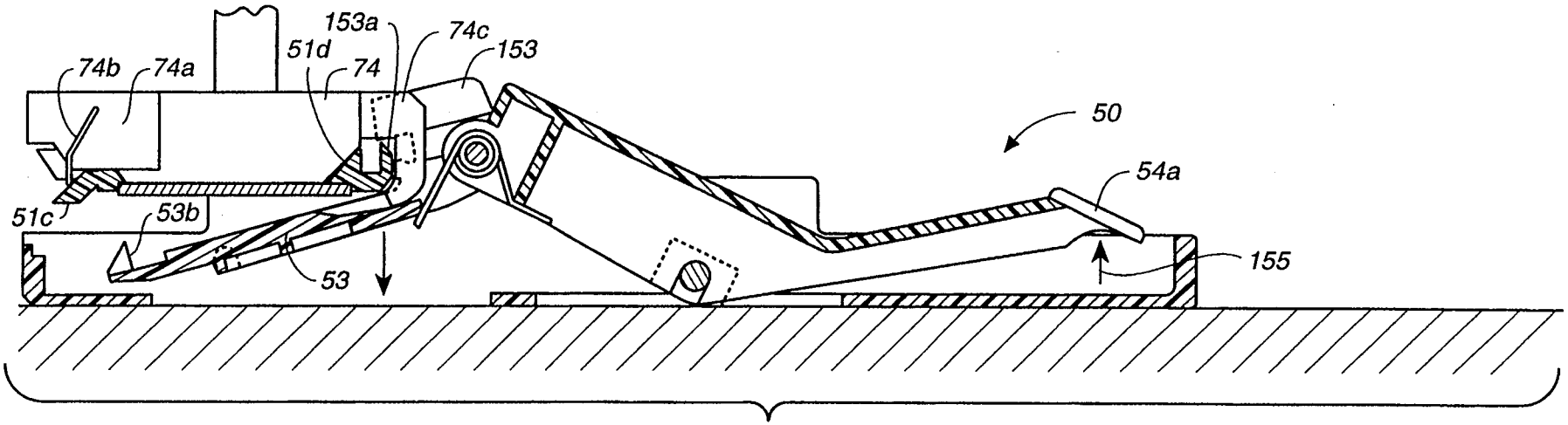
FIG._50 STEP E
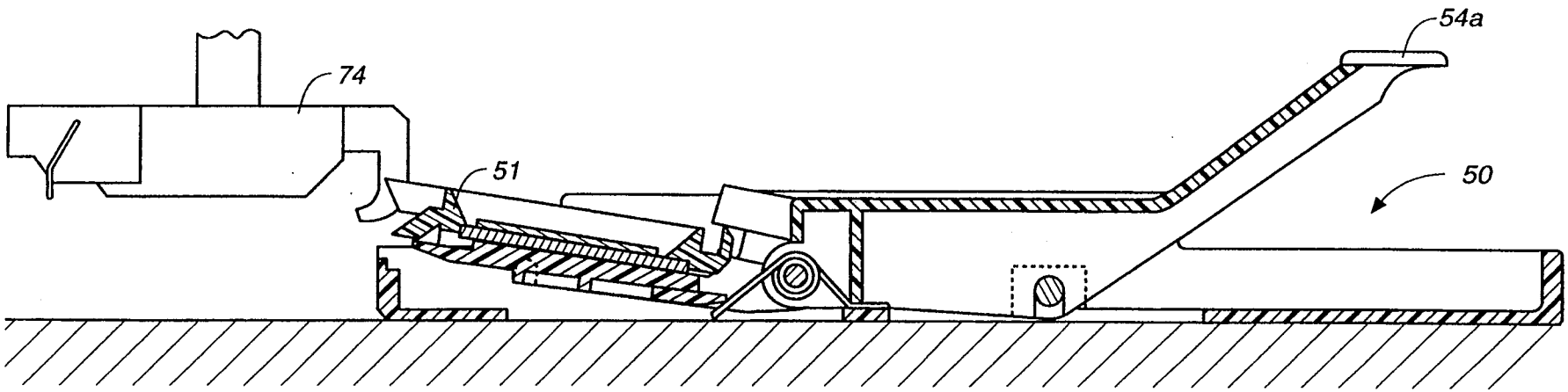
FIG._51 STEP F

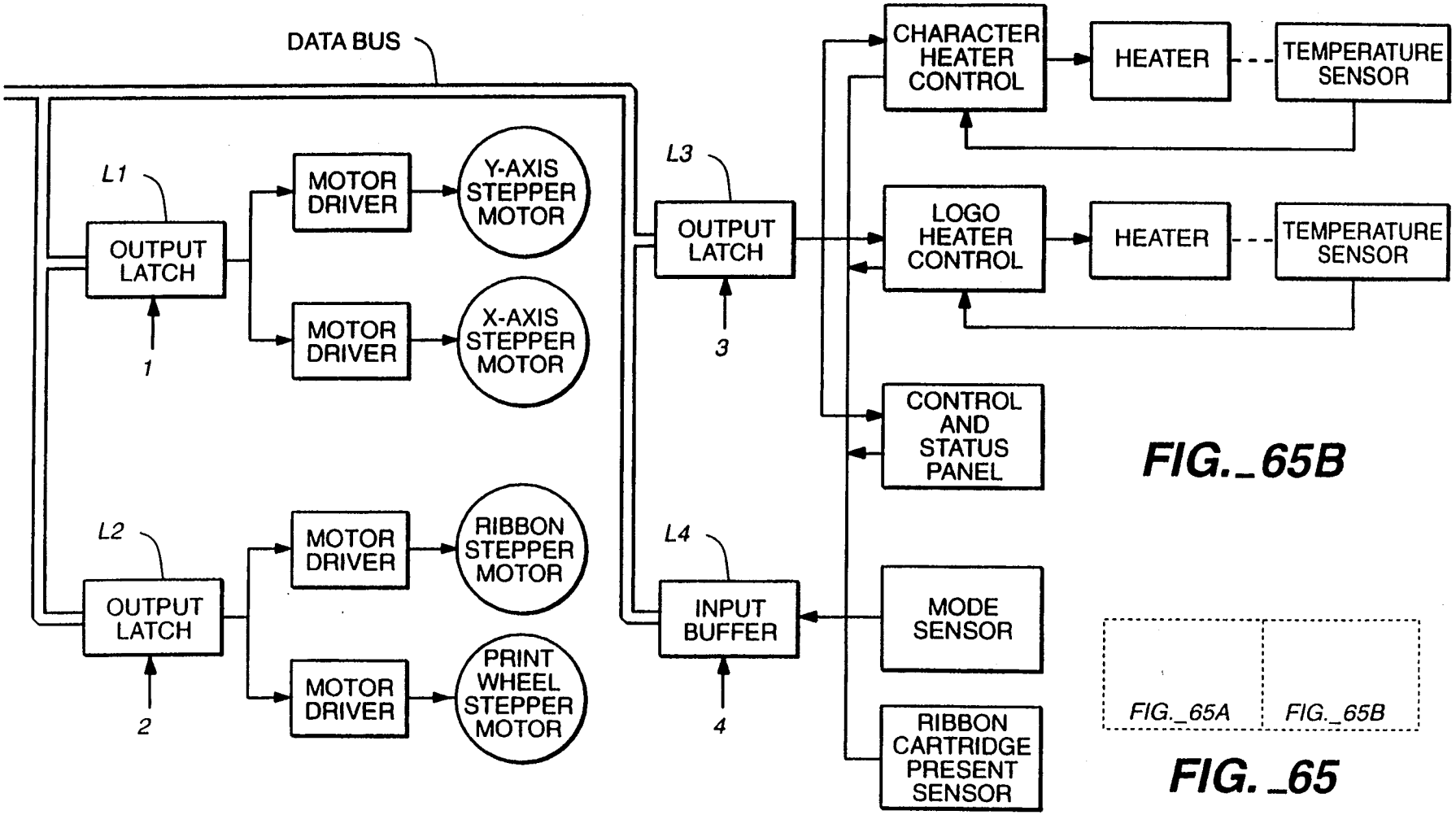
TEMPERATURE SENSOR
HEATER
CHARACTER HEATER CONTROL
TEMPERATURE SENSOR
HEATER
LOGO HEATER CONTROL
CONTROL AND STATUS PANEL
MODE SENSOR
RIBBON CARTRIDGE PRESENT SENSOR
FIG._65B
FIG._65A
FIG._65B
FIG._65
L3
OUTPUT LATCH
3
L4
INPUT BUFFER
4
DATA BUS
Y-AXIS STEPPER MOTOR
X-AXIS STEPPER MOTOR
RIBBON STEPPER MOTOR
PRINT WHEEL STEPPER MOTOR
MOTOR DRIVER
MOTOR DRIVER
MOTOR DRIVER
MOTOR DRIVER
L1
OUTPUT LATCH
1
L2
OUTPUT LATCH
2

```
POWER ON:
    Initialize CPU hardware and registers, bring all motors to low power.
ENTRY 1:
    Transmit ready-prompt to host computer.
ENTRY 2:
    If no command has been received from the host computer, then
        If OFFLINE, ensure platen is at MAX position and carriage is at MID position.
        Else (online), ensure platen and carriage are at their last positions.
        IF no print command has been received within the last 1 second,
        send the printwheel to its home position  (petal #76).
        Scan keypad and record status of PRINT and ADVANCE keys for later
        reporting to the host via the 'request status' command.
        GO TO ENTRY 2 above.
    Else (a command has been received from the host computer)
        Look at command and verify the syntax is valid.
        If syntax invalid, report error to host and go to ENTRY 1 (above).
        Else (syntax is valid)
            Based upon command received, dispatch to the appropriate
            command handler, then return to ENTRY 1 above.
```

FIG._66

FLAT BED DAISY WHEEL HOT DEBOSSING STAMPER

RELATED APPLICATION

This application relates to design patent applications, filed herewith, entitled Hot Debossing Stamper Machine (DM-093) Ser. No. 29/010716, filed Jun. 17, 1993; Debossment Stamper Foil Tape Logo Cartridge (DM-094) Ser. No. 29/009664, filed Jun. 17, 1993; Debossment Stamper Foil Tape Character Cartridge (DM-095) Ser. No. 29/009665, filed Jun. 17, 1993; Logo Loader-Unloader For Debossment Stamper (DM-096) Ser. No. 29/009667, filed Jun. 17, 1993; and Debossment Stamper Daisy Wheel And Casing (DM-097) Ser. No. 29/010715, filed Jun. 17, 1993; the disclosures of which are incorporated herein by reference.

BACKGROUND OF THE INVENTION

1. Field of the Invention

This invention is directed to a serial hot debossing stamper printing machine generally for imprinting titles, authors name, logos and other information on a cover or spine of a book, booklet, or the like. More particularly it is directed to a gantry-type assembly with a movable print engine including a rotating character-containing wheel, e.g. a daisy wheel, in association with a transfer foil tape cartridge for force and heat debossment of material from the foil tape to a workpiece, such as a cover for a marketing, sales, engineering, research or business-office type booklet or report.

2. Material Art

U.S. Pat. No. 4,930,911, the precursor of subject invention and assigned to the same assignee thereof, sets forth in the background section of that patent, various prior art devices including various commercialized hot foil printing machines. The '911 patent itself describes a computerized daisy wheel printer where a series of character fingers are heated in the immediate vicinity of the character and forced by a cam-operated head against a cartridge foil tape to imprint foil material on a workpiece. This patent also envisioned that various means other than a character wheel may be employed, such as a dot matrix head to impress a character or logo on the workpiece. The patent also contemplated that the printer may be programmed and the print cycle, dwell time and heat levels adjusted for various type fonts and for the surface texture, e.g. smooth paper, vinyl, leather or other embossed or smooth cover stocks, of the workpiece to be printed. The present invention presents a series of distinct improvements over the constructions shown in the '911 patent.

A cursory review of prior patents cited in the '911 patent prosecution, both domestic and foreign, has been made. U.S. Pat. No. 3,301,370 discloses an early portable device including what is now known as a daisy wheel for hot stamping selected indicia on a heat sensitive web, namely a continuous strip of plastic label stock. Two spaced anvils are closed between a character on the end of a flexible finger and on label stock and heat applied. U.K. 2,152,436 A shows a non-impact marking device such as an ink-jet or laser marker in which the workpiece is positioned on a movable platen. U.S. Pat. No. 4,044,665 describes a printing machine including type face slugs where the print table can be adjusted in height. U.S. Pat. No. 4,462,708 shows an automated tape lettering machine which includes a stepper motor-driven character disc positioned at a home position and movable to a print position. U.S. Pat. No. 4,308,794 describes an electromagnet driven typewriter hammer for actuating flexible laminae radiating from a character bearing disc where the striking hammer has a pin head with a central end notch which contacts a positioning wedge in a rear cavity of the laminae pad typing element. U.S. Pat. Nos. 4,074,798 and 4,147,438 show the use of character plug faces of different shapes at the end of the spokes of a print wheel albeit in the typewriter art.

U.S. Pat. No. 4,541,746 illustrates that daisy wheel typewriters have included the print wheel in a cartridge and microprocessor control over home and print positions. U.S. Pat. Nos. 4,416,199 and 4,373,436 show in a non-daisy wheel hot stamper, the use of a braking mechanism for a transfer tape supply reel or cassette and a cam and cam-follower to move a marking head toward an anvil. The latter patent also shows a quick-release snap lock connection of the cassette to the main assembly. U.S. Pat. No. 4,516,493 illustrates the use of a pair of parallel guides for sliding-in of an etched die into a metal heated block for imprinting text or logos on elongated tapes for production of award ribbons.

SUMMARY OF THE INVENTION

The present invention in its preferred embodiment is directed to a desktop-size dual station flat bed stamper for a modern office environment. It includes both a daisy wheel character debossment station and a separate second debossment station for debossing a logo or other normally non-character indicia. Debossment for a logo can be from either a section of foil tape displaced from the section of foil tape positioned for daisy wheel character debossment both on a single cartridge or preferably, from one or the other of two separate tape cartridges which are positioned alternatively into the print engine. The second debossment station normally includes a debossment die with an etched logo thereon. Due to the large size of a typical logo and the greater depth and width of the logo indicia segment, a very high force up to about 2000 pounds (900 kg) is necessary with appropriate increased dwell time to satisfactorily deboss the logo imprint into the workpiece media surface. A separate heated forcer is utilized in side-by-side debossment stations, each driven by a common servo motor. In the preferred embodiment insertion of a relatively wide foil tape-containing cartridge into the assembly shifts the servo motor from driving a low force forcer for the character wheel fingers through one gear train to driving a high force forcer through a second gear train to provide a force of up to 2000 pounds (900 kg) for the logo debossment. The first gear train handles forces in a range of three to about 240 pounds (1.4 kg to about 110 kg), the smaller forces normally employed for period or comma strike force with the higher forces being used for a large capital "W" strike force, all when using the first gear train.

In order to accommodate 1) this wide range of forces during operation with either of the gear trains, 2) to reduce the size and weight of the machine and 3) to negate the requirement of expensive load bearings in the stamper, a rigid box frame is provided so that a character force exceeding approximately 12 pounds (5.5 kg) and especially a logo force "bottoms out" a floating print engine and a floating platen between anvils formed by upper and lower horizontal beams above the print engine and below the platen, respectively. Typically bottoming-out will occur with about the 12 pound (5.5 kg) character force. Connected side plates between these beams are placed in tension upon generation of the printing forces and the bottoming out.

To insert and remove the logo debossment die into the printer assembly, particularly in the underside of the print engine, a logo loader and unloader tool is provided. Logos are coded with an area and size setting for easy operation, interchangeability and repeatable print quality.

The print engine "reads" the size and style of type of each print daisy wheel inserted and automatically adjusts the force and dwell and escapement value of each character. The adjustment includes platen (and attached cover) advance for proportional spacing of characters and for kerning of certain character pairs, as well as ribbon advance, which is adjusted based on the size of characters being printed to avoid wasting ribbon. The adjustment also includes use of a hot strike algorithm which measures the time a particular character was last struck by including a real time clock history of character striking and based on a predetermined heat loss delay curve of that character, adjusts and lowers the second and subsequent dwell time of the heated forcer against that character and that section of the transfer tape in contact with the character. Otherwise the transfer tape would become overheated if the same dwell time was always used which would result in print "bleed" or smear of the embossed impression on the workpiece. Further, such hot strike adjustment results in very appreciable speed enhancement of the stamper since, for example, the second "e" of the word "speeds" would need only the slightest modicum of additional heating or dwell time when the whole word is being printed. Likewise, the second "s" of "speeds" still would have residual heat from the strike of the first "s" stroke and the dwell time of the second "s" stroke would be less. The print wheel character forcer and the logo debossment die forcer are used independently from each other. The character forcer brings the character to stamping temperature primarily from the time the character forcer places its hammer into conductive contact with the character finger pad, the transfer foil tape and against the workpiece. Means are also provided to initiate and continue alignment of each character at a proper lateral spaced printing position via a detent notch along a side of the print hammer and a ridge or detent on the character pad so that each character in a print line is properly spaced. This obviates the problem of the inherent side-to-side lateral flexing of the daisy wheel character-containing fingers. The logo is held in contact with the logo forcer hammer and is held at stamping temperature while in the logo mode (activated by the logo cartridge insertion).

Another aspect of the invention is the provision of having the tape cartridges serve as a thermal shield and safety interlock. Electronic end-of-tape, broken tape or jammed tape sensing to warn an operator to insert a new cartridge is provided. This is particularly important since the operator could be printing on an expensive media (notebook) and would not want to ruin it. An improved brake, preventing tape back up, allows platen character-by-character printing motion to break free any transferred foil material sticking to the cover workpiece from the immediately preceding character strike impression.

The print engine of the invention includes a central casting with two spaced parallel vertical forcer apertures therein. Each aperture is vertically stacked top-to-bottom with an assembly of a cam, cam-follower roller, forcer shaft with return spring, bushing and hammer including a heater, overlying a respective debossment zone.

The logo debossment die is normally formed by photo chemically etching a magnesium plate, which die is mounted in a unique logo frame. A heat transfer material pad is placed on the die surface facing the forcer hammer end flat bottom to give high thermal conductivity at the heat transfer interface between the heated forcer hammer end and the logo die. A unique logo loader and unloader tool is utilized to load the logo frame and its attached logo die into the print engine and in turn for unloading the frame and die from the engine. The tool is especially useful since it places the frame into a heated zone of about 200° F.–250° F. in the print engine which heat could be harmful if an operator attempted to manually insert and remove the logo frame and die.

The print wheel of the invention is driven by a separate stepper motor through a gear train 4.8:1.0 and by a spring-loaded locator pin attached to the print wheel drive gear and is guided into a curved ramp and drive notch on an exterior surface of an upper hub when the print wheel rotates. The hub extends upwardly from a print wheel casing. The locator pin is mechanically phased to the motor electrical phase and combined with an optical reflective flag on the print wheel to allow print wheel homing when it drops into the drive notch. The casing has a first peripheral relatively wide rectangular window on its top side for entry of the character forcer hammer and a narrow radial slit on its bottom side extending to the casing periphery and aligned with the window radial center line, allowing downward flexing of a character finger therethrough by the hammer action. To protect the character fingers from scraping and damage during rotation of the print wheel and to increase the finger-return spring force after a strike stroke, a flexible plastic strip extends under each finger. The strip extends from the wheel hub to a radial position just inbound of the weld zone between the finger and the conductive character pad which contains the character to be printed. A second radial window on the casing between the hub and the casing outer periphery exposes a circular arc flat reflector encoder strip of alternate non-reflective and reflective areas which are sensed by an optical sensor to indicate a particular print wheel, such as a 24-Point Arial type face and to indicate a home position (FIG. 30A and FIG. 71). Identification of the particular wheel automatically adjusts the different force and dwell time and escapement value of the particular character on the wheel, which information is pre-programmed into the printer firmware. The top-side of the print wheel casing also includes integral entry keys and grooves and a handle for inserting the wheel and casing into the print engine and a saucer-shaped underside for protection of the characters, alignment with the character tape cartridge indentation and to prevent the operator from contacting the hot characters.

A microcontroller is used to control the motion profile of the hammer velocity and position feedback using pulse width modulation (PWM) for both character embossment and logo die embossment.

The character cam has two profiles so that either a low force or medium force profile can be selected depending upon direction of rotation from home. Both profiles have constant rise sections that allow a constant conversion of motor torque to force over a wide range of hammer up and down positions. They also have rapid rise sections to allow the hammer to arrive at the media rapidly (fewer degrees of motor rotation). Force is selected by pulse width modulation to create a constant current which the motor converts to a constant torque. There are 31 levels of force (or 31 levels of PWM) for each cam force surface.

The logo cam has only one profile because it has a shallow ramp to give larger force output for a given torque input. Force on the logo cam is varied in the same manner as force on the character cam (PWM).

Use of the described hot stamper of this invention and foil tape results in the pigmented wax being melted off the tape carrier film to produce a quality cover with the advantages of sharp images, no drying time, no cleanup, a debossed surface and the ability to print colors and metallics.

The present invention also is directed to a method of hot stamping employing the technique set forth below.

BRIEF DESCRIPTION OF THE DRAWINGS

FIG. 46 is a side cross-sectional view of the loader (step A) entering die forcer hammer section of the engine assembly.

FIG. 47 is a side cross-sectional view of the loader (step B) pivoting the frame to a position for hooking the frame on the forcer hammer frame.

FIG. 48 is a side cross-sectional view of the loader (step C) latching the logo frame to the forcer hammer frame.

FIG. 49 is a side cross-sectional view showing (step D) the latched position of the logo frame in the hammer frame with the unloader reentering the hammer section for die frame removal.

FIG. 50 is a side cross-sectional view showing (step E) showing disconnect of an outboard end of the frame from the hammer frame.

FIG. 51 is a side cross-sectional view showing complete unlatch (step F) of the logo frame and removal of the frame and loader from the forcer hammer frame.

FIGS. 65A and 65B are a block diagram of the printer/stamper electronics.

FIG. 66 shows the pseudocode description of the printer/stamper firmware.

DETAILED DESCRIPTION

The Stamper

Figure 1:
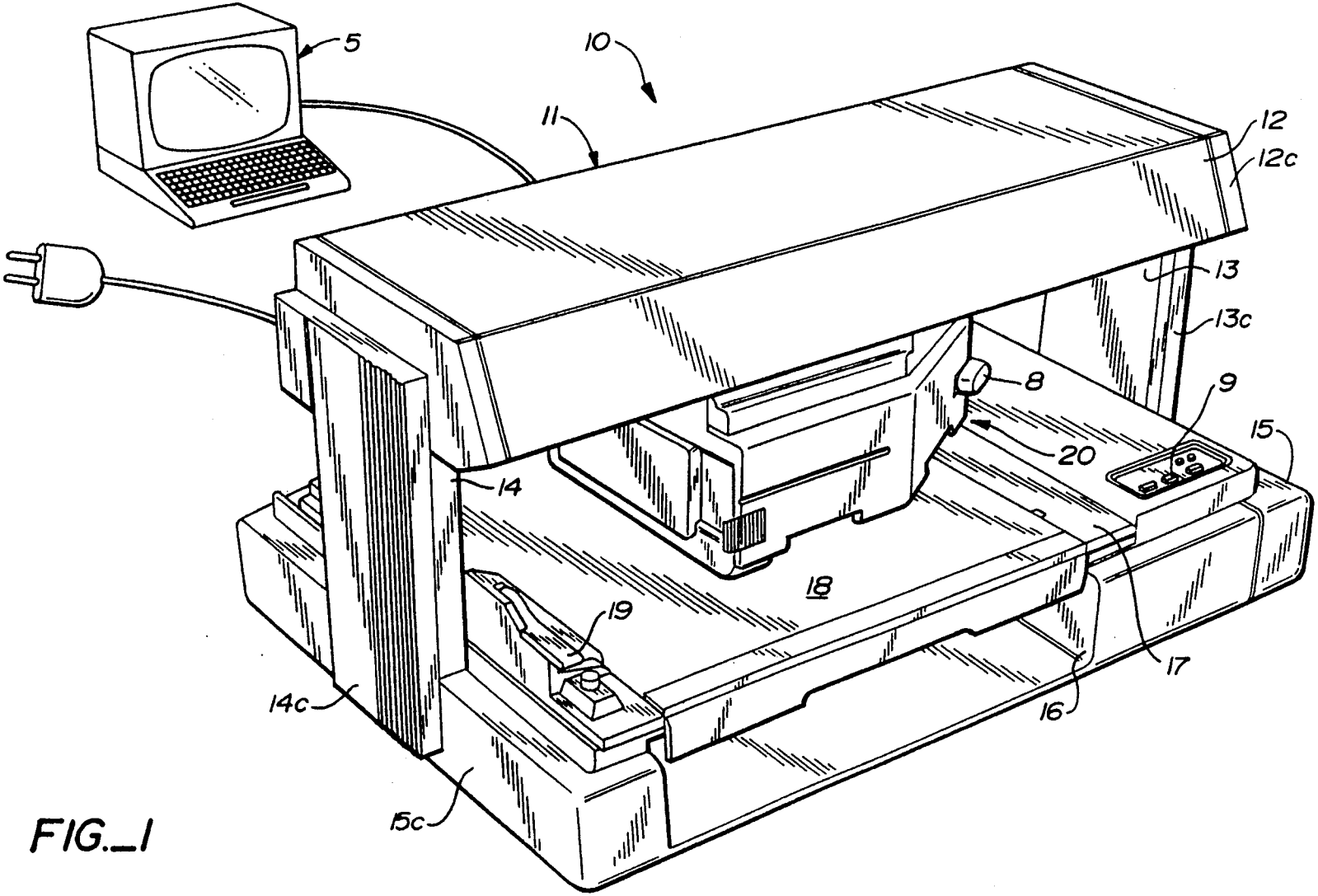
FIG. 1 is a perspective view of the flat bed hot debossing stamper of the invention showing connection to a dedicated personal computer.

The overall assembly of the preferred embodiment of the dual station flat bed daisy wheel hot debossing stamper 10 is seen in FIG. 1 with the stamper connected to a dedicated personal computer 5 or the like which contains and stores information for operating the stamper and accepts the desired information to be printed on a selected workpiece. The PC provides a keyboard and control unit for controlling debossment of a line of individual character debossments across a workpiece; for controlling relative movement of the workpiece and the stamping engine and carriage line-by-line; for controlling movement of a character wheel with respect to a character forcer; and for controlling movement of both a logo die forcer and character finger forcer interchangeably to deboss transferable foil tape material from indexed tape cartridges.

The debossment printer-stamper 10 includes a fixed gantry 11 having a closed frame structure including a frame top 12, a right-hand tensionable side plate 13, a left-hand tensionable side plate 14 and a frame bottom 15 which serves also as the stamper base. A movable platen 17 includes a removable platen insert 18. A clamp 19 is provided to clamp a workpiece (not shown) typically a relatively thin booklet or report cover of paper, plastic, leather or other stock material. A front recess 16 is sized to receive ring portions of a typical three-ring binder when the cover of that binder is placed on the platen 17 for stamping. A debossment print engine or carriage 20 is hung from an anvil upper load beam **12*a* (FIGS. 3, 4 and 5) within the frame top 12 and is movable along a Y-axis parallel to the frame top, normally for line-to-line printing movement. The platen 17 being of appreciably less mass than the print engine 20 is moved along a X-axis on a character-to-character printer movement orthogonally to the movement of the print engine. Suitable aesthetic casing elements 12*c*, 13*c*, 14*c* and 15*c* surround the interior load elements of the gantry frame. Control buttons and indication lights 9 are provided on the base 15** typical to PRINT, to ADVANCE, to ON-LINE and to indicate by an LED the on-line and power-on conditions.

Figure 2:
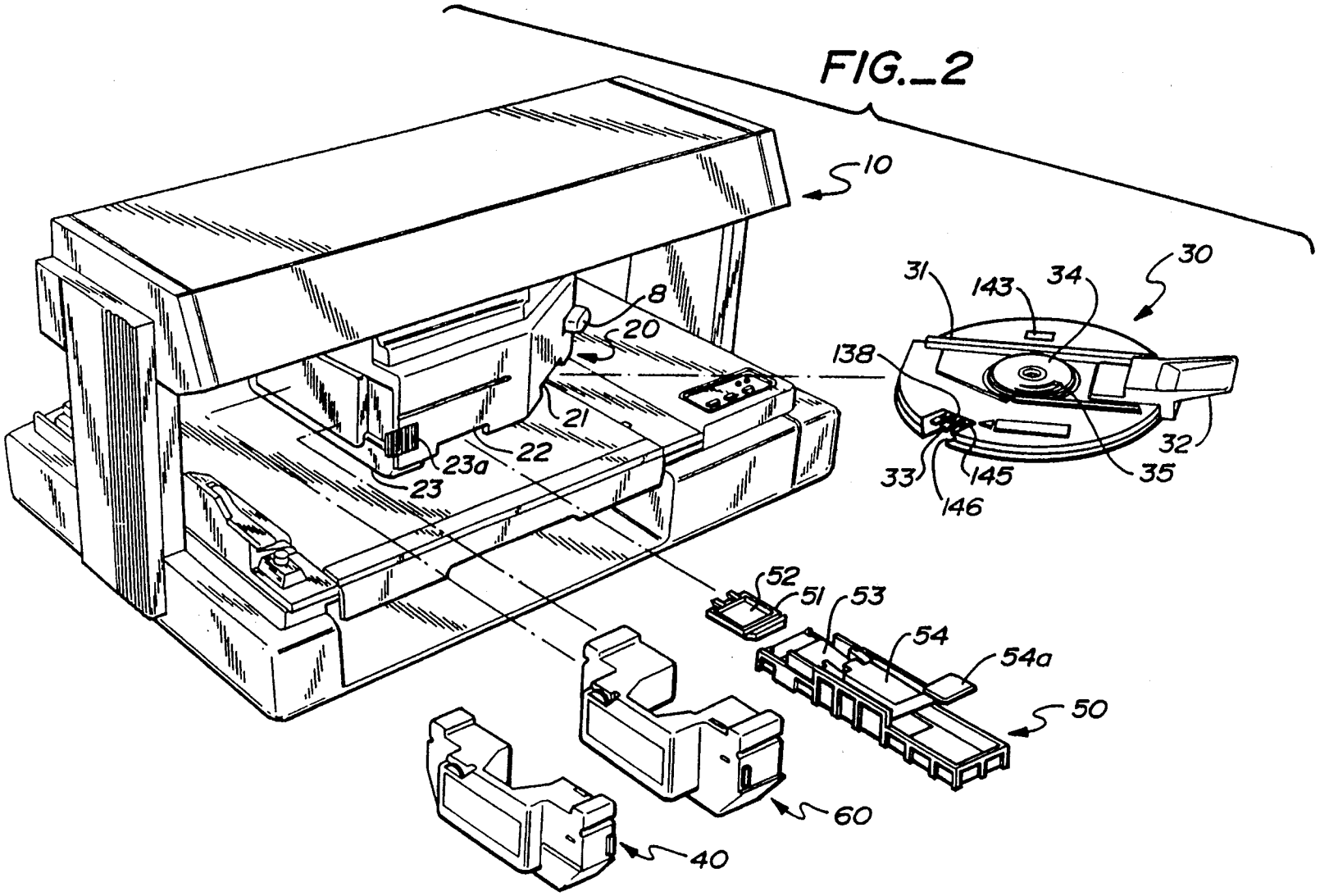
FIG. 2 is an exploded perspective view of the stamper showing the entry ports for the character wheel and casing, the logo and frame and logo loader-/unloader and either the character transfer foil tape cartridge or logo die transfer foil tape cartridge.
Figure 24:
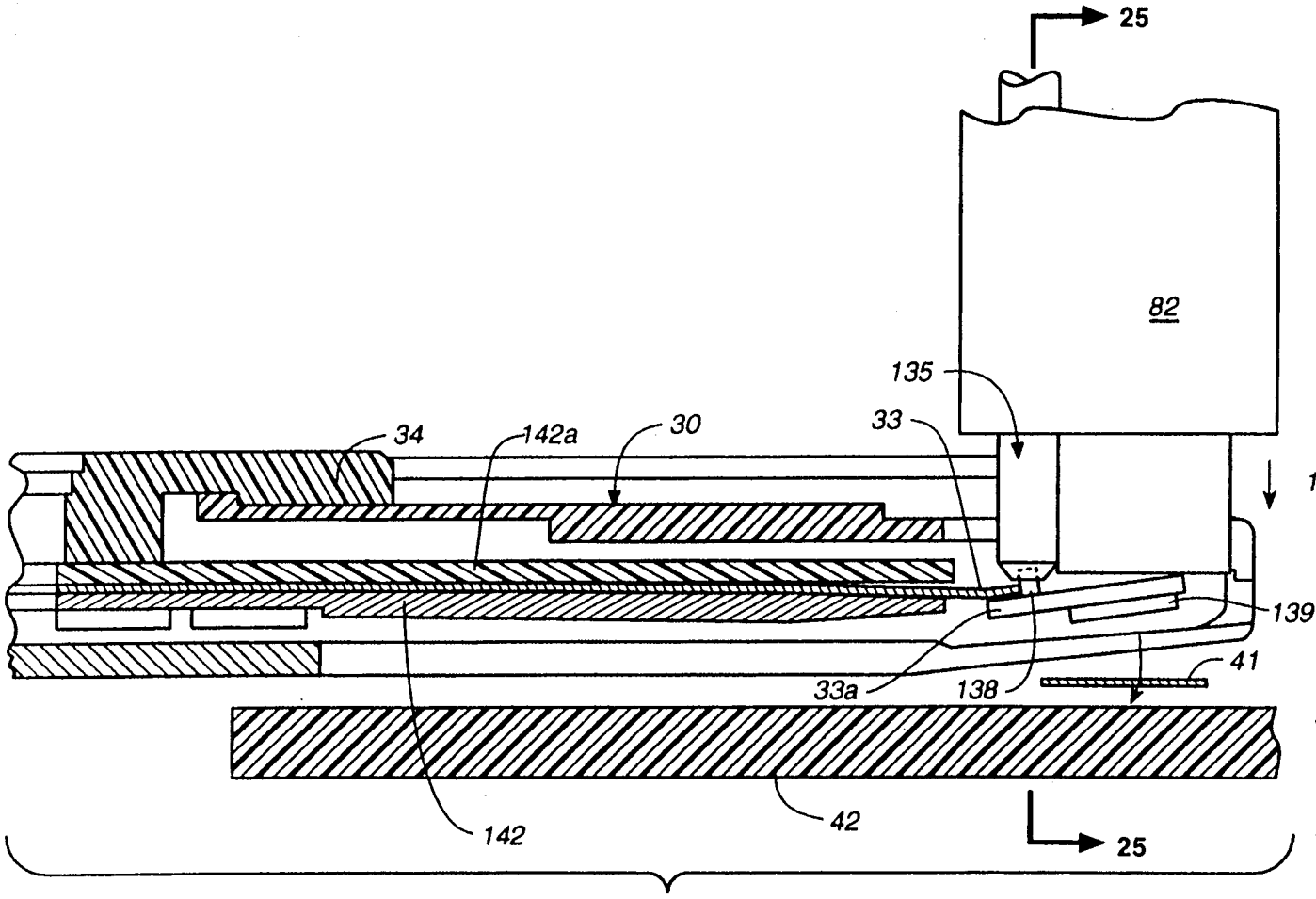
FIG. 24 is a back view of the character forcer end showing an offset spring-pressed centering fork with a partial cross-sectional view of the character wheel and casing.

FIG. 2 illustrates the general assembly of other major components of the stamper 10 into the print engine 20. These include in a preferred embodiment a daisy character wheel and casing 30 and a character wheel foil tape cartridge 40. Alternatively, a logo frame 51 mounting a logo die 52 and a logo die foil tape cartridge 60 is employed, when a logo or other large indicia is to be printed. A logo loader-unloader tool 50 is utilized to insert and remove the logo frame and die into an entrance/port 22 at the bottom of the print engine by angular manipulation of a loader logo frame-holding loader pad 53 and a loader handle 54. The character wheel tape cartridge 40 is inserted into a side entrance 23 of the print engine when the character wheel and casing 30 has been or is to be inserted into the entrance 21 at the bottom of the print engine. Suitable latches **23*a* latch the respective cartridges 40 or 60 into entrance 23. The character wheel and casing includes a pair of spaced parallel guide rails 31 and slots 31*d* which interfit with corresponding slots and rails in the print engine, an insertion handle 32, a series, typically from 70–90, of radial spring fingers 33 each mounting a character-containing pad 33***a* at its radial end and each extending from a wheel hub 34. Hub 34 and its integral character wheel is driven by a stepper motor in the print engine by a motor drive pin guided by a circular arc entrance ramp on the hub top surface into a rectangular drive and homing slot 35 in the hub. The character wheel and casing is removed from the print engine by initial movement of handle 8. The top surface of the casing includes a strike window 145 and a casing window 143 for optical access of an optical sensor to sense alternating reflective and non-reflective surfaces 134 (FIG. 30A) on the character wheel indicating homing of the print wheel and indicating the presence and identification code of the print wheel. The bottom surface includes a radial triangular slit 146 for depressed character finger passage. Each finger pad 33*a* includes a triangular ridge 138 on its top surface for character centering (FIG. 24).

A workpiece such as a report cover is clamped onto the platen table which moves above the base anvil (X-axis) and provides character-to-character spacing. The platen moves either toward or away from the operator front position. The carriage moves along the top guide rail and provides line-to-line spacing (Y-axis). The carriage moves in left to right or right to left with respect to the operator front position.

In a typical size the stamper has a 22" by 15" (56 cm by 38 cm) footprint, a 11" (28 cm) height, weights about 60 pounds (27.3 kg) and a character printing speed of approximately one character per second.

Gantry Frame

Figure 3:
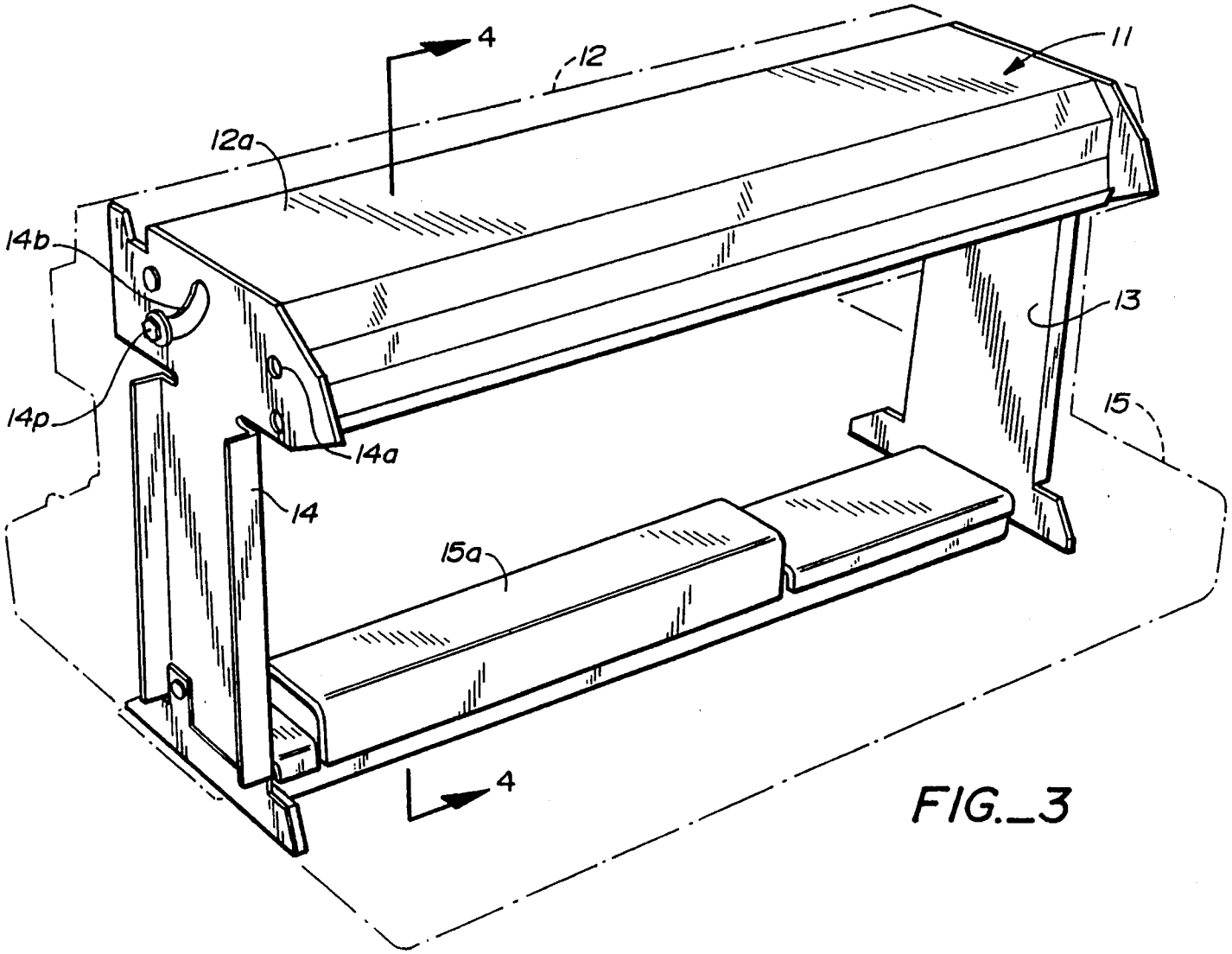
FIG. 3 is a perspective view of the internal load-bearing frame of the stamper showing the overall general outline of the stamper in dashed lines.

FIG. 3 is directed to the load sections of the gantry frame 11 namely an upper horizontal anvil load beam 12*a* and a lower horizontal anvil load beam 15*a*, each connected at their ends by vertical tensionable side plates 13 and 14. The side plates have a T-configuration with the upper cross-piece having upper beam attach apertures 14*a* for reception of bolts to hold the beam 12*a* and a curved slot 14*b* for reception of a beam tilt bolt 14*p*. The latter and pivot pin 14*e* allows tilting of the upper beam 12*a*, and the print engine connected thereto after removal of the casing elements 12*c*, 13*c* and 14*c* and the bolts extending through apertures 14*a*, for easily servicing the print engine. The rigid upper anvil load beam 12*a* and rigid lower anvil load beam 15*a* permit "bottoming out" of the print engine and the platen therebetween with resultant tensioning of the attached side plates, when the required high die debossment forces, up to about 2000 pounds (900 kg), are employed. This closed tied-at-both ends construction reduces the overall size and weight of the printer and the size, added complexity and cost of the required bearings. Light spring-loaded lower bearings support the flat platen and allow the platen to have light contact with the bottom anvil when single character-only stamping is being done. The weight of the print engine puts the side plate tensioning members in compression. As the stamping force exceeds the other weights bearing on the side plates, that force minus the various weights tensions the side plates 13 and 14.

Figure 4:
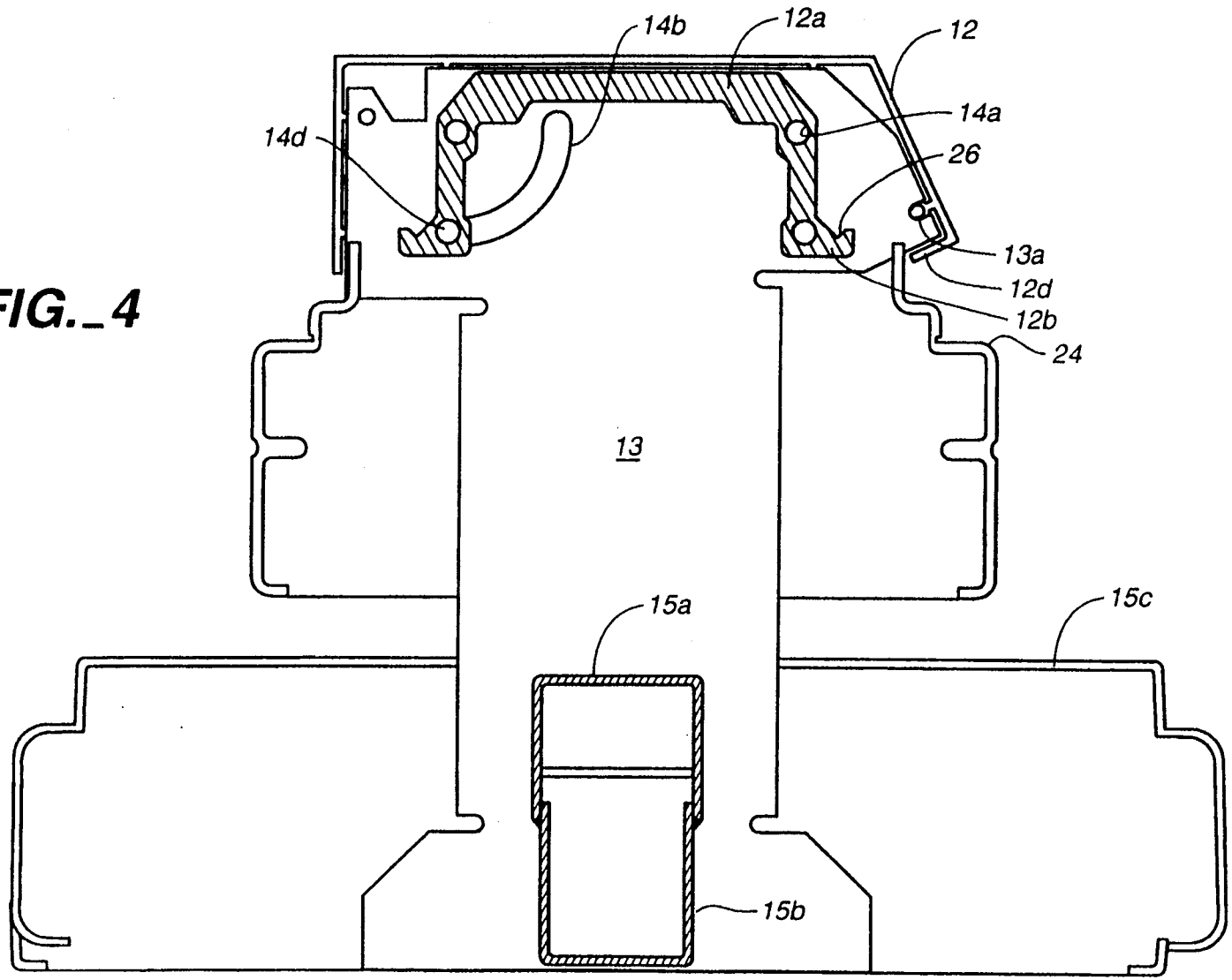
FIG. 4 is a side view of the stamper frame and casing elements taken on the line 4—4 of FIG. 3.

FIG. 4 illustrates the cross-sectional inverse U-shape of upper beam 12*a*. A pair of parallel wheel guide grooves 26 are provided on the upper surface of a pair of beam bottom flanges 12*b*. The cross-sectional shape of the print engine casing 24, which is screw-mounted over the print engine and curves within the frame top 12 with clearance, and the bottom beam casing 15*c* is also seen. Such clearance enables the casing 24 and print engine to move relative to the top frame left and right. Casing 12*d* is snap-mounted into a groove 13*a* in each of the side plates.

In the preferred embodiment, the rigid lower anvil load beam consist of two pieces (15*a* and 15*b*) welded together as shown in FIG. 4, and this rigid lower beam assembly is welded to side plates 13 and 14. Platen inserts 18 of various thicknesses are used to "build up" platen 17 to accommodate thin covers. Alternatively (not shown) the raised bottom anvil portion 15*a*, rather than being welded to the lower cross beam 15*b*, could be raised and lowered along with the floating platen and its guide and support means by a series of four rotary cams connected to a common drive system coupled to an operator controlled lever or knob, thereby eliminating the need for platen inserts to accommodate covers of varying thicknesses.

The Print Engine

Figure 5:
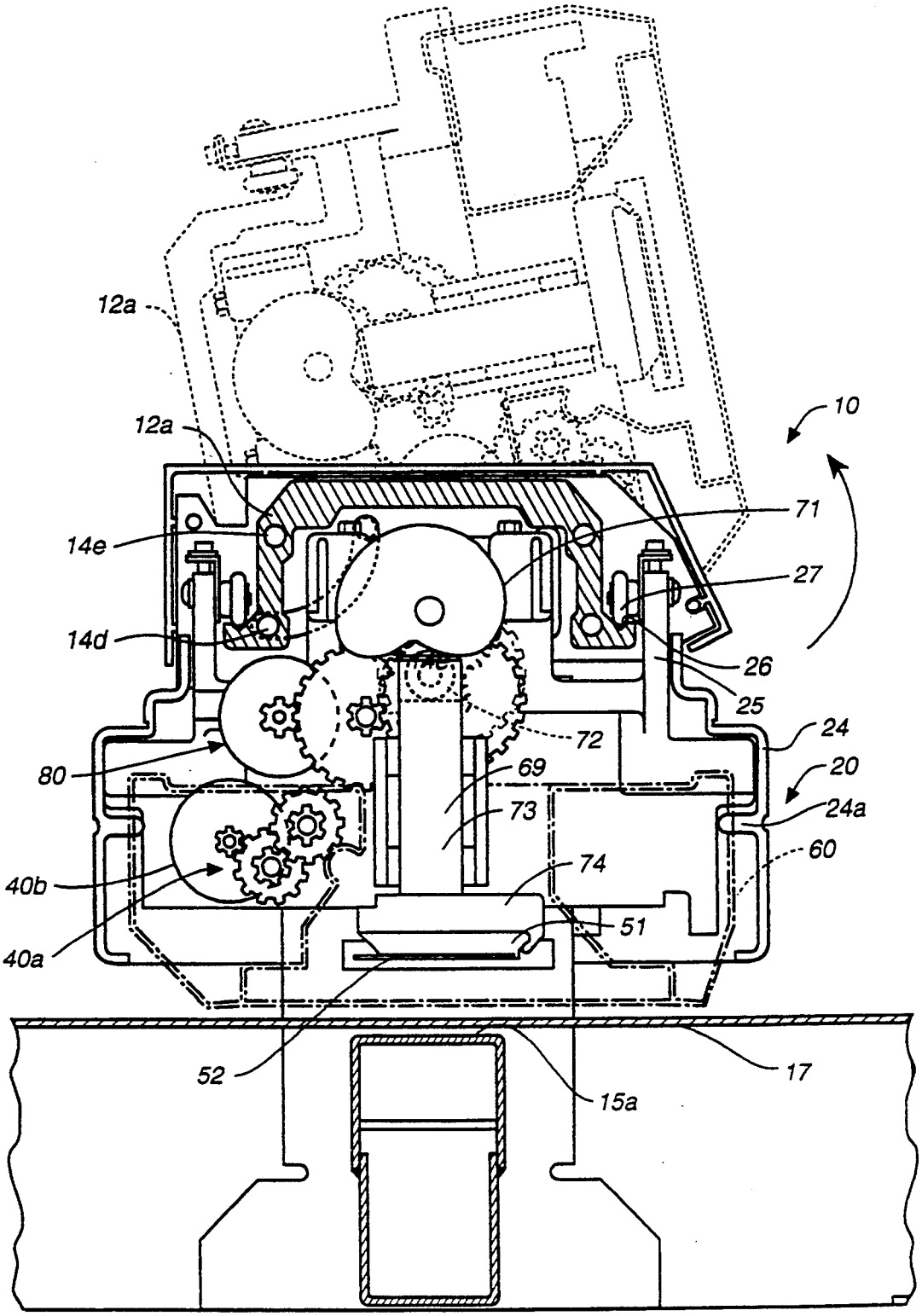
FIG. 5 is a side view taken on line 5—5 of FIG. 11 of the stamper frame with a die forcer in the "up" position and with the print engine shown in tilt servicing position by dashed lines.
Figure 40:
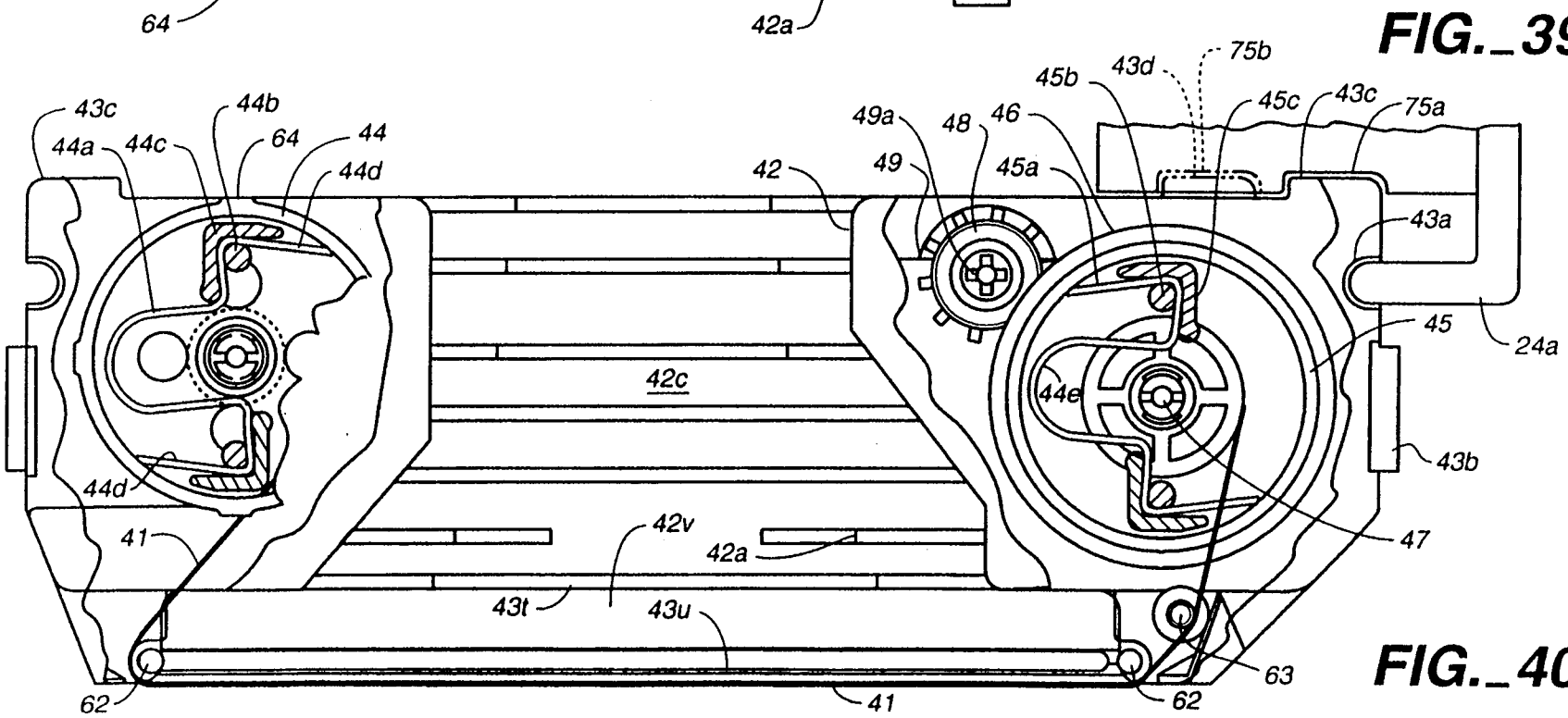
FIG. 40 is a cutaway back view thereof.

FIG. 5 shows upstanding side hang members 25 integrally extending upwardly from the print engine 20 frame and two pairs of spaced wheels 27, one pair adjacent to each end of the print engine, and traveling in the spaced wheel grooves 26 of the upper load beam 12*a*. This allows for smooth y-axis travel of the print engine to its line-to-line print positions. This Figure also shows a logo embossment die station 69 which comprises a servo motor driven die cam 71, a roller die cam-follower 72, a die forcer shaft 73, a die forcer hammer 74 containing a heater element 82F (as in FIG. 12) and mounting a logo embossment die 52 contained in the logo frame 51. The above elements are shown in the die forcer "up", non-forcing/non-stamping, position. The position of gear trains 80 dictate which of the two forcer assemblies and debossment stations are in operation. This Figure further illustrates in phantom, the tilting (to any position up to about 100°) of the entire beam 12*a* and engine 20 for servicing, about pivot pin 14*e* and bolt pivot 14*p* as indicated by the curved arrow. The position of the tape advance stepper motor 40*b* and the tape advance gear train 40*a* for driving the tape spool (FIG. 40) is also shown.

Figure 6:
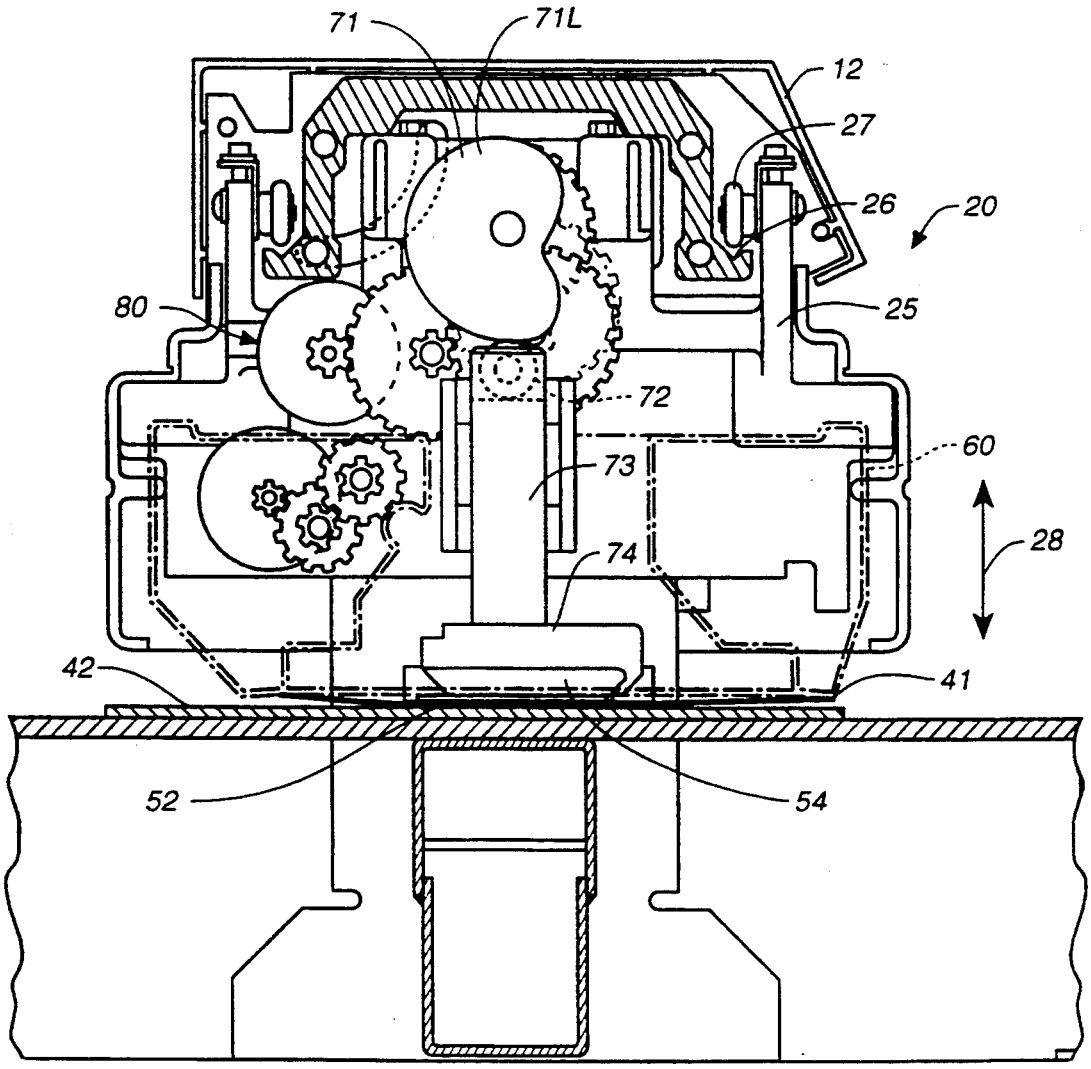
FIG. 6 is a view similar to FIG. 5 with the logo forcer of the engine in "down" condition pressing the logo die against a foil tape, workpiece and a platen anvil.

FIG. 6 illustrates the logo forcer cam 71 in a rotated "down" position 71L, in which the logo die 52 is force-contacting the foil tape at a die debossment zone and the workpiece and platen thereunder, to deboss transferable material from the foil tape, which is representative of the logo or other indicia, into the workpiece surface. A variety of forces are transmitted through a constant slope segment of the logo cam by varying the current to the motor (via pulse width modulation). In the logo die mode of operation, due to the high force being exerted i.e. from about 89 pounds (38 kg) to about 2000 pounds (900 kg), the wheels 27 are lifted from the upper beam grooves 26 and the entire forcer and die force load is taken up (arrows 28) between the rigid upper and lower anvils and in tensioning the side plates.

Figure 7:
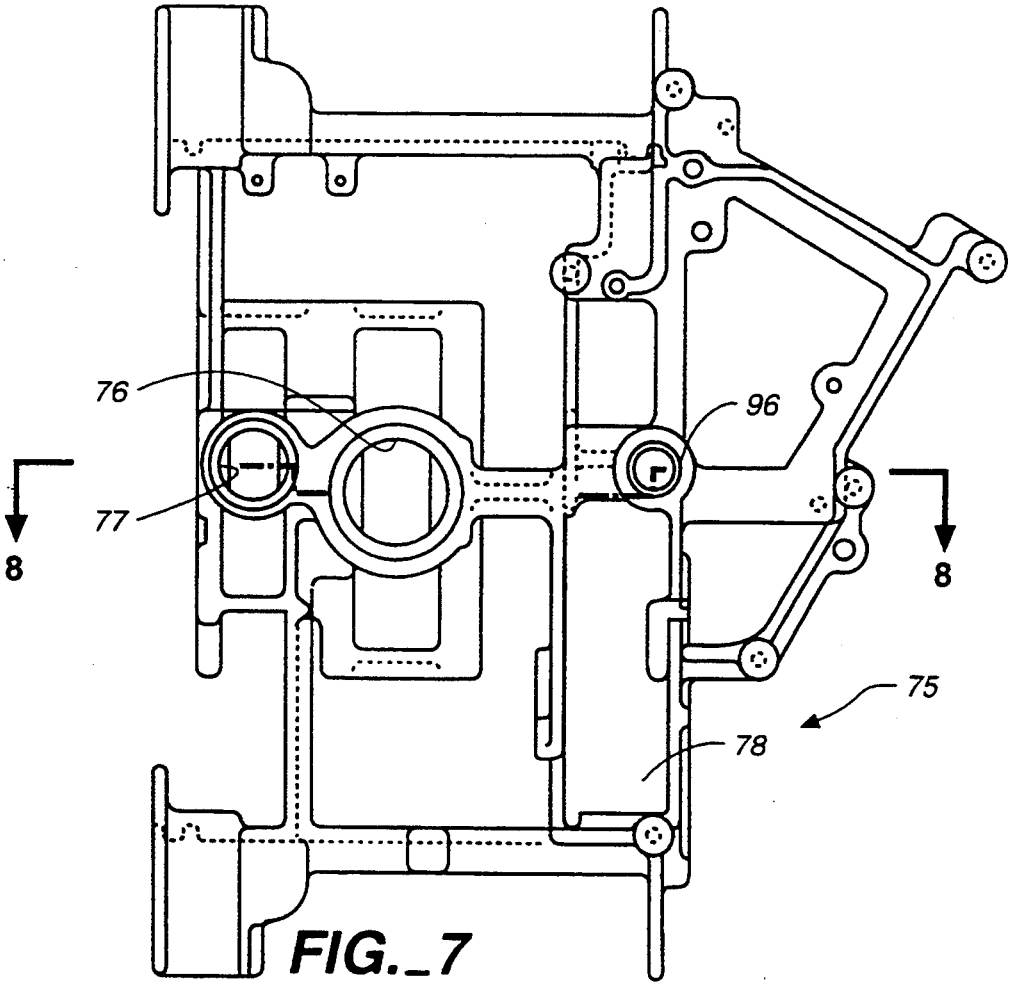
FIG. 7 is a bottom view of the print engine central casting.
Figure 8:
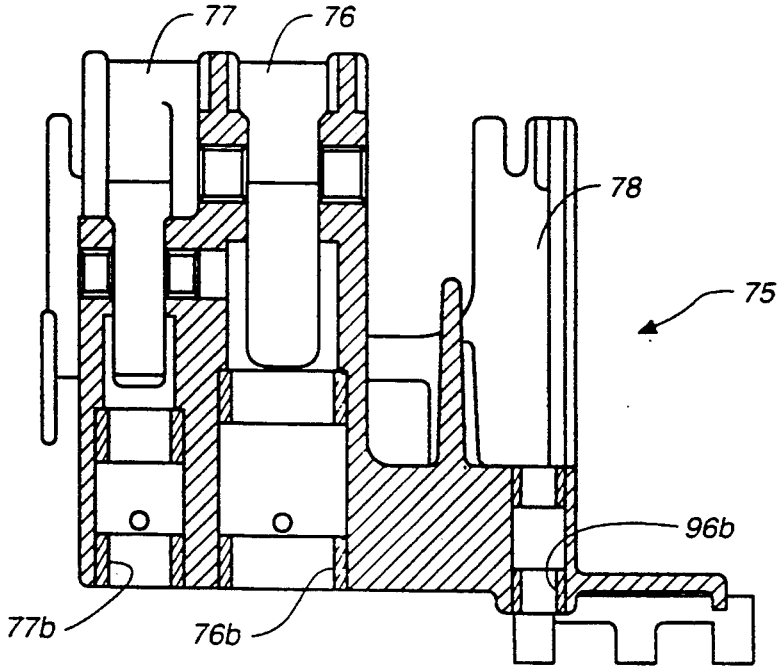
FIG. 8 is a front cross-sectional view thereof taken on the line 8—8 of FIG. 7.

A central die casting 75 for the engine 20 is seen in FIGS. 7 and 8, including a die forcer casting cavity 76 and a smaller character finger forcer casting cavity 77. Forcer drive gears are located within cavity 96*a*. Cavity 96 is utilized to mount a shaft which supports the print wheel gear. The casting also mounts guides for the print wheel cartridge and foil cartridges. Note that the logo can not be used when a print wheel cartridge is in place. The casting also mounts a small PC board that is used to interconnect electrical elements. Suitable bearings 76*b*, 77*b* and 96*b* are provided.

Figure 9:
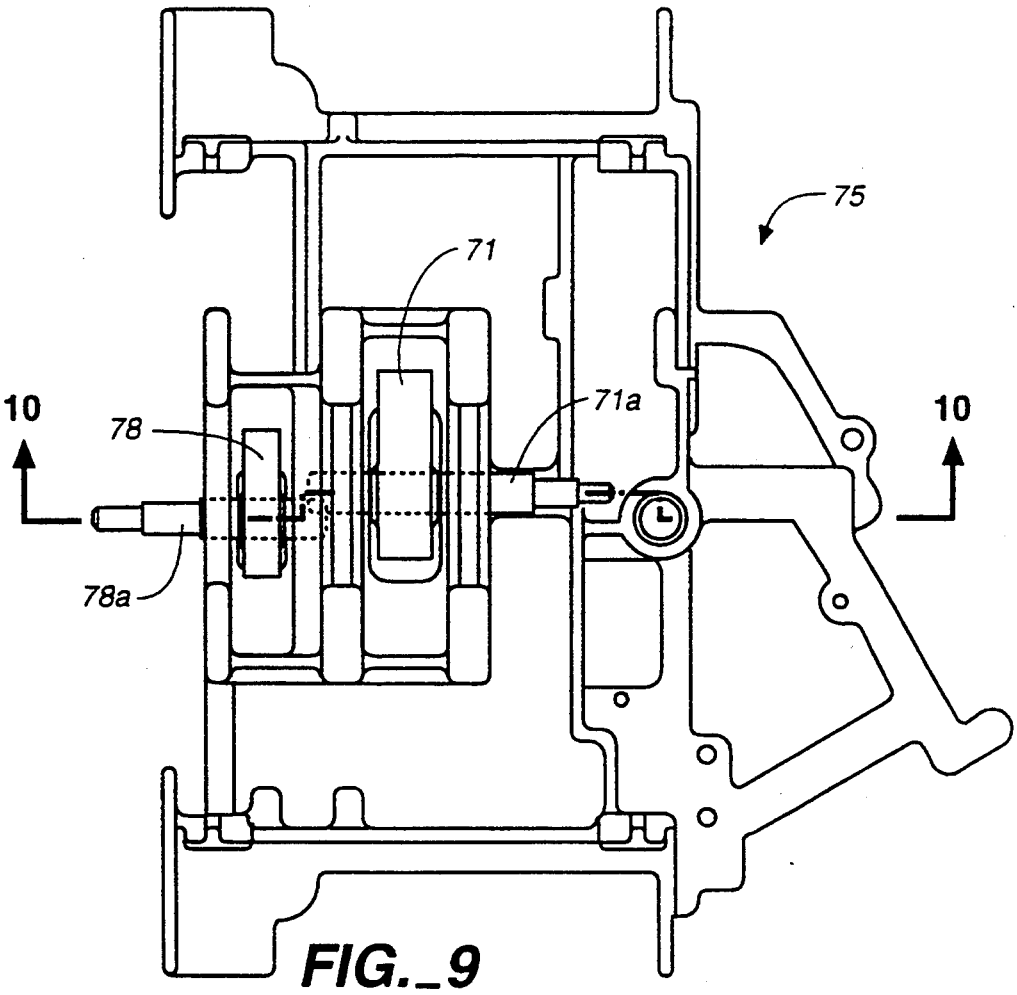
FIG. 9 is a top view of the casting with the cam and cam shaft inserted, of each of the character wheel forcer and logo die forcer.
Figure 10:
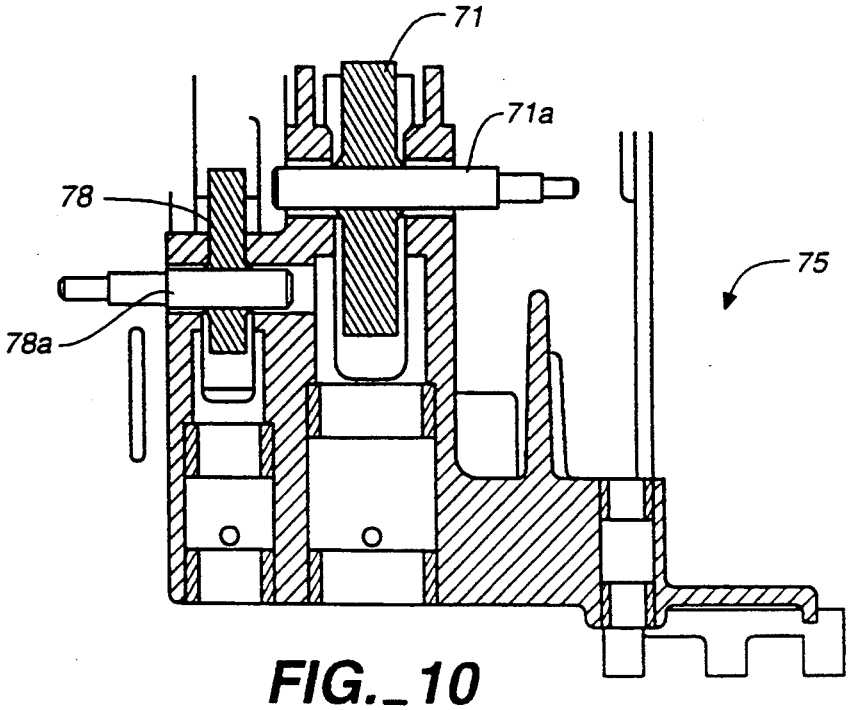
FIG. 10 is a front cross-sectional view thereof taken on the line 10—10 of FIG. 9.
Figures 11, 11A:
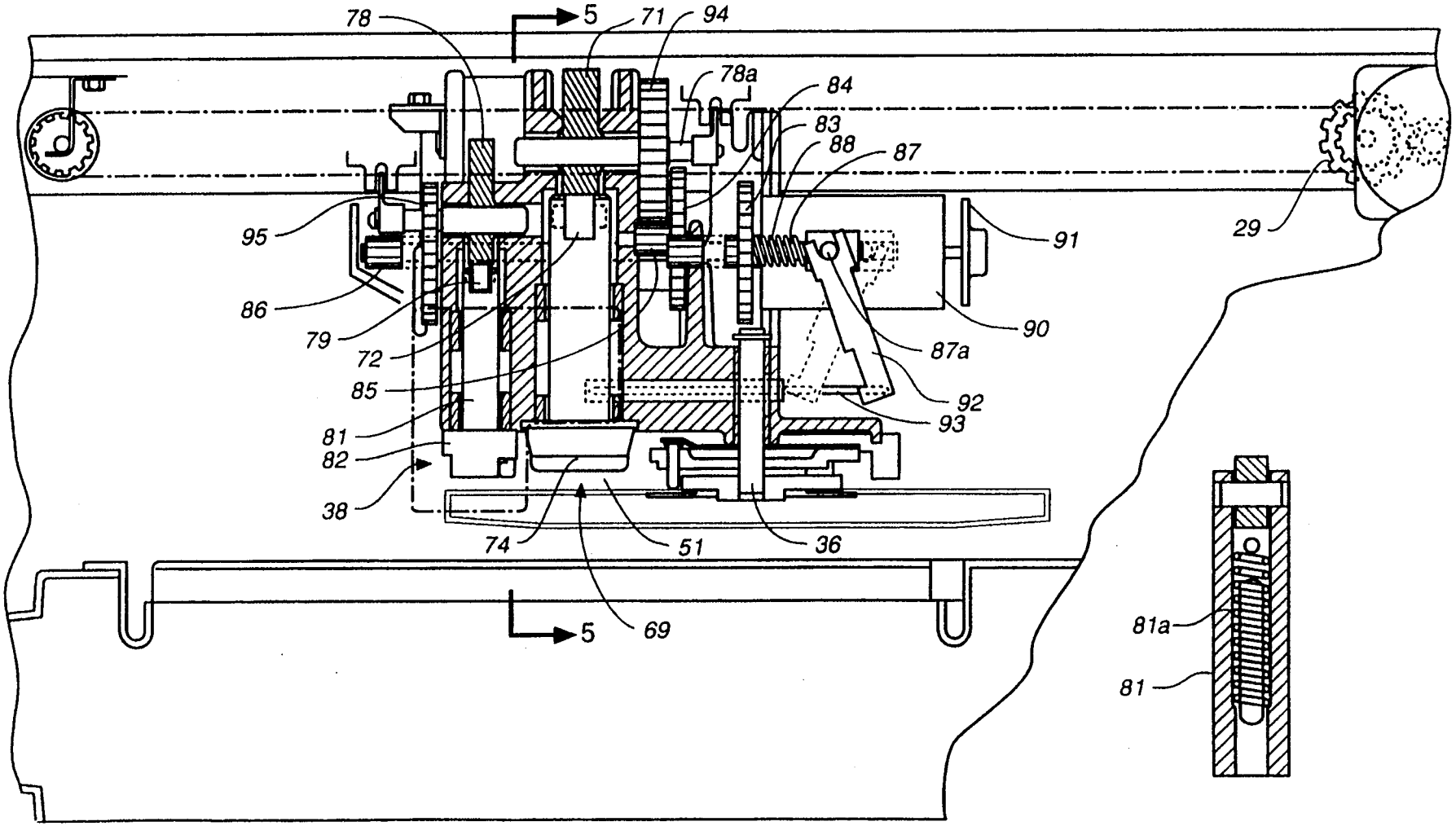
FIG. 11 is a partial cross-sectional front view of the geared interior of the print engine showing the first gear train in operation with the first forcer poised over an inserted character wheel and casing.
FIG. 11A is a cross-sectional side view of the character forcer shaft.

FIGS. 9 and 10 illustrate the placement of the die forcer cam 71 and die cam shaft 71*a* into the casting 75. Also seen is the placement therein of the character wheel forcer cam 78 and cam shaft 78*a*.

As seen in FIGS. 11–14 first and second gear trains are utilized to drive either the low force character finger forcer 38 or the high force logo die forcer 69 by changing the respective gear ratios. The high logo force mode is triggered into operating position by insertion of the logo foil tape cartridge 60 (FIG. 2) which pushes a spring-loaded gear shift link 92 and attached link shaft 93 inwardly and by pivot action of link 92 about gear shaft pin 87*a* shifts gears 83 and 84 against spring 88 so that spur gear 85 drives large diameter gear 94 attached to the die embossment cam shaft 71*a*. At the same time spur gear 86 is forced outwardly and held outwardly by the cartridge and is disconnected from intermeshing with gear 95 which drives the character finger forcer cam 78. At this time, operation of the servo motor 90 is controlled by the current to the motor representing that current needed for a particular force to be applied by the forcer for a particular dwell time. Generally a force is applied to the high forcer cam operating the logo die forcer of greater than about 75 pounds (about 34 kg) while the character die forcer has a maximum force about 240 pounds (about 110 kg). A return spring 81*a* returns the forcer shaft upwardly upon the release of force by cam rotation.

Not knowing a priori where the media surface (the booklet cover) is and with a requirement that there be a precisely controlled dwell time, it is desirable to commence the heating cycle in the tape and dwell time when the respective forcer hammers are placed in contact with the foil tape and workpiece thereunder. There is almost no thermal transfer from the heated hammer to the print wheel character until the hammer is in forcing condition on the foil tape and workpiece media. Since it is not known before printing the first character, where the media surface actually is (cover thicknesses vary from 0.004" to 0.200"), a print measurement stroke is provided. This is a stroke that causes the forcer hammer to go down slowly until it stalls into the media while moving at a lower force than one would normally use to strike a character. As the hammer moves down, a servo motor stall condition is detected by sensing the slots in the encoder disc 91. When no slots are seen for 100 milliseconds it means the motor has stalled and the hammer must be buried into the media to some extent. This determines the approximate height position of the media. For margin purposes the motor is backed off one revolution and this is called the "pre-print" position which is put into memory. Thus on future print cycles using the same cam on the same type of media it is no longer necessary to measure media height. The motor can be moved at high speed to the pre-print position rapidly and a constant current applied to servo motor 90 and the dwell time started. When the dwell timer for a particular character, or a recently struck character expires, the servo motor is returned to its home position and that ends the print stroke. Since two cam surfaces are provided in the character bidirectional cam 78, one surface for character high force (used for example on a capital "W" or "M") and one surface for character low force (used for example on a period or comma), the distance-to-media between each are different, necessitating a prior measurement stroke for each. The cam profile is different depending on which direction the cam is rotated. Further the total distances travelled by the hammer are different in terms of encoder slot counts. In practice the servo motor starts moving at about 3000 rpm, is slowed to 2000 rpm then to 1000 rpm then to 500 rpm at various velocity zones as determined by the slot counts on the encoder disc. At the approach to the pre-print position a motor brake pulse is applied so that the exact pre-print position is arrived at with the motor at near zero rpm. At that time a requested current is applied to the motor representing the desired force to be applied on a character by the forcer including the forcer cam, for a fixed amount of time which represents dwell. When the dwell timer indicate completion of dwell the motor is quickly returned to the home position. The cam profile is a constant linear rise cam in the areas of force transfer so if a constant current is applied to the servo motor, it will translate the resultant constant torque to a constant force on the follower and shaft (independent of position along the cam, as long as it is still on the constant slope arc). This gives a constant force by the hammer on the foil tape and media via the cam-follower and forcer shaft.

Figure 12:
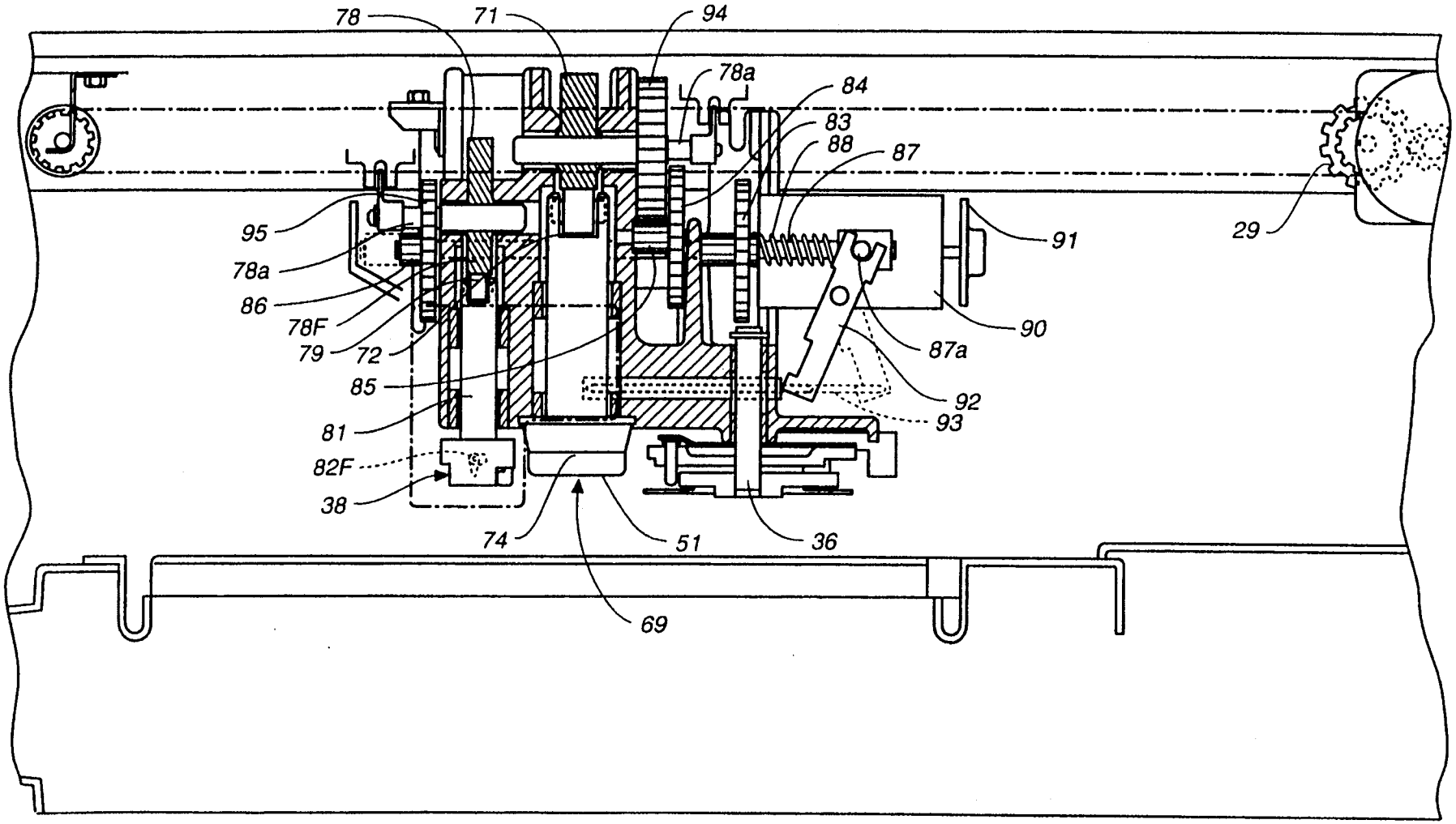
FIG. 12 is a partial cross-sectional front view showing the second gear train in operational mode.
Figure 13:
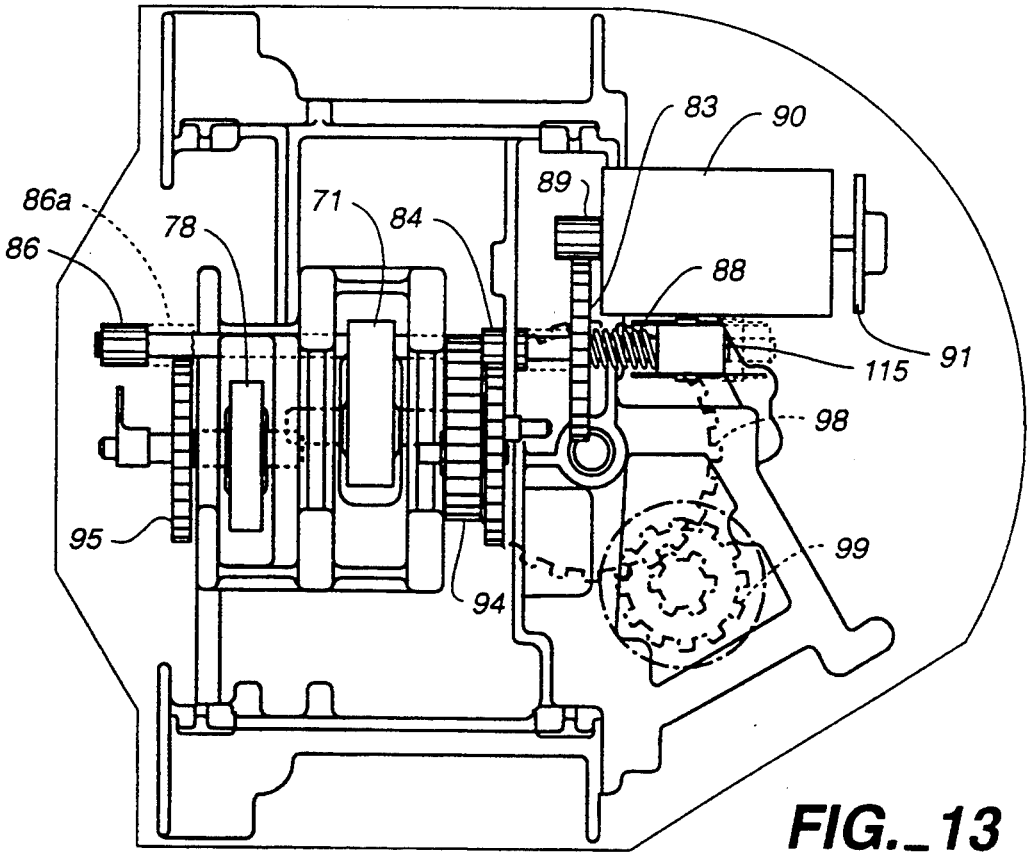
FIG. 13 is a top view of the first gear train in operational position.
Figure 14:
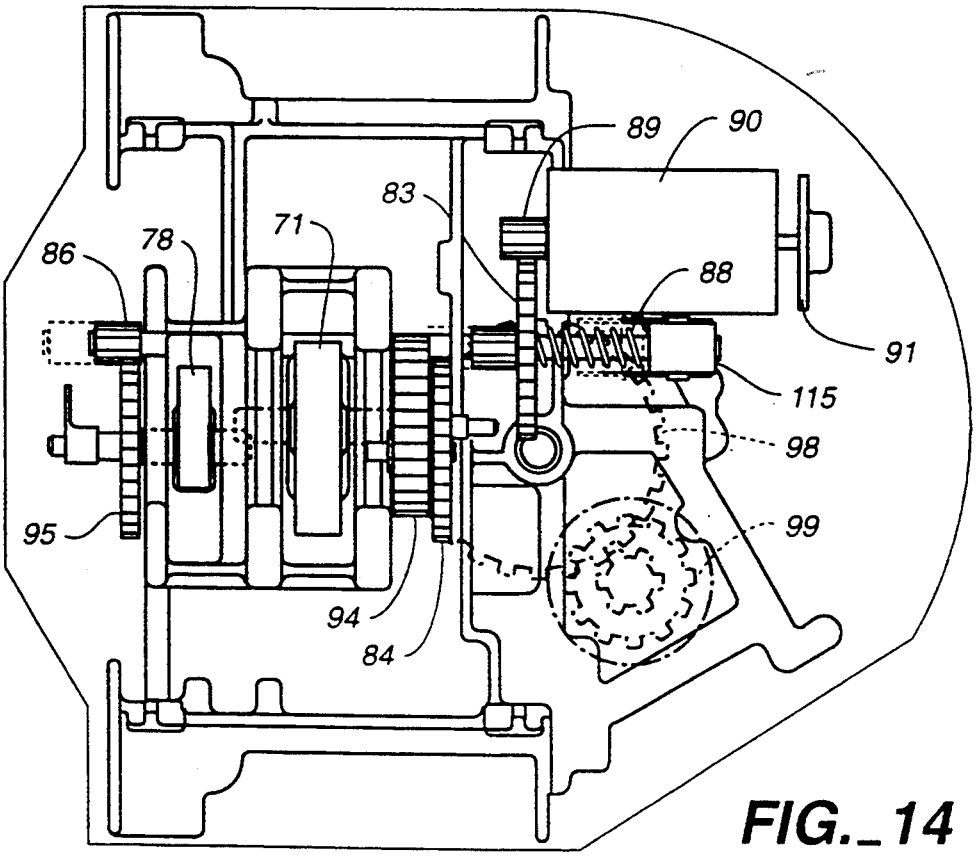
FIG. 14 is a top view of the second gear train in operational position.

In FIG. 12 it is seen that upon removal of the logo cartridge, the first gear train is again placed in operation with gear 86 again driving the cam shaft to cam position 78F to operate the character finger forcer hammer 82 into forcing position against a character finger pad. A heater 82F in the form of a resistor and a thermister to control the heater temperature is provided in the hammer.

The Gear Trains

Figure 15:
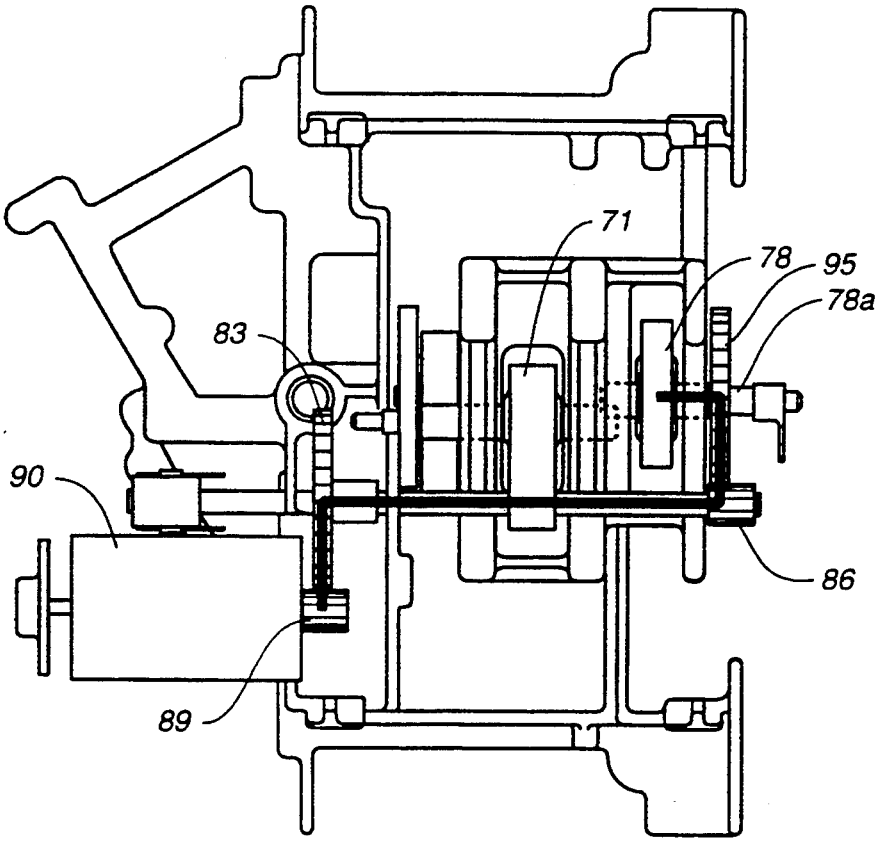
FIG. 15 is a top schematic view of the character finger forcer drive train.
Figure 16:
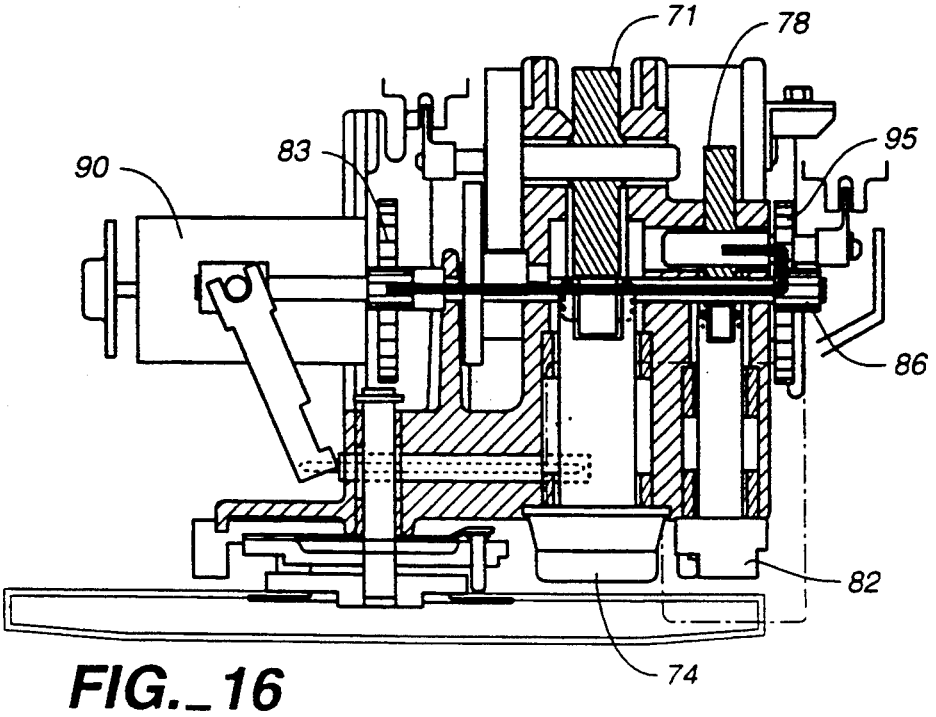
FIG. 16 is a back cross-sectional schematic view of the character finger forcer gear train.

FIGS. 15 and 16 schematically illustrate the first gear train having a final drive ratio of 24 to 1. The servo forcer motor 90 drives gear 1 (89) (10 tooth) which in turn drives gear 2 (83) (56 tooth) which through shaft 87 drives gear 3 (86) (14 tooth) which intermeshes with gear 4 (95) (60 tooth) attached on the character cam shaft 78*a* to rotate the character cam 78. The gear drive path is indicated by the heavy line. All gears are 32 pitch.

Figure 17:
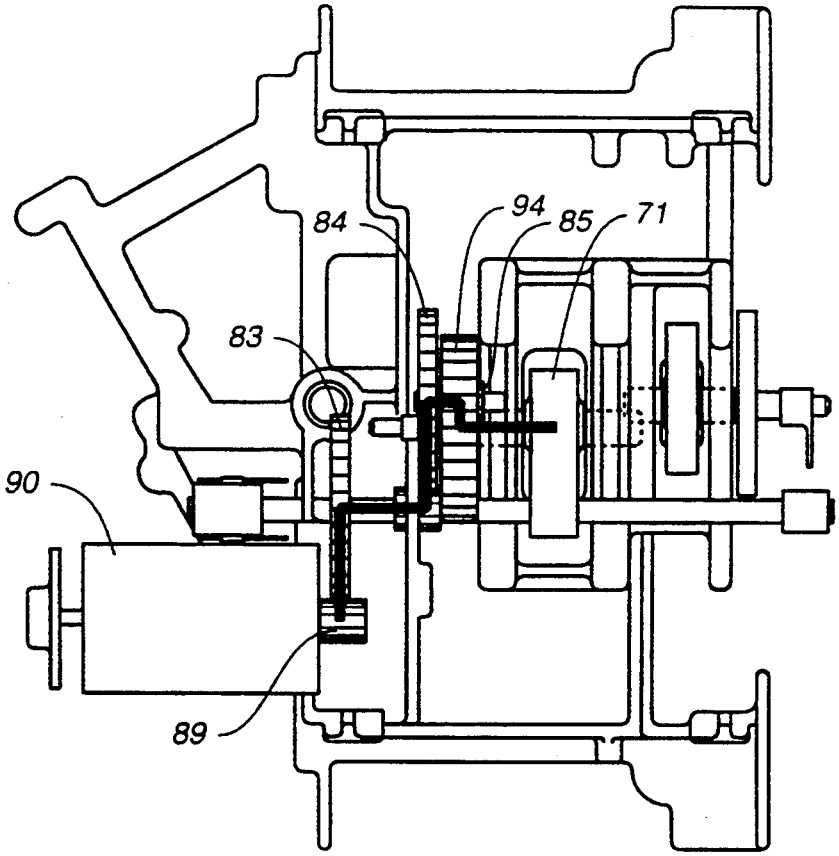
FIG. 17 is a top schematic view of the logo forcer gear train.
Figure 18:
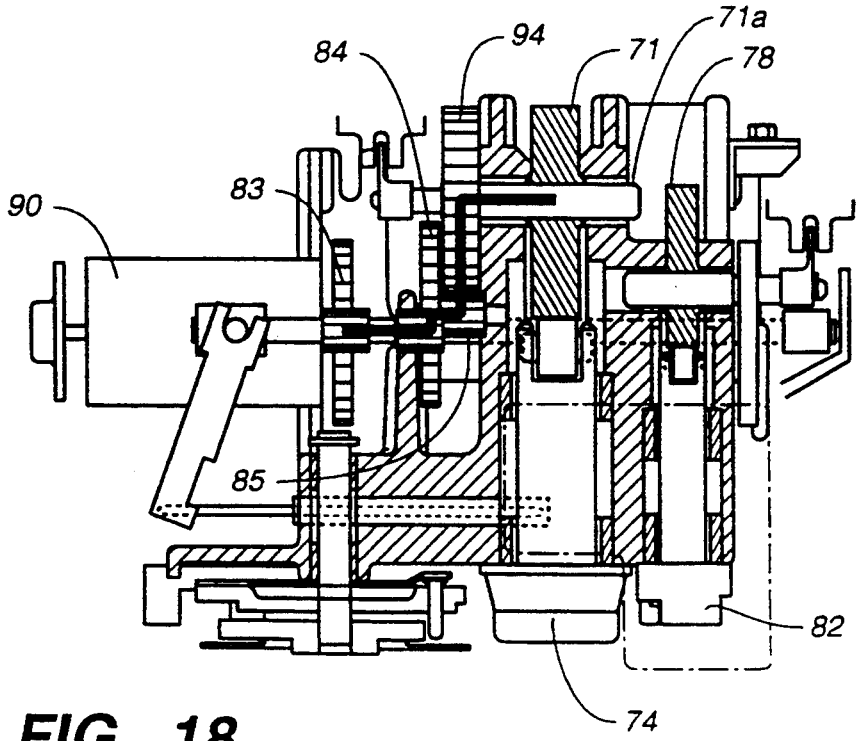
FIG. 18 is a back cross-sectional schematic view of the logo forcer drive train.

FIGS. 17 and 18 illustrate the second (logo) gear train having a final drive ratio of about 110 to 1. The servo forcer motor 90 drives gear 1 (89) (10 tooth) which drives gear 2 (83) (56 tooth) and 3 (14 tooth) which gear 3 drives gear 4 (84) (60 tooth) which turns gear 5 (85) (14 tooth) which in turn drives gear 6 (94) attached to the logo cam shaft 71*a* to rotate the logo cam 71.

The Cams

Figure 19:
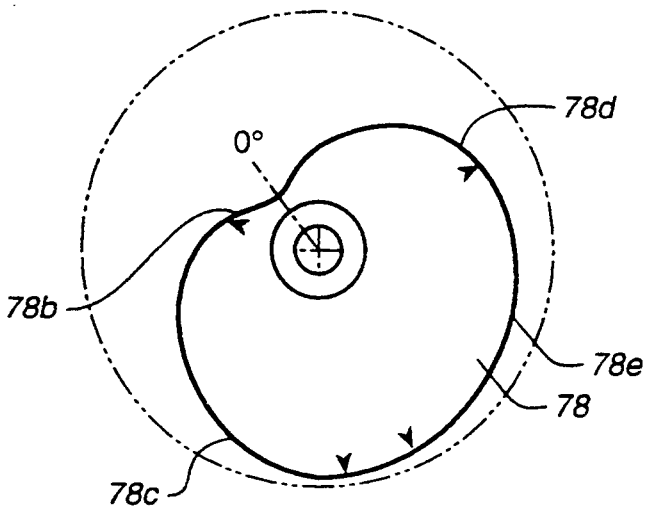
FIG. 19 is a side view of the character cam per se.
Figure 20:
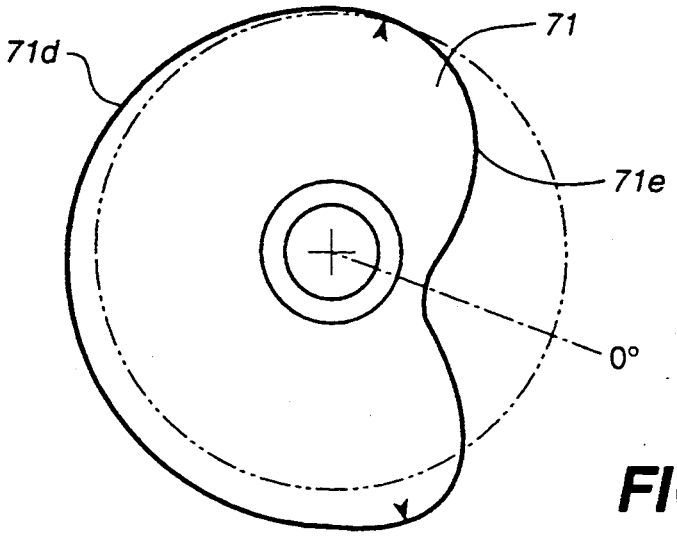
FIG. 20 is a side view of the logo die cam per se.

FIGS. 19 and 20 illustrate the shape of the cam surfaces of the bidirectional character finger forcer cam 78 and bidirectional die cam 71. From the noted zero degree "home" position in FIG. 19 a 0°–25° clockwise rapid rise section 78*b* and a 25°–136° constant rise section 78*c* having a relatively low force is provided. A 0° to 250° (110° total) counterclockwise rapid rise section 78*d* and a 250° to 150° constant rise section 78*e* having a medium force is provided. These sections are generally illustrated by the tick notations on the cam. The upper first rise surface 78*c* of cam 78 results in relatively low forcer forces of from about 3 to 80 pounds (1.4 to 36 kg) while use of the second constant rise surface 78*e* results in about a three times force of from about 9 to 240 pounds (4.2 to 110 kg). The cams are constructed of heat treated and oil quenched copper steel (FC-0208-80 HT) as known in the art. The logo die cam 71 has a 94° rapid rise section 71*e* and one continual rise cam surface 71*d* from about 94° to 300° which, dependent on the position of the cam surface on the cam roller-follower will result in forces of from about 75 to about 2000 pounds (34 to 900 kg) on the logo die forcer and the debossment die.

Figure 21:
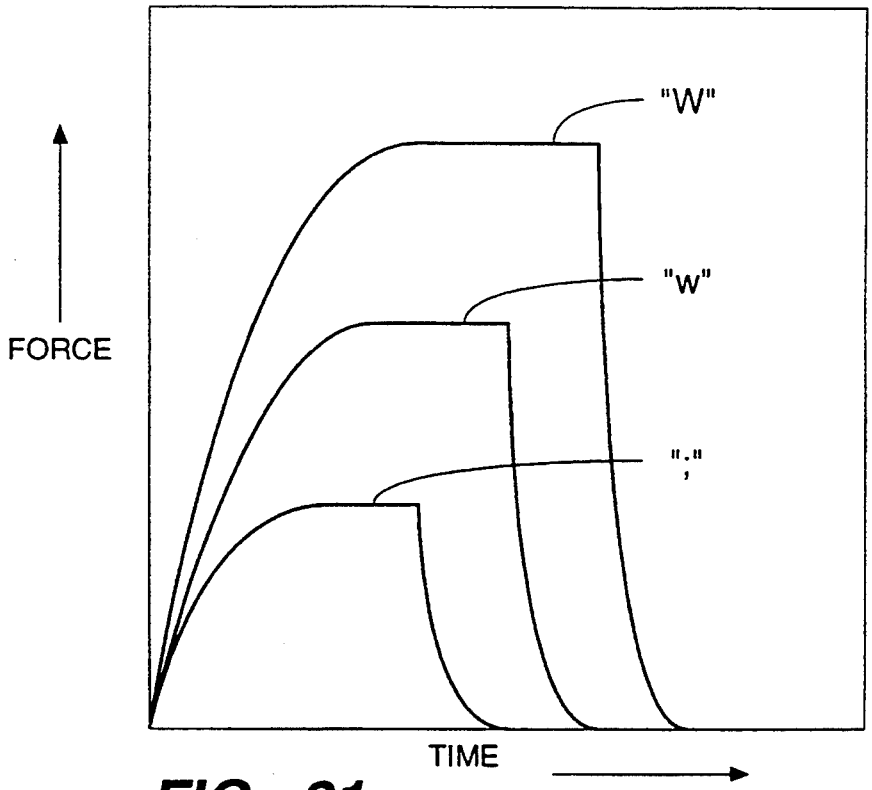
FIG. 21 is a typical force-dwell time graph showing various character curves.

FIG. 21 illustrates graphically typical force-dwell time curves. It is seen the force and dwell time of a comma "," or period "." is substantially less than a small "w". In turn a large "W" has a need for a substantially greater force and dwell time than a small "w".

Figure 22:
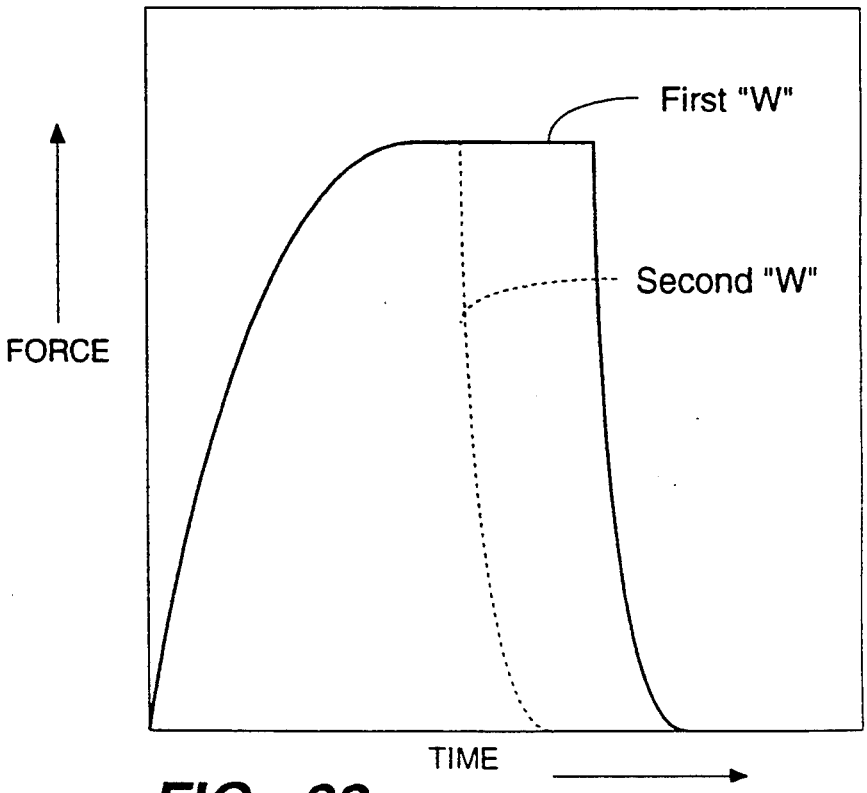
FIG. 22 is a force-dwell time graph illustrating hot striking curves of a single character.

FIG. 22 illustrates graphically the hot strike algorithm where a needed first "W" has a force-dwell time shown in full line where it is necessary to have a full heating cycle of the character. If a second strike of the "W" is made shortly after the first strike the heating cycle may be very short or at least shorter because of the residual heat left in the character while it is undergoing heat decay. This shorter time is represented by the dashed line.

The Platen

Figure 23:
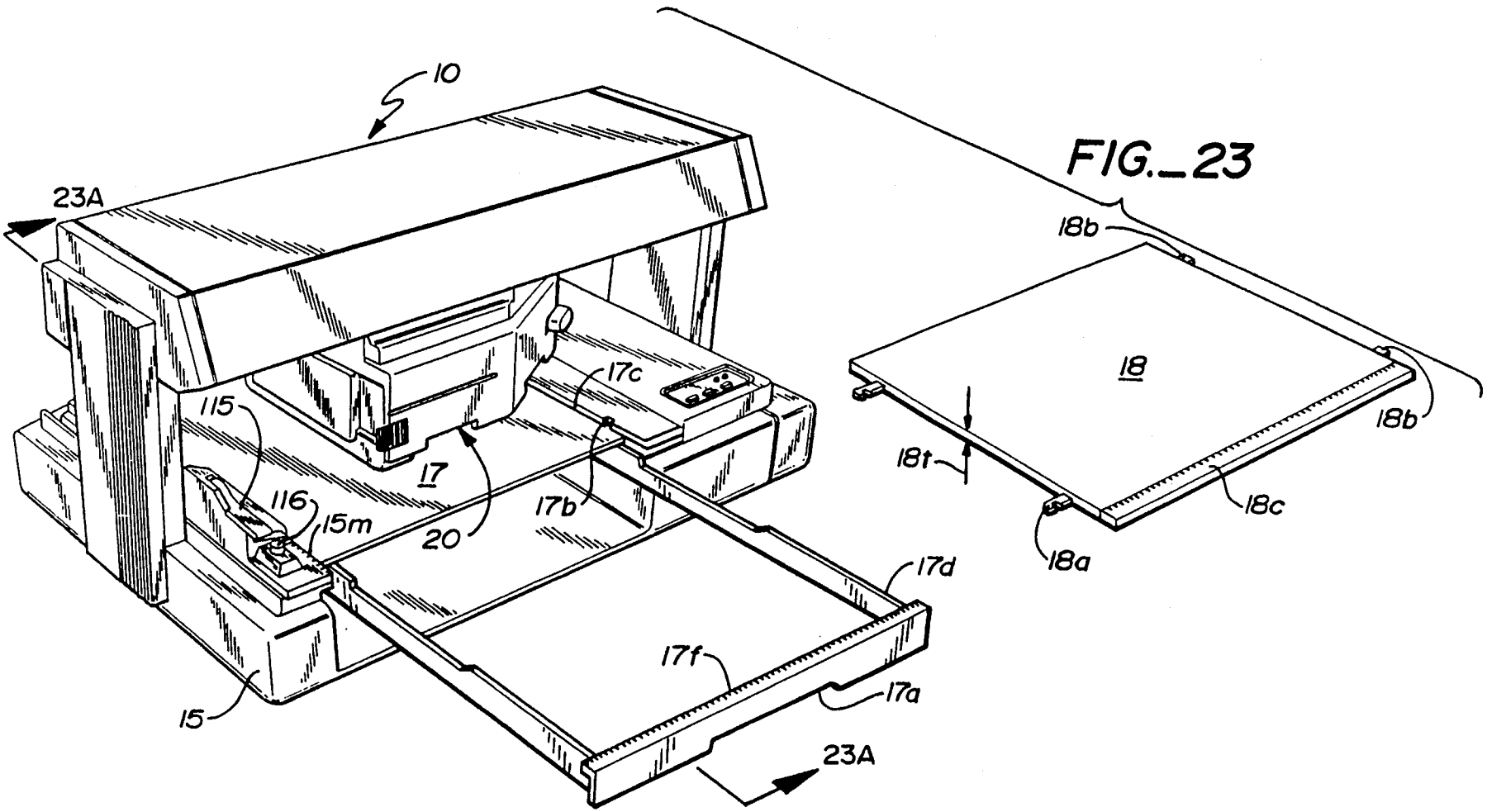
FIG. 23 is an exploded perspective view of the hot stamper with the platen frame in the "out" position and the platen insert removed.
Figure 23A:
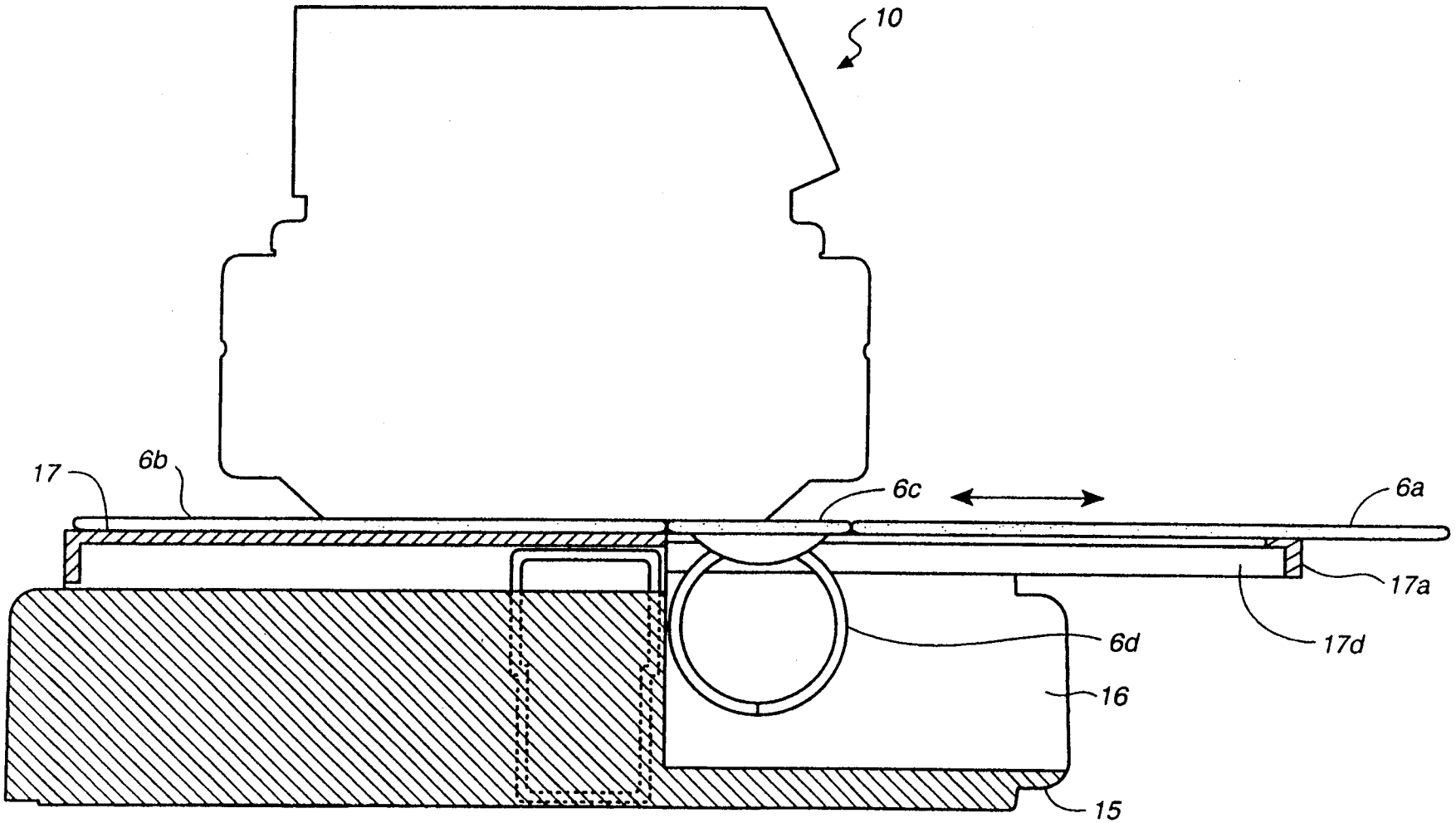
FIG. 23A is a schematic partial cross-sectional view showing the positioning of a ring binder for cover printing.
Figure 25:
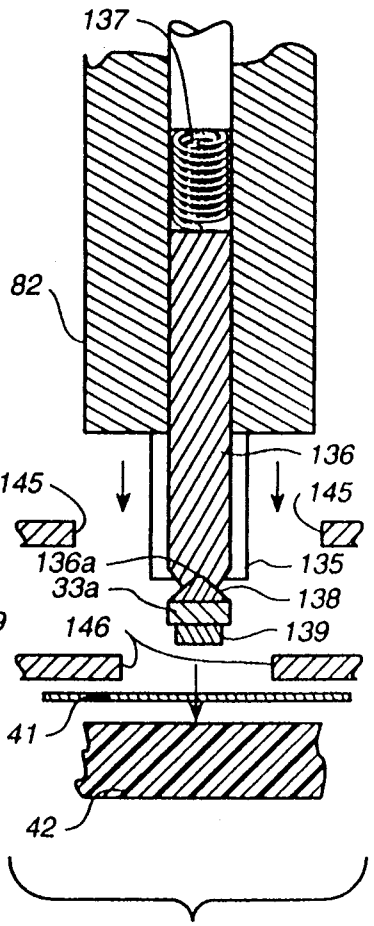
FIG. 25 is an end view of the centering fork in engagement with a character finger ridge taken on the line 25—25 of FIG. 24.

Shown in FIG. 23 is the platen arrangement with platen insert 18 removed from a platen base 17. The platen frame 17*d* is used to support the spine and back cover of ring binders and is pulled out by pulling on a hand-hole 17*a*. The platen insert 18 is removable by releasing workpiece clamp 115, loosening thumb screws 116, shifting the insert rearwardly and then aligning the protrusions 18*b* with slots 17*b* on the platen top 17*c*. The right edge of the insert is lifted out and the slotted protrusions 18*a* lifted out of corresponding slots on the left side of the platen top 17*c*. Measurement indicia 18*c* may be formed on a y-axis edge of the platen insert 18, on the pull-out portion 17*d* front edge 17*f*, and on an x-axis edge 15*m* of base 15. The platen and insert are slidable on a pair of rails and driven in an x-axis by a stepper motor in a character-by-character strike motion. A workpiece/platen cam clamp 115 functions to clamp the top edge of the typical paper stock cover into an initial measured position on the platen. Hand screws 116 are employed to lock the platen insert. The insert may be of a prescribed thickness 18t. If a workpiece is particularly thin a thicker insert may be employed or if a workpiece is particularly thick a thinner insert may be used. For media 0.135" to 0.200" thick only the platen base is used. For media 0.066" to 0.135" a thin platen insert 18 (0.093") is added to the base platen. For media 0.004" to 0.065" thick a thicker platen insert (0.155") is added to the base platen. This thicker platen insert has a top surface which acts as a thermal insulator to retard heat loss through thin covers, thereby cooling the face of the character pads or logo die below appropriate wax transfer termperature. The various platen inserts keep the print surface closer to a nominal position for a wide range of media thicknesses such that the "S" bend of the character fingers is within prescribed limits and the character face is parallel to the surface of the cover during debossment. The platen is driven by a stepper motor and spur gear driving a drive pulley under the right front end of the platen. The drive pulley rotates a belt which extends to a spring-loaded idler pulling under the right rear end of the platen. This is illustrated in FIG. 12 which shows a similar drive for the print engine. The platen slides in a commercially available Accuride linear ball slide (not shown) having spaced springs under the slide, and positioned next to the pulley/belt drive. A conventional L- and inverse L- slide (not shown) is provided under the left side of the platen. In printing (stamping) of a ring binder (FIG. 23A) the front cover 6*b* is placed on the platen 17 (without insert 18) with the ring 6*d* hanging into space 16. The back cover 6*a* is supported by the pull-out frame 17*d* and extends over edge 17*f*.

Forcer Hammer Action

Figure 27:
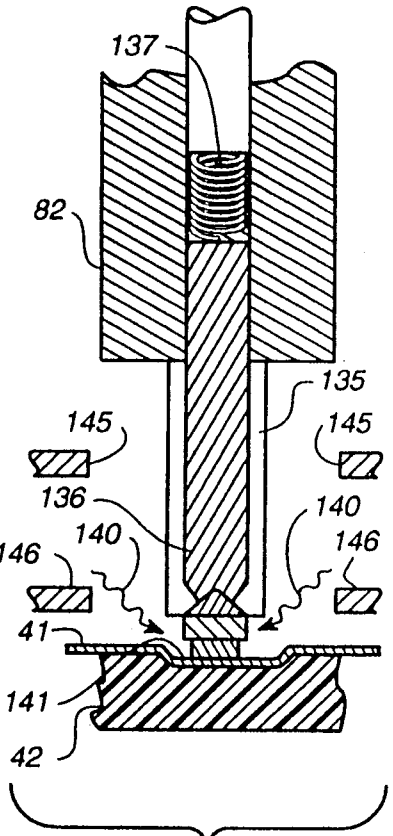
FIG. 27 is an end view thereof taken on the line 27—27 of FIG. 26.
Figure 26:
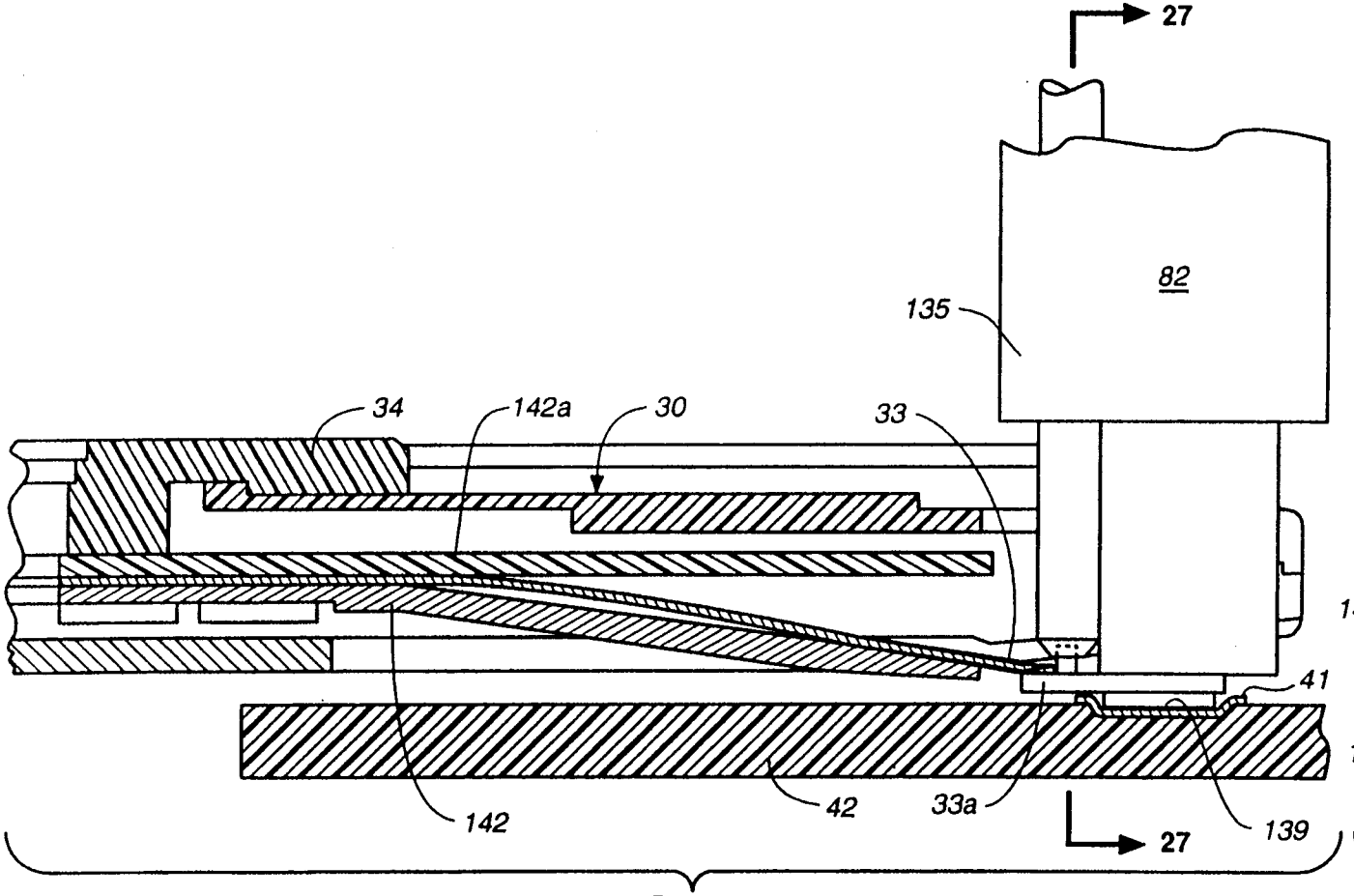
FIG. 26 is a back view similar to FIG. 24 but with the force hammer in debossing position on the character, the tape and workpiece.

FIGS. 24–27 schematically illustrate the action of the character wheel forcer hammer 82 against a character finger 33, more particular against a character pad 33*a*, as well as a character-centering device. The character pad is made of a high thermal conductivity material such as 20C beryllium copper. The centering device 135 is attached to the side of the hammer facing the rotational centerline of the character wheel. This device includes a spring-pressed vertical probe 136 pressed downwardly by spring 137 and having an inverse V-slotted end 136*a*, which probe and slot in a downward motion captures an upstanding triangular ridge or detent 138 at a radial median line on the top of each character pad, the ridge or detent having an inverse V-shaped top surface corresponding to the inverse V-shaped probe end slot. The character pad and the character 139 on the character pad 33*a* are thus captured (FIGS. 24 and 25) and centered with respect to the character wheel slot 146 (FIG. 2) in a desired print position. FIG. 26 and 27 show the further downward advancement of both the hammer 82 and the probe 136 against the character pad 33*a*, the former forcing the character 139 against foil tape 41 and through operation of the hammer heater over a prescribed dwell time (heat arrows 140), debossing the transferable material into a force-depressed area 141 of the typical paper-stock report cover 42. Upon completion of the prescribed dwell time, the hammer rises to its home position pulling the probe off the pad ridge 138 and out of the way of the character wheel before it rotates to the next print position. The centering device compensates for the small lateral movement of the fingers and for gear train play and results in very evenly spaced characters on the debossed line of characters.

FIGS. 24 and 26 illustrate the use of radial plastic strips 142 underlying each finger, such strips protecting the underside of the fingers and assist in returning a depressed finger to its original home plane of storage. An annular rigid plastic plate 142*a* rotating with the hub 34 functions as the character wheel encoding disk the bottom of which forms the plane of storage of the character fingers.

The Character Wheel

Figure 28:
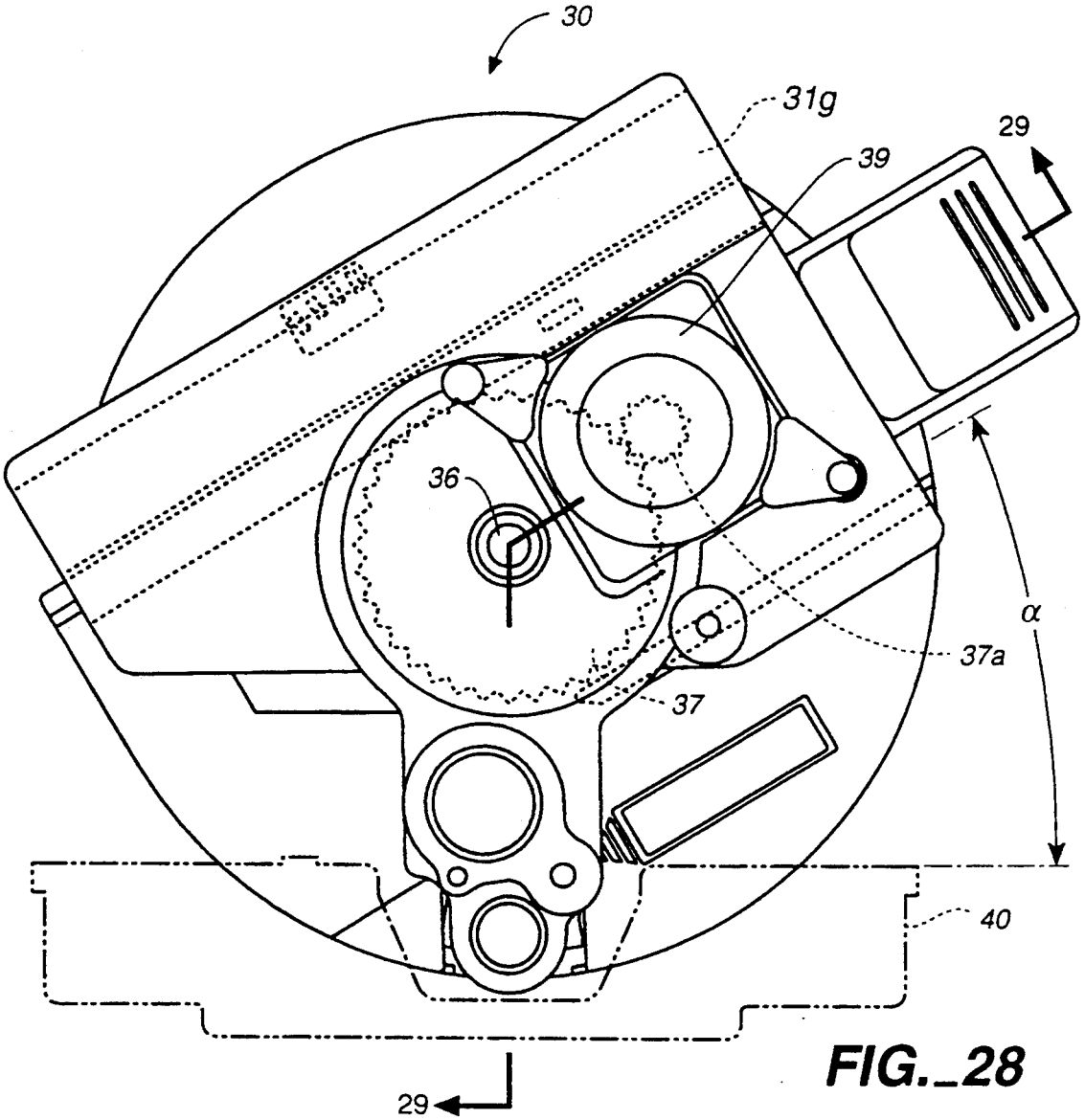
FIG. 28 is a top view of the character wheel gear train.
Figure 29:
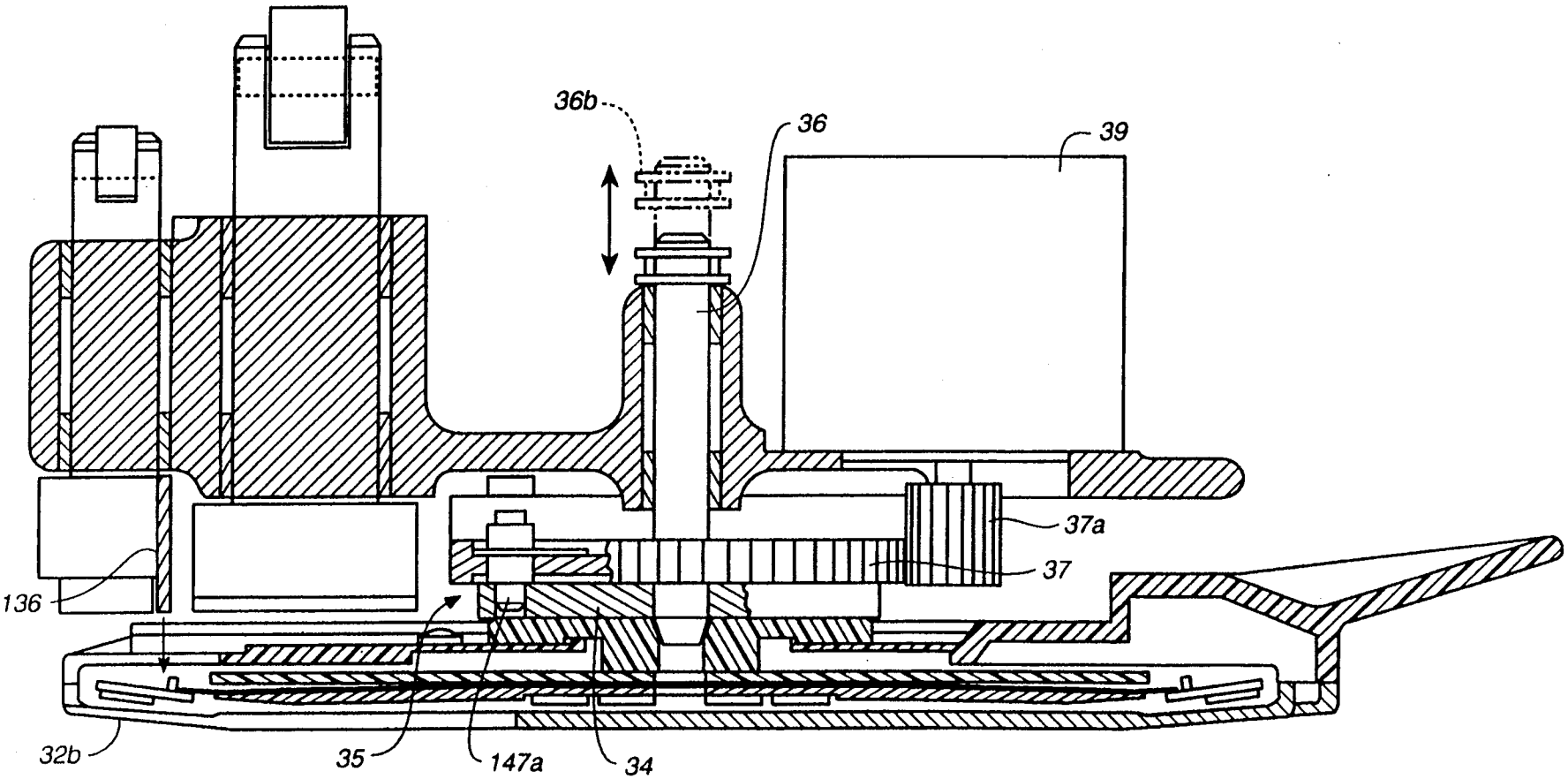
FIG. 29 is a front cross-sectional view of thereof taken on the line 29—29 of FIG. 28.
Figures 30, 30A:
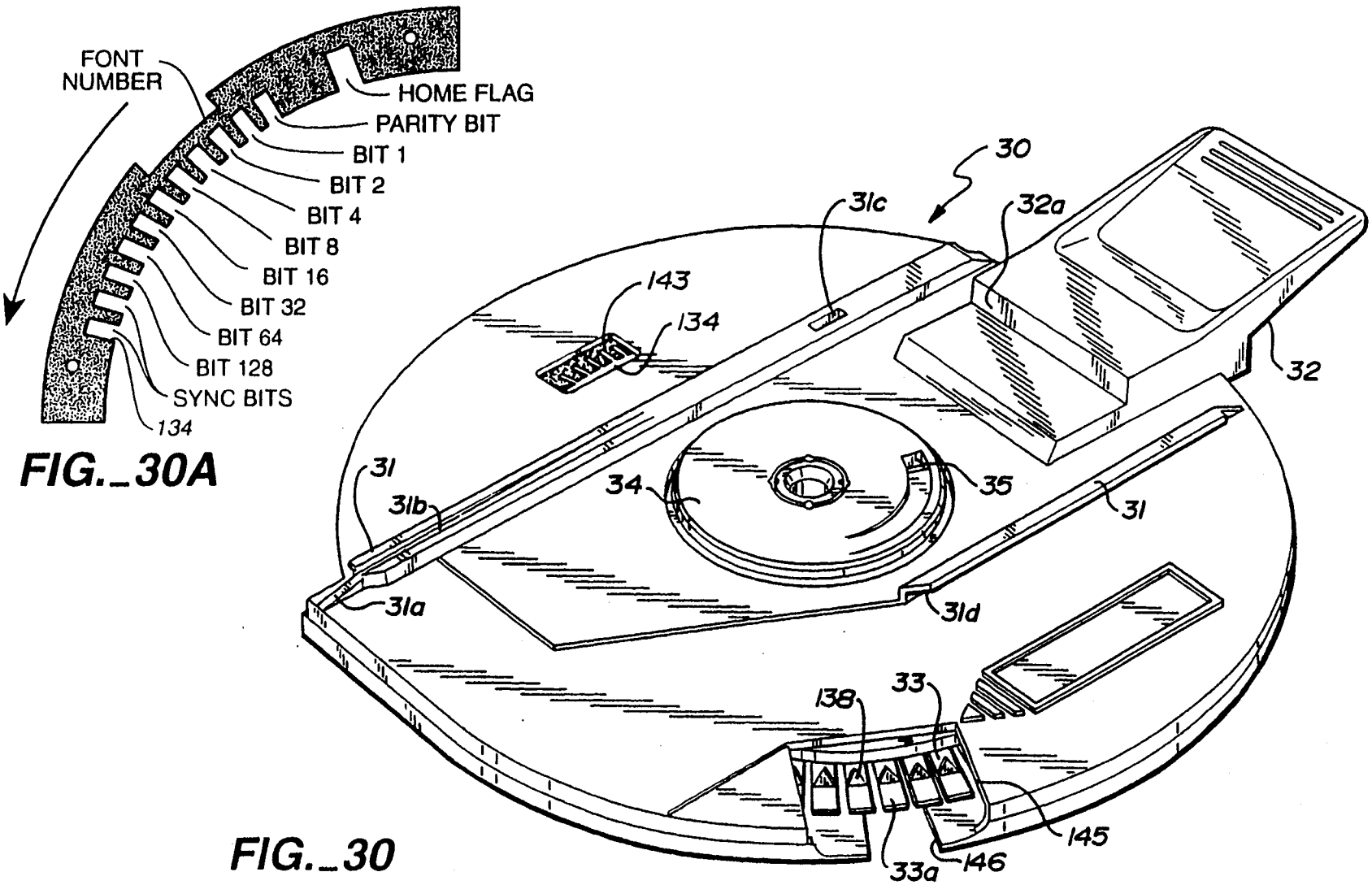
FIG. 30 is a perspective view of the print wheel and casing.
FIG. 30A is a detailed plan view of the reflecting/-non-reflecting arc strip.

FIGS. 28 and 29 show the gear train of the character wheel assembly. Stepper motor 39 drives spur gear 37*a* which drives central gear 37 which is connected to the wheel drive shaft 36 movable into the print wheel hub 34. A shaft throw out bearing 36*b* is provided at the top of shaft 36. A locator pin 147*a* extends from under a peripheral portion of gear 37 which upon rotation enters the print wheel hub ramp and slot 35 on the top of the print wheel casing (FIGS. 2 and 30). As seen in FIG. 28 guide rails 31*g* are provided to receive the corresponding guide rails and grooves 31 of the print wheel casing.

FIG. 30 shows a more detailed and larger view of the print wheel and casing, particularly the wheel hub 34 and print wheel drive homing ramp and slot 35. In addition, one of the linear guide rails 31 which guide the print wheel and casing into the print engine includes ramp surfaces 31*a* and 31*b* as well as an ramp end slot 31*c*.

Figure 31:
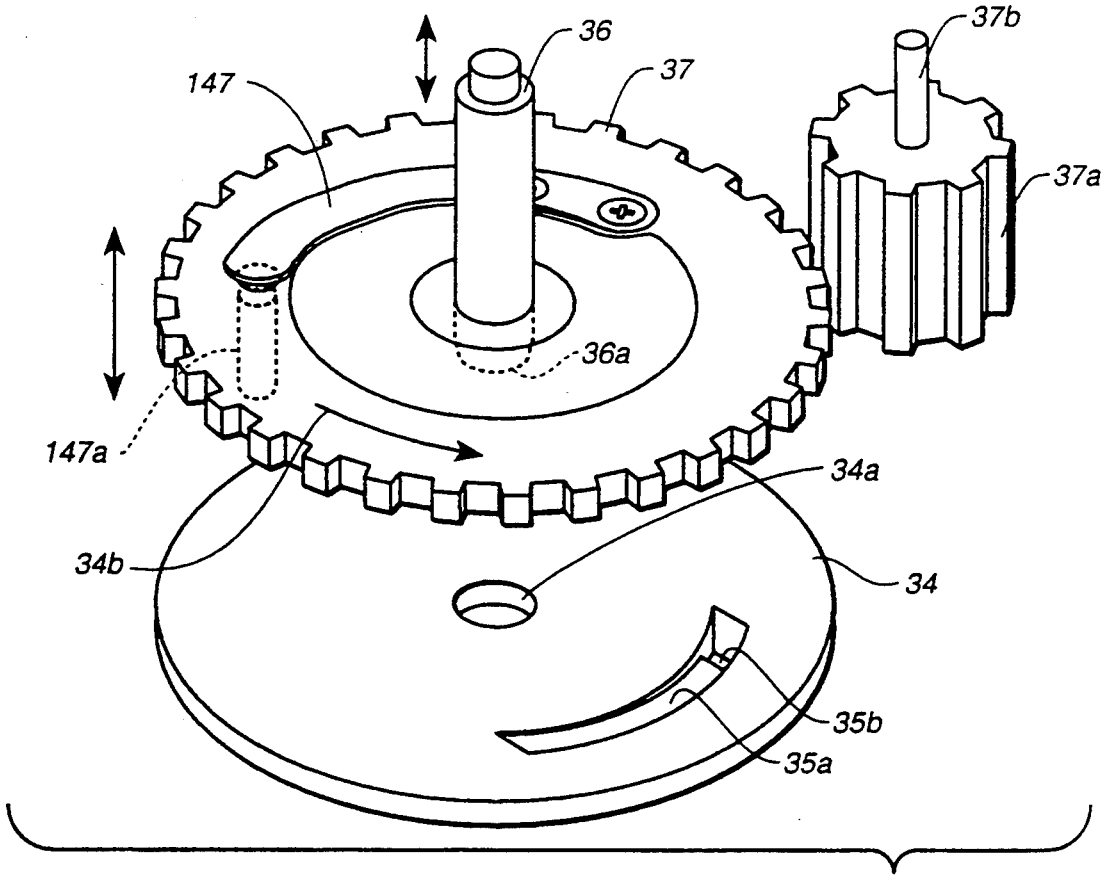
FIG. 31 is a perspective schematic view of the character wheel ramp slot drive mechanism.
Figure 32:
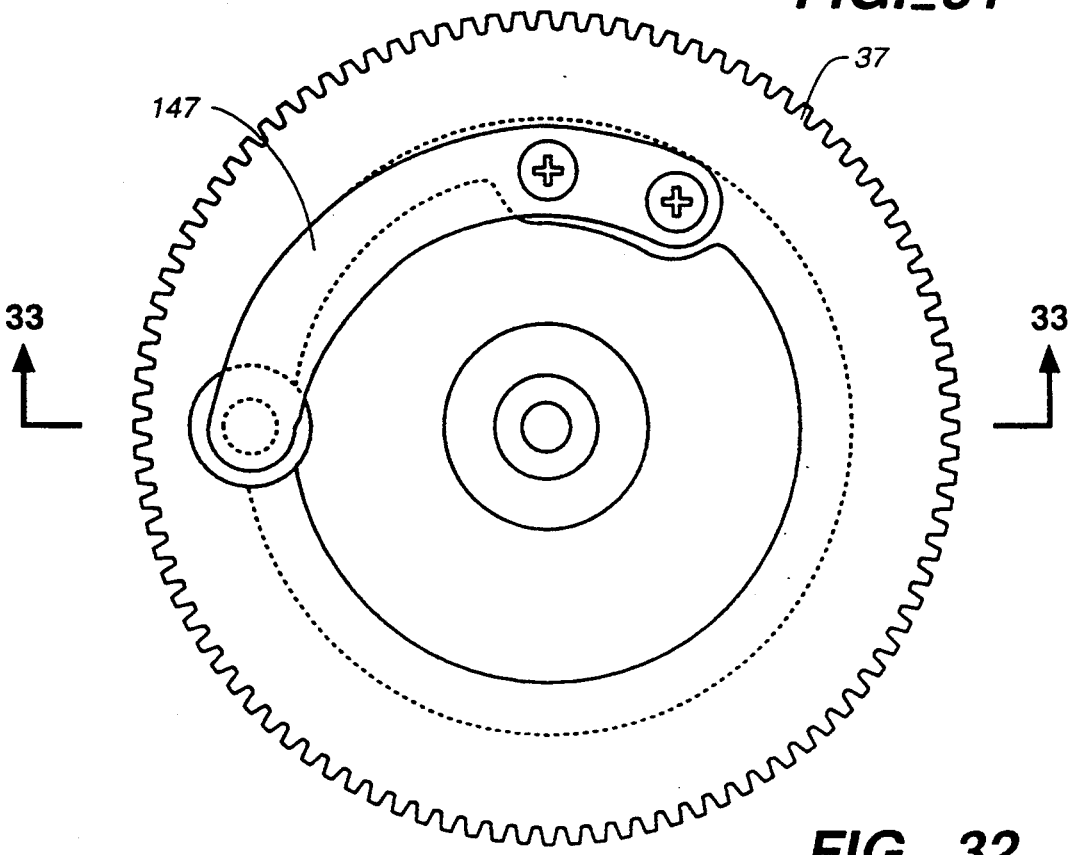
FIG. 32 is a top view of the print wheel gear.
Figure 33:
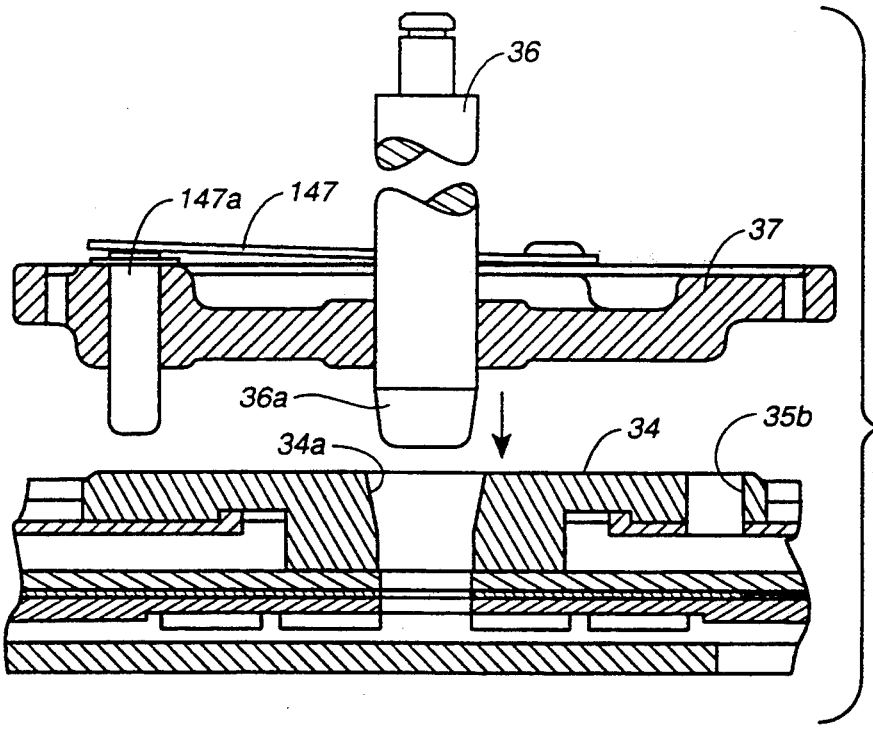
FIG. 33 is a cross-sectional view thereof taken on the line 33—33 of FIG. 32.
Figure 34:
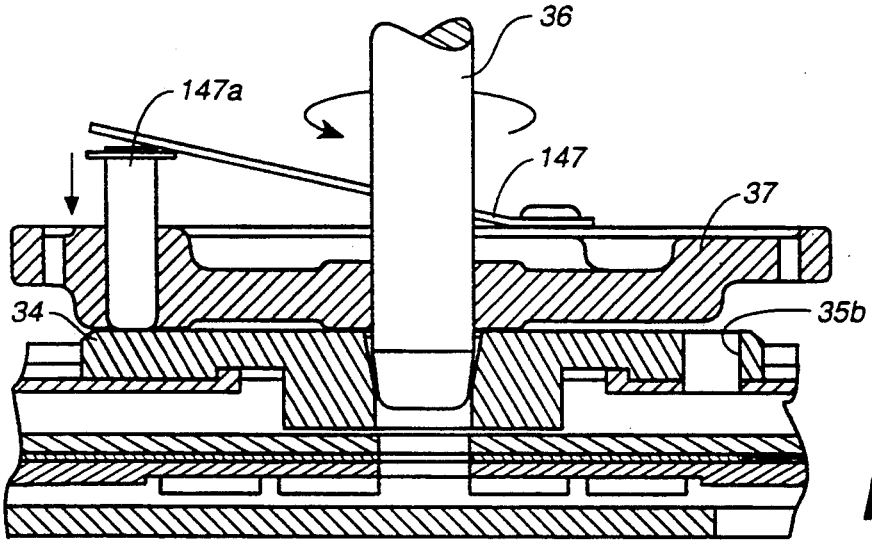
FIG. 34 is a cross-sectional view thereof with the locator pin up.
Figure 34A:
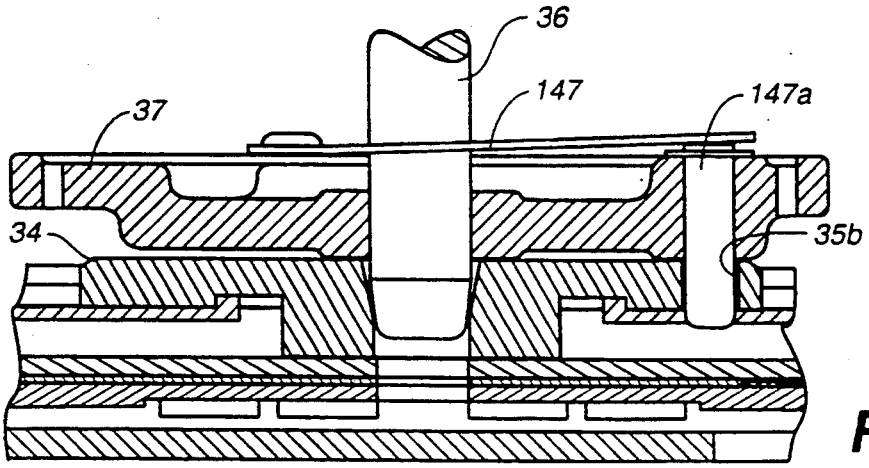
FIG. 34A is a cross-sectional view thereof with the locator pin engaged.

As seen in FIG. 31 a print wheel gear shaft 36 is molded to a print wheel drive gear 37 driven by a drive gear 37*a* which is driven by a stepper motor drive shaft 37*b* connected to stepper motor 39 (FIG. 29). Gear 37*a* does not move up or down but is in continuous engagement with gear 37 which does move up and down with the shaft 36 with its teeth sliding up and down on the meshing teeth of gear 37*a*. The shaft 36 moves up to clear the print wheel hub 34 by operation of a mechanical linkage (FIGS. 35–37) actuated by the print wheel insertion. A curved leaf spring 147 is attached to the top surface of gear 37 and has a distal end fixedly mounting a locator/locking pin 147*a* which due to its spring movement moves up and down and along the ramp 35*a* into a through notch or slot 35*b* in the hub 34 at the end of the ramp. A bottom nose 36*a* of the shaft 36 extending under gear 37 engages into the print wheel center aperture 34*a* for centering. The gear 37, spring 147, pin 147*a* and shaft 36 are seen in more detail in FIGS. 33–34A. When the daisy character wheel and casing is inserted into the print engine (FIG. 2) the spring-pressed locator pin 147*a* rides above hub 34 on the top of the character wheel casing and the gear 37 is rotated (arrow 34*b*) so that the locator pin 147*a* slides down the ramp 35*a* until it drops into the rectangular through-slot 35*b* and stays there by spring pressure from spring 147. The gear makes a slow revolution in the direction of ramp 35*a* with the pin at an intermediate vertical position until it finds the slot 35*b*. This places cylindrical drive pin 147*a* at a predetermined "home" portion of the wheel in the casing. The hub and attached wheel can then be driven in either rotational direction to rotate the print wheel in that direction so as to reach the particular character to be printed in the shortest elapsed time.

Figure 35:
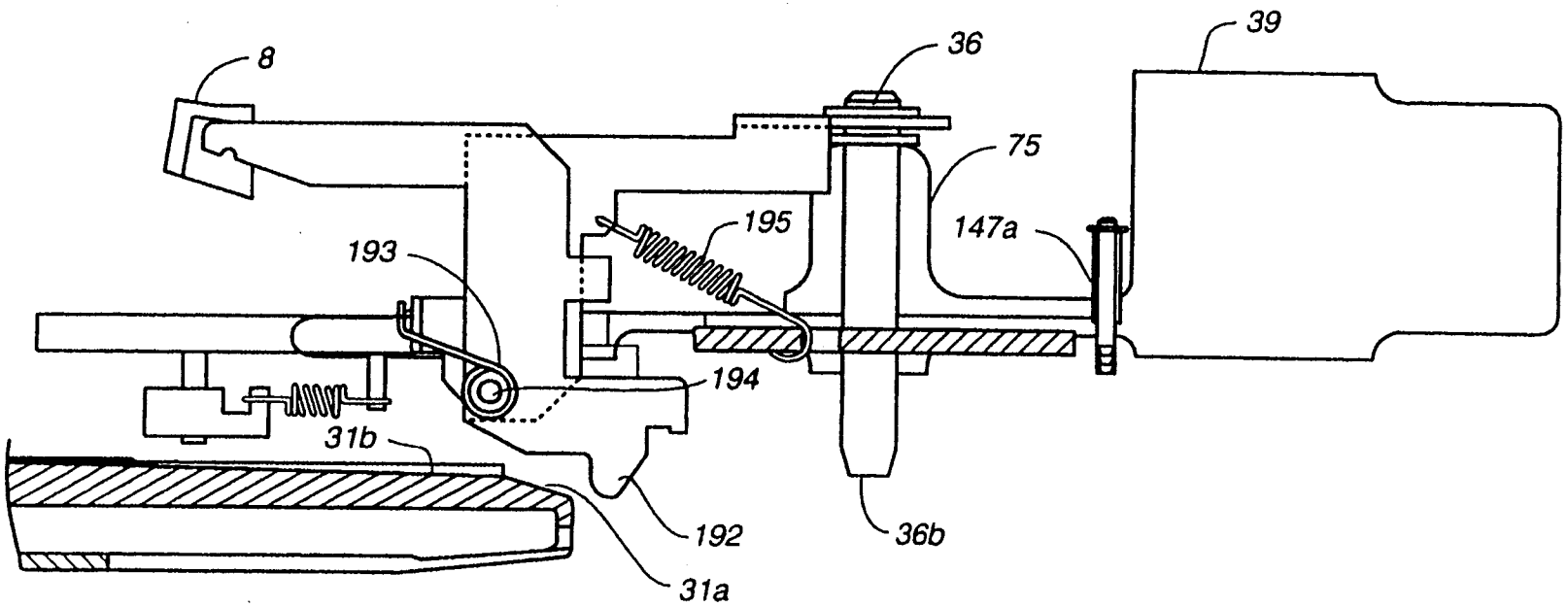
FIG. 35 is a schematic side view of the print wheel and casing locking mechanism at casing entry.
Figure 36A:
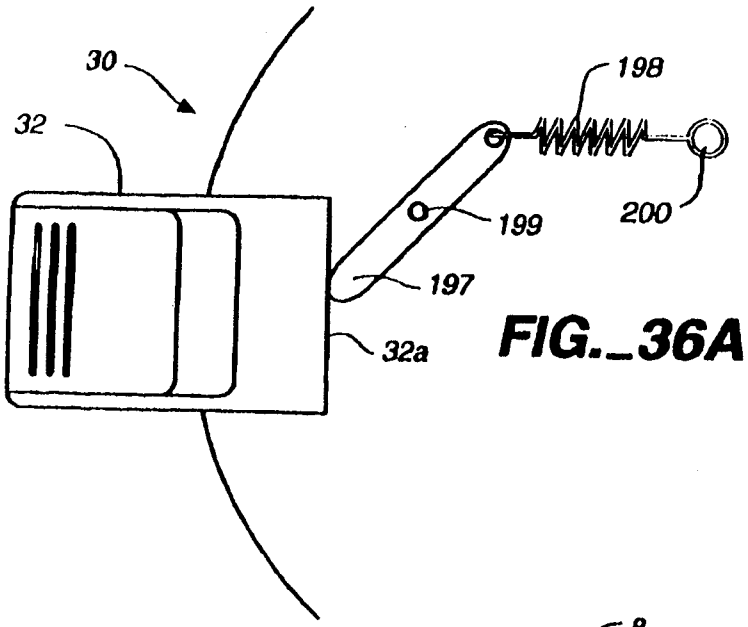
FIG. 36A is a schematic top view of the print wheel eject mechanism.
Figure 36:
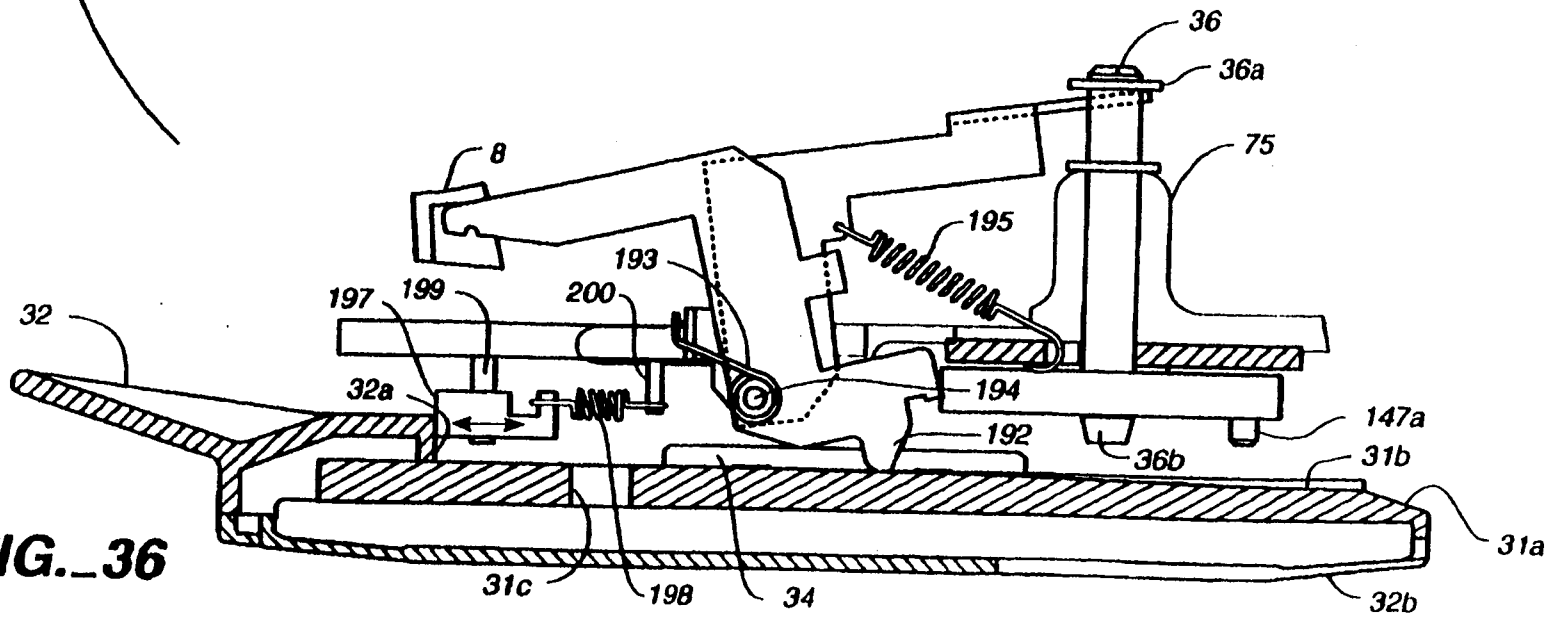
FIG. 36 is a schematic side view thereof with the lock and print wheel shaft UP and a monitoring of the print wheel inserted into the print engine.
Figure 37:
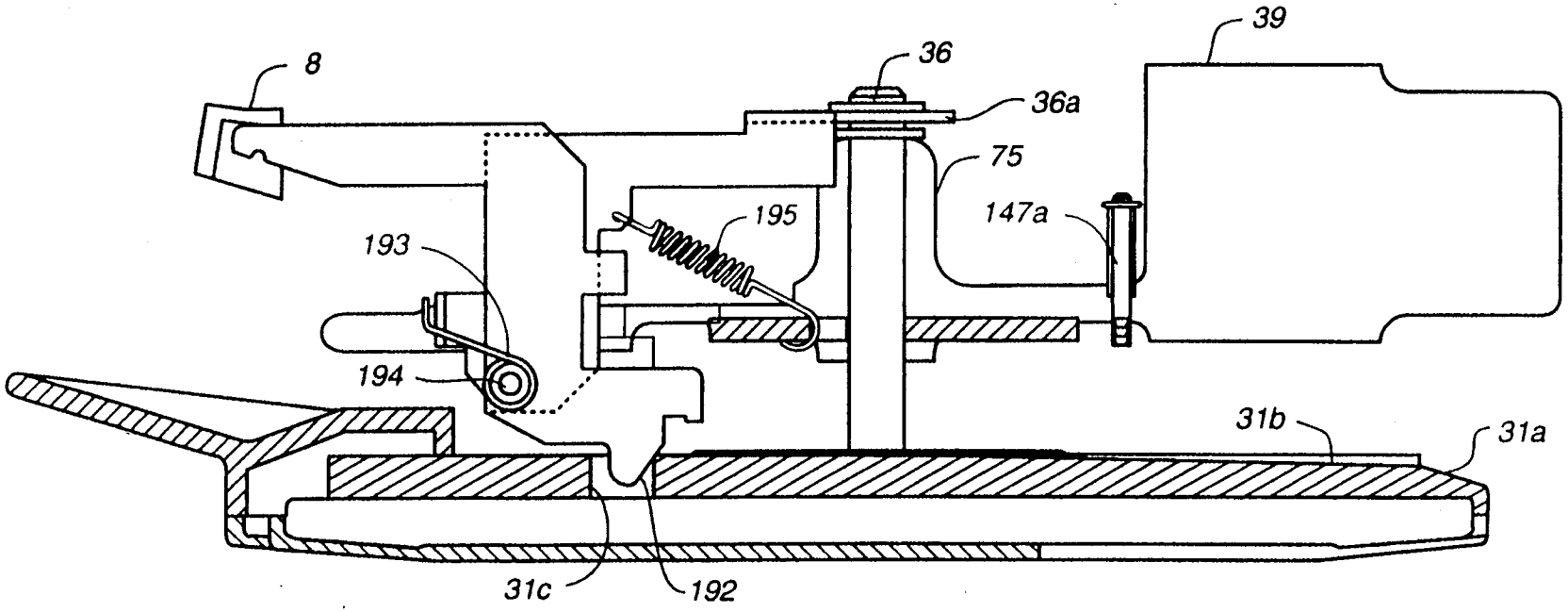
FIG. 37 is a schematic side view thereof with the print wheel and casing fully inserted and locked and the print wheel shaft DOWN.

FIGS. 35–37 describe the mechanical linkage for locking the print wheel and casing into the print engine and for releasing the print wheel and casing including pin 147*a*. As seen in FIG. 35 as the primary ramp 31*a* in guide rail 31 is inserted into the engine it contacts a print wheel locking tang 192 which is pivotably moved upwardly about pivot 194 as ramp portion 31*a* progresses inwardly. This begins to raise shaft 36 which movement continues as the secondary ramp 31*b* (FIG. 36) pushes tang 192 further upward. By the time the top of the ramp 31*b* is reached the shaft 36 is at a full "UP" position. Still further linear movement of the print wheel/-casing inwardly (FIG. 36) over the top surface of the casing (and as guided by rails and grooves in the casing and in the print engine) leads to an inner print wheel operational position (FIG. 37) where the tang 192 drops into print wheel casing slot 31*c*. A print wheel release handle 8 (FIG. 2) extending from the print engine, is pressed down to unlock both the tang 192 from slot 31*c* and simultaneously raise locator pin 147*a* from the slot/notch 35*b* in the print wheel hub 34 and shaft end 36*b* from the center of the print wheel hub so that the print wheel and casing 30 can be removed from the print engine by sliding it out as guided by rails and grooves 31. A tang coil spring 193 (FIG. 37) surrounds pivot 194 and has a first end fixed to the tang upper section and a second-end (not shown) fixed to the top of the right guide rail. Spring 195 (FIG. 37) biases the shaft 36 and attached gear 37 down, causing the shaft end to locate in the central aperture 34*a* of the hub. In FIGS. 36 and 36A, the print wheel cartridge is partially ejected by a pivotable ejection lever 197 operated by a spring 198. One end of the spring is attached to a pin 200 in the print engine casting 75, the other to the pivoted lever. The lever 197 which is in continuous contact with the fully inserted print wheel pivots on a pin 199 in the casting 75. When the tang 192 is released the ejection lever, which is in contact with the print wheel casing, namely a handle portion 32*a*, and the release of the extended spring 198, forces the print wheel and casing out of the print engine. The shaft 36 extends through a bore in the print engine casting 75 (FIG. 7)

Figure 38:
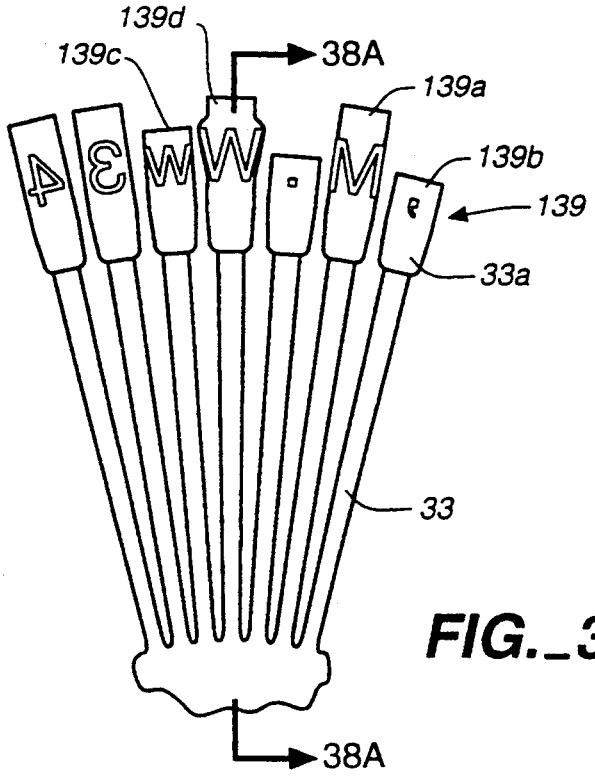
FIG. 38 is a partial bottom view of an arc of several character fingers showing character pads of differing lengths.
Figure 38A:
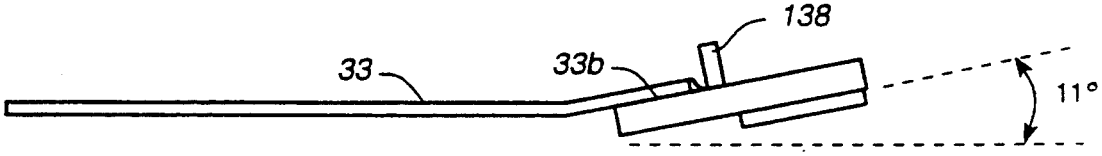
FIG. 38A is a side view of a single character finger and a character pad.
Figure 39:
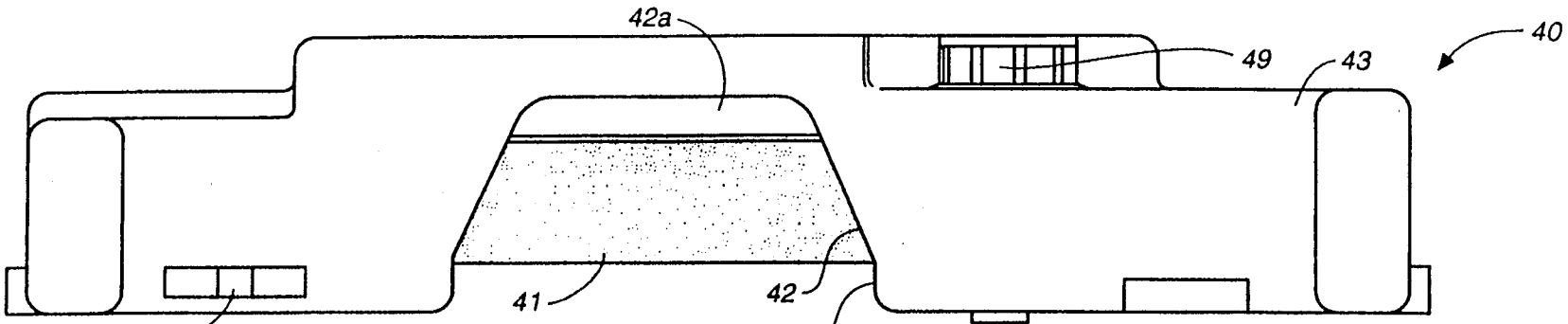
FIG. 39 is a top view of the character finger foil tape cartridge.

FIG. 38 illustrates the underside of a group of character wheel fingers showing fingers 33, character pads 33*a* welded thereto at 33*b* and raised characters 139 thereon. Heat loss through the spider fingers 33 is low because it is inhibited by conductivity loss through the weld 33*b* (FIG. 38A) and because the fingers 33 have a small cross sectional area and are constructed of a low thermal conductivity material compared to the character pads (steel compared to copper alloy). Character pads for a small character 139*b* on which less heat input is necessary to raise it to a debossing temperature of about 190° F. to 250° F. (88° to 121° C.) are smaller in radial length than those pads having a large character 139*a* on which more dwell time is necessary. The result is that print time for small characters is less not only for the reason that the character itself is smaller but the mass of the character pad for that small pad is also less due to its smaller radial length. Less dwell time means faster debossment of a series of characters. A mid-size character 139*c* has a radial length between the radial lengths of characters 139*a* and 139*b* for the same purpose. A dual capitals wheel, i.e., one with a large capital W 139*d* and a smaller capital w 139*c* as in FIG. 38, allows one to print in all capital letters but with the first letter of a word in a larger capital letter, as well as all letters of one line in large capitals and all letters in another line in small capitals. The result is three different styles on the same print wheel. FIG. 38A illustrates the preferred angular orientation 11° of the character pad before a forcing stroke is applied.

The Foil Cartridges

FIGS. 39, 40, 40A and 40B illustrate the foil cartridges 40 and 60 of the invention. Each of the dual cartridges includes a casing 43. The cartridges 40 and 60 differ in two main ways, namely, the width of the foil tape is wide, typically 1.75 inch (4.45 cm.) in the logo die cartridge 60 while the foil tape width, typically 0.75 inch (1.91 cm.) in the character wheel foil tape cartridge 40 is narrower. Accordingly the cartridge casing in the logo die cartridge 60 is wider as seen in FIG. 2. Arched strike window 42 and 42*a* forming a casing side indentation 42*c* provide for access of the character wheel forcer (or die forcer when that debossment die mode of operation is being utilized) and allows the forcer(s) heated hammer(s) to strike the top of the foil tape centrally positioned in the window 42 so that the tape transfer medium on the tape bottom is debossed into the workpiece surface. An outer peripheral bevel 32*b* is provided on the underside of the print wheel casing, particularly adjacent to the underside strike window 146 so that the insertion of the casing into the cartridge indentation 42 or vice versa does not cause snagging of the tape extending across the respective bottom strike windows. The indentation includes a horizontal rib 43*t* under which a peripheral edge of print wheel casing at the casing strike windows is inserted or vice versa. The peripheral exterior of the sloped bottom edges 32*b* of the print wheel casing on either side of the lower strike window 146 abuts rib 43*r*. The central portion of the indentation 42*c* and ribs 43*t* and 43*r* form a recess 42*v* to receive the strike windows portion of the print wheel casing.

A supply spool 44 includes a sinuous anti-back rotation spring 44*a* having a central bight 44*e* portion extending partially around the spool or reel shaft and intermediate portions extending between a pair of cross-pieces comprising spaced fixed posts 44*b* and fixed angles 44*c* between the front and rear sides of the casing. The spring has distal ends 44*d* terminating at a position abutting in friction contact the spool circular interior surfaces. This provides a friction, preventing free-wheeling and back rotation of the supply reel 44. A take-up spool 45 includes a similar anti-back rotation spring 45*a*, and similar posts 45*b* and angles 45*c*. These anti-back rotation springs enable the cartridge to act as a uniform tape puller to strip loose tape that is sticking to the workpiece from a just-completed debossment as the platen advances character-to-character.

A gear 46 is attached to the tape-up spool and driven about shaft 47. Gear 46 is driven by gear 48 which has a spike-rear opening 49*a*. Upon introduction of the cartridge into stamper entrance 23 the spike opening engages a blade-ended drive shaft of the cartridge stepper-motor 40*b* (FIG. 5). The blade is spring-loaded so it will clutch engage the spike opening as it begins to drive. The tape advance gear train 40*a* and tape advance stepper motor 40*b* are seen in FIG. 5.

The tape 41 from the supply spool 44 passes around a pair of fixed guide pins or rollers 62 and around an idler roller 63. A finger notched thumb wheel 49 accessible at the top front edge of the cartridge can be employed to tighten the ribbon before entry of the cartridge into the print engine entrance 23. A series, preferably four, of 90° reflector pads 64 are provided on the supply spool along with a spool sensor 105 (FIG. 52) for detecting tape jamming, broken tape or a "tape running out" condition. Opposed notches 43*a* guide the cartridge into corresponding spaced parallel ridges 24*a* on the print engine. The notches 75*a* in the casting 75 and ridges on the engine housing 24 can be at different levels or spacing (such as phantom ridge 43*d* and notch 75*b* in FIG. 40) or different sizes dependent on the stamper model.

Figure 40A:
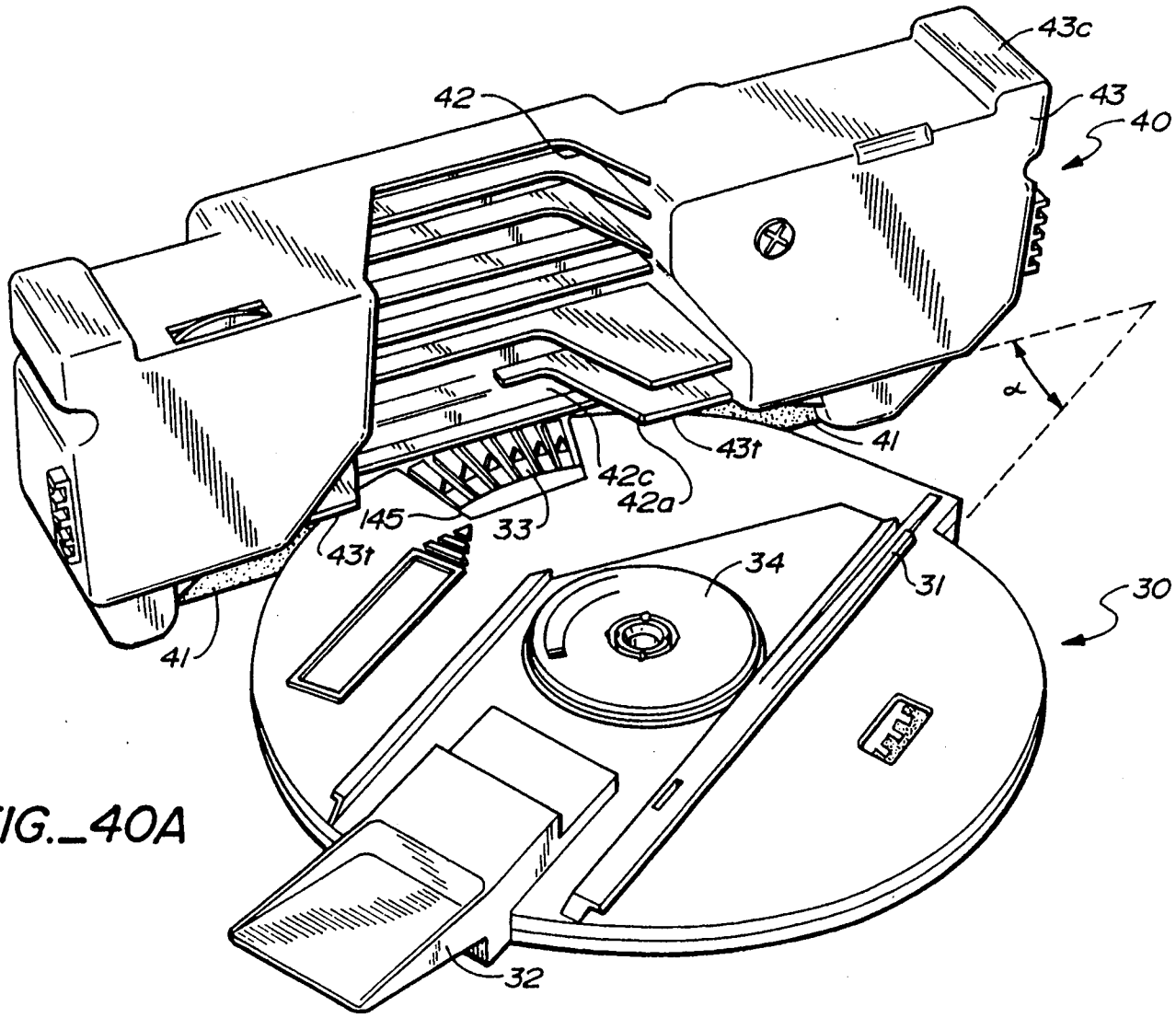
FIG. 40A is a perspective view showing the mating of the character tape cartridge and the print wheel and casing.
Figure 40B:
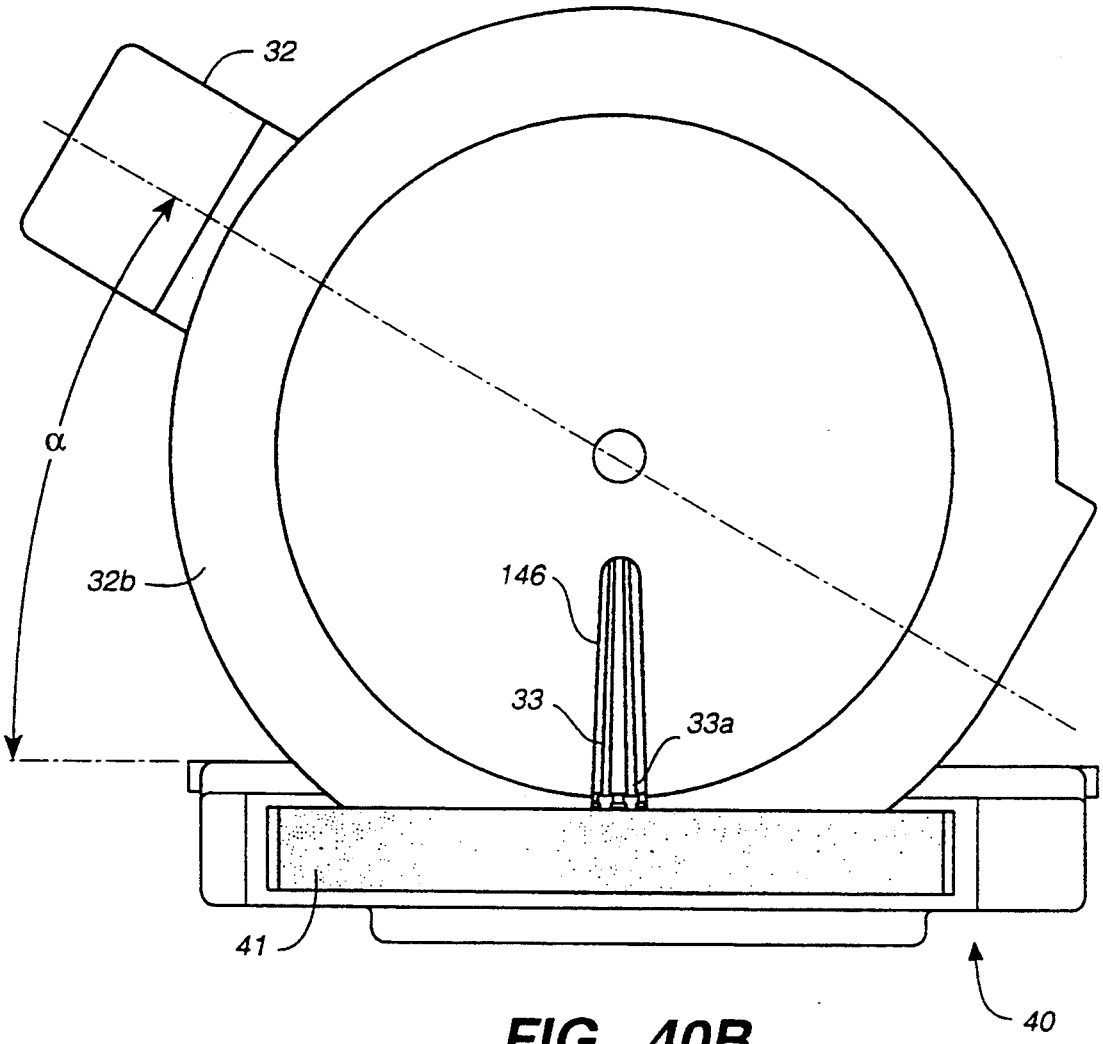
FIG. 40B is a bottom plan view of the mating position of the print wheel casing above the transfer tape of the cartridge of FIG. 40A.
Figure 41:
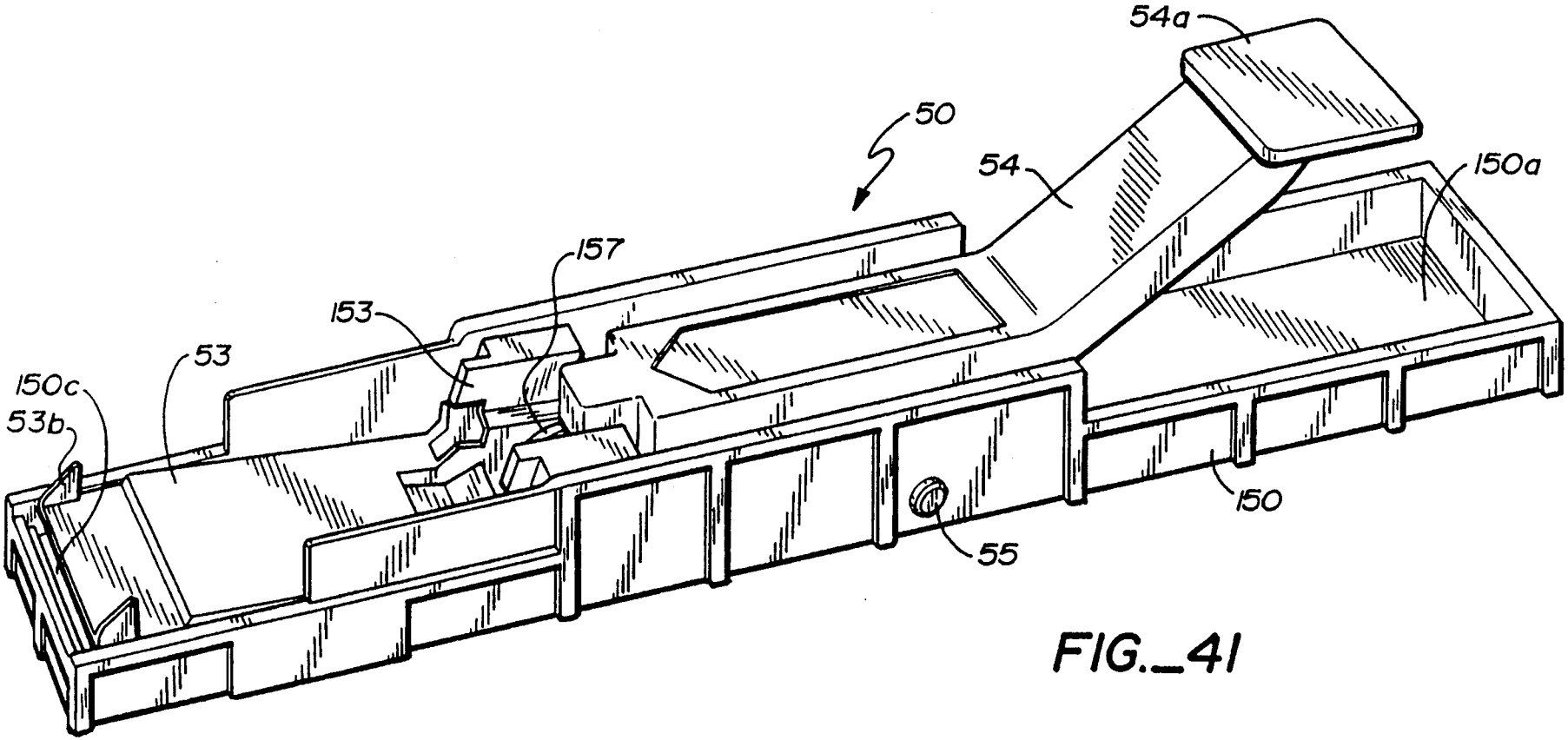
FIG. 41 is a perspective view of the logo loader-unloader.
Figure 43:
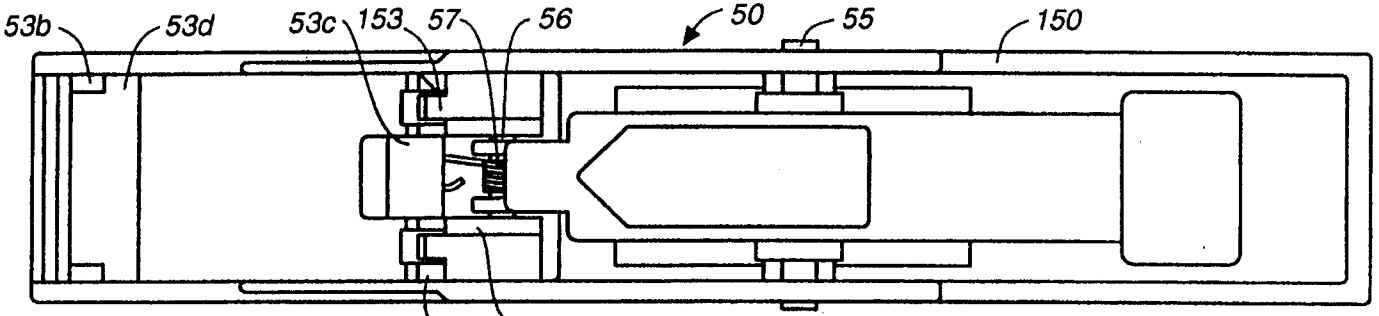
FIG. 43 is a top view of the logo loader-unloader per
Figure 44:
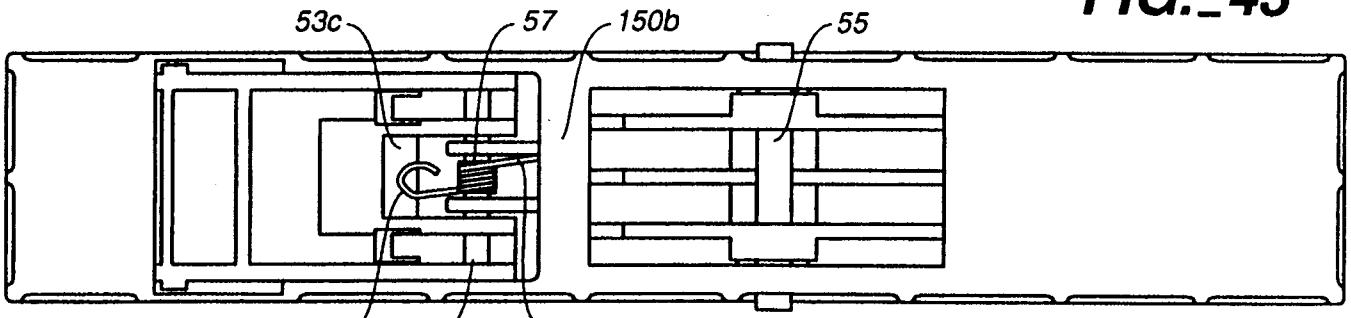
FIG. 44 is a bottom view thereof.
Figure 42:
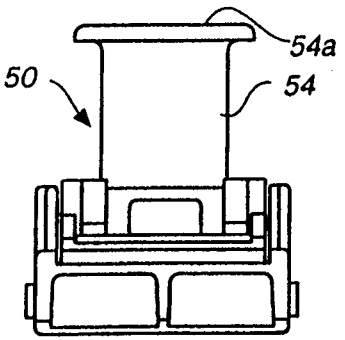
FIG. 42 is an end view thereof.
Figure 45:
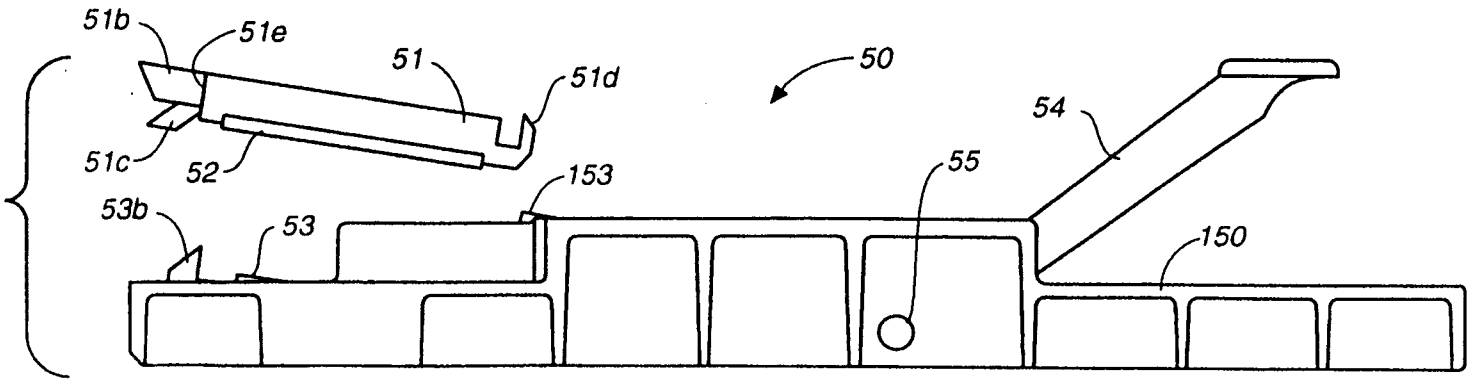
FIG. 45 is a side view of the logo loader and the pre-placement position of the logo frame.

FIGS. 40A and 40B illustrate the relationship between the inserted tape cartridge 40 and print wheel and casing 30 where the aligned strike windows 145 and 146, the latter in the casing bottom, are themselves aligned in the cartridge indentation 42*c* at a level below cartridge rib 43*t*. The cartridge is inserted linearly along one side of the print engine (FIG. 2) as guided by top projections 43*c* and grooves 43*a* on the cartridge. The print wheel and casing is inserted linearly from the front of the print engine as guided by guides 31. The included angle $\alpha$ between the longitudinal axis of guides 31 subtend an arc of about 30°. This orientation may be in the range of 25° and 35°, dependent on the exact location of the print wheel strike windows and the print wheel handle and guide rails 31. In use the character forcer (or die forcer) passes down through the cartridge indentation 42*c* so that it forces the fingers 33 (or logo 52) against the tape 41 under the inserted print wheel casing 30.

The Logo Loader/Unloader

FIGS. 41–45 show the details of the logo loader-unloader 50, hereinafter called the "loader", which is utilized to insert and remove the logo die 52 and its frame 51 into and out of what could be the relatively hot confines of the print engine. It also allows a user to access an area under the print engine with ease and dispatch. The three-part loader 50 includes a loader base 150 having a base rear recess 150*a*, a base bottom cross-piece 150*b* (FIG. 44) and a base front recess 150*c*; a handle 54 having an end finger-manipulated pad 54*a*; and a logo pad 53. The handle 54 is manipulable into and out of base recess 150*a* and the pad 53 tilts with respect to base recess 150*c* by the pivot action of the handle around a handle pivot pin 55 and the pad around a pad pivot pin 56. Spring pressure is exerted on the pad by the handle pivot spring 57 having a front end 57*a* extending under and in contact with pad 53 in all angulations thereof and a rear end 57*b* confined between a portion of the handle bottom and the top of base cross-piece 150*b*. The spring 57 is confined laterally by a pair of integral links 157 integrally extending from the forward bottom end of handle 54. The loader pad 53 has two projections 53*b* which are angularly depressible into a recess 150*c* in the loader base. The surface under the projections hit the bottom of the recess limiting the downward travel of the loader pad which is being forced upward by the front portion 57*a* of the torsion spring 57. The loader pad includes a top projection 153 under which an outer end of the logo frame 51, including a rear frame locking projection 51*d*, fits. The bottom of projection 51*d* seats in a lower shelf 154 (also seen in FIG. 49) in the pad 53. The front bottom of the logo frame, including central front frame locking projection 51*b* and projection 51*c*, fits into a front recess 53*d* of the pad. A pair of spaced integral stop means in the form of upstanding triangular tabs 53*b* extend upwardly from the front top edge of the pad 53 such that end side portions 51*e* of the frame abut thereto (FIG. 45) and prevent forward sliding of the mounted die frame.

FIGS. 46–51 illustrate a series of six successive steps A-B-C-D-E-F involving insertion and removal of the logo frame 51 and a logo die 52 staked between underlying end ledges on the window frame-like frame. The top side of the logo die 52 contains a rectangular conductive pad 152 having a surface area corresponding to the surface area of the bottom of the logo hammer. This pad may be a Q-pad available as Model No. Q11 from Berquist Company of Minneapolis, Minn. As seen in FIG. 46 with the handle 54 "up", the logo frame is placed on the loader pad 53 so that projection 51*d* fits into a notch 53*g* formed by pad projection 153 and the side front edge 51*f* of the frame abuts pad lip 53*b*. The loader with loosely-mounted frame 51 is pushed into the entrance 22 (step A) in the print engine to a position under forcer hammer 74 where (FIG. 47) a pair of spaced front locking projections 51*b* seat (step B) into a hook or aperture 74*d* adjacent to the hammer bottom against a bail-like spring 74*b* extending under hammer frame 74*c*. Once seated the handle end pad 54*a* is pushed partially down (FIG. 48) pivoting the handle and both raising the pad pivot 56 confined between pintle links 157 on the handle and tilting and raising the rear of the pad 53 (step C) so that the frame rear locking projection 51*d* is inserted into a hammer frame hook portion 74*a*. Spring 74*b* prevents the fall out of spaced projections 51*b* and projection 51*c* and biases the logo against the heater/hammer. The loader 50 is then withdrawn with the handle and pad 54*a* remaining partially depressed.

When it is desired to remove the logo frame and attached logo from the print engine, normally after completion of a logo print stroke(s), the handle is fully depressed (FIG. 49) placing the pivot spring 57 in torsion due to the angular displacement of spring ends 57*a* and 57*b* and fully tilting empty pad 53 (step D). The front end of the logo pad is restrained by the action of the projections 53*b* in the recess 150*c*. The front side ends of pad projections 153 pass around the hammer frame hook portion 74*a* in the hammer frame 74*c* surrounding the hammer forcing (step E) the front end of the logo frame downwardly (FIG. 50) so that the logo frame front end drops onto the logo pad 53. The hammer frame is constructed of Ryton high temperature-resistant plastic material. As the handle is raised slightly (arrow 155) the loader is pushed inwardly further against a horizontal portion of spring 74*b* so that the front end of the logo frame, particularly the front frame locking projections 51*b* and projection 51*c* are pushed out of the hammer frame hook portion 74*a* dropping the spaced front edges of the logo frame behind the spaced projections 53*b* of the pad 53. The handle pad 54*a* is then raised (FIG. 51) and the loader with the logo frame 51 loosely mounted on pad 53 is removed (step F) from the print engine entrance 22.

Figure 52:
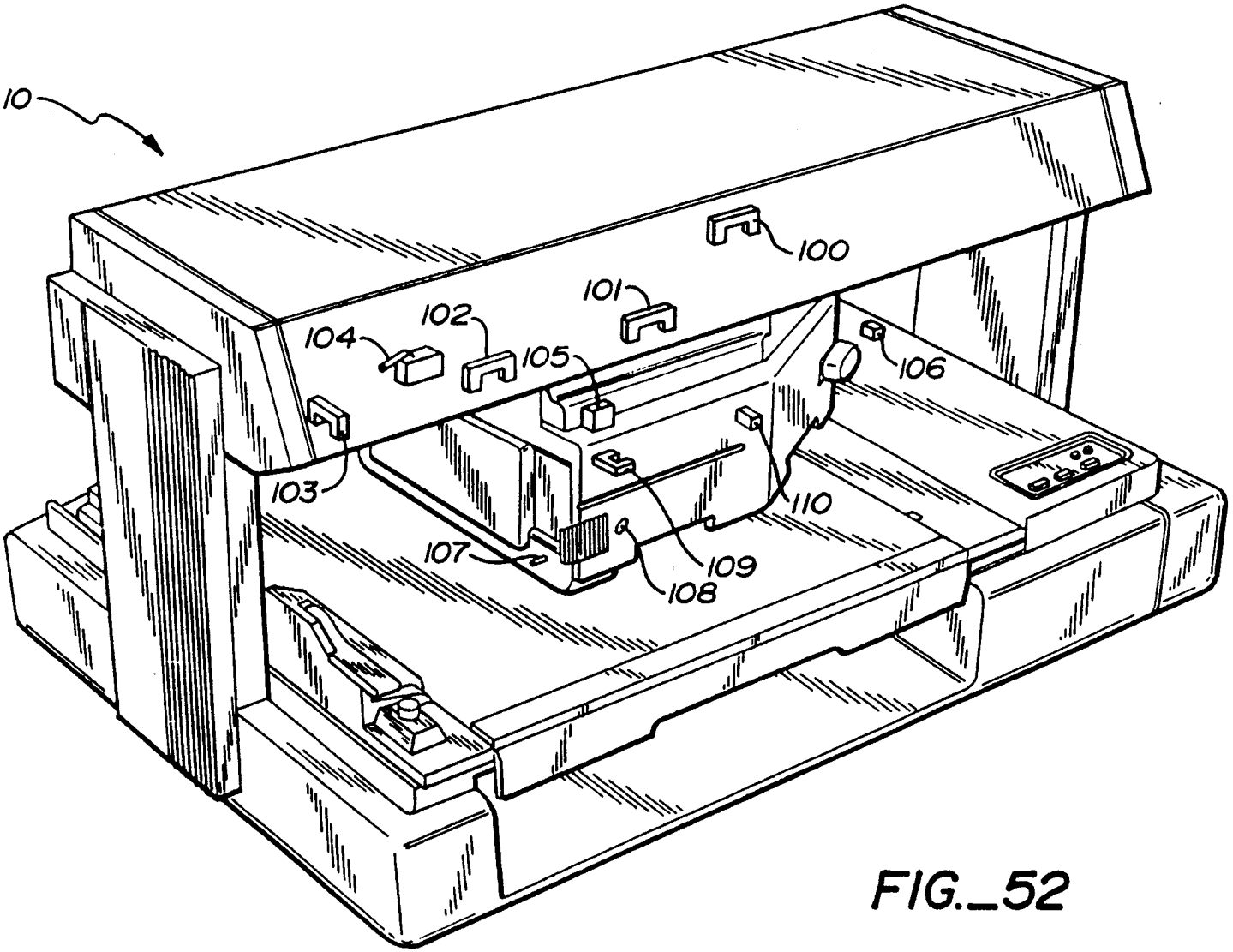
FIG. 52 is a perspective view of the stamper illustrating the general location of each of eleven sensors.

FIG. 52 illustrates the various sensors utilized in the stamper and arranged in approximate positions in the stamper to control the various functions. These include the encoder disc sensor 100 associated with the force servo motor; home position sensors 101 and 102 for the logo cam and character finger cam; a home or end position sensor 103 for the print engine y-axis movement; a microswitch sensor 104 for sensing the presence/absence of a foil tape cartridge in the print engine; a footage-remaining and tape fault (spool) sensor(s) 105 for the foil tape in a cartridge(s); a platen location sensor 106 in the base 15; hammer heater sensors 107 and 108; a cam mode sensor 109 for indicating a character finger cam or logo cam in forcing position; and a character wheel sensor 110 to sense the type face and size of the character set being inserted into the print engine. Sensor 104 is used as a redundant safety feature and prevents operation of the forcer motor in the absence of a tape cartridge.

Figure 53:
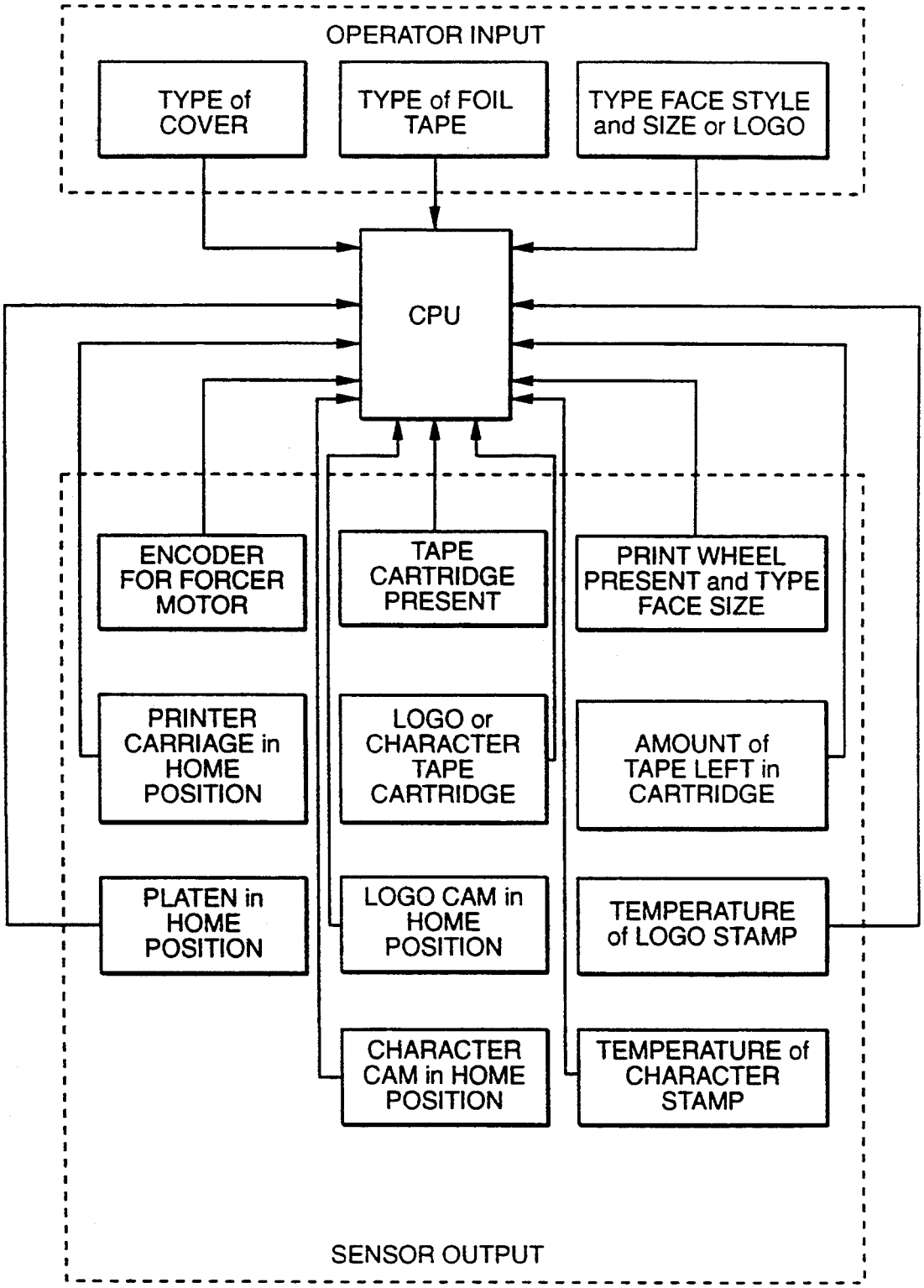
FIG. 53 is a block diagram illustrating the CPU inputs including the sensors of FIG. 52.

FIG. 53 is a block diagram showing the operator inputs and the inputs to the central processing unit from the sensors in FIG. 52.

Single Cartridge Dual Station Embodiment

Figure 54:
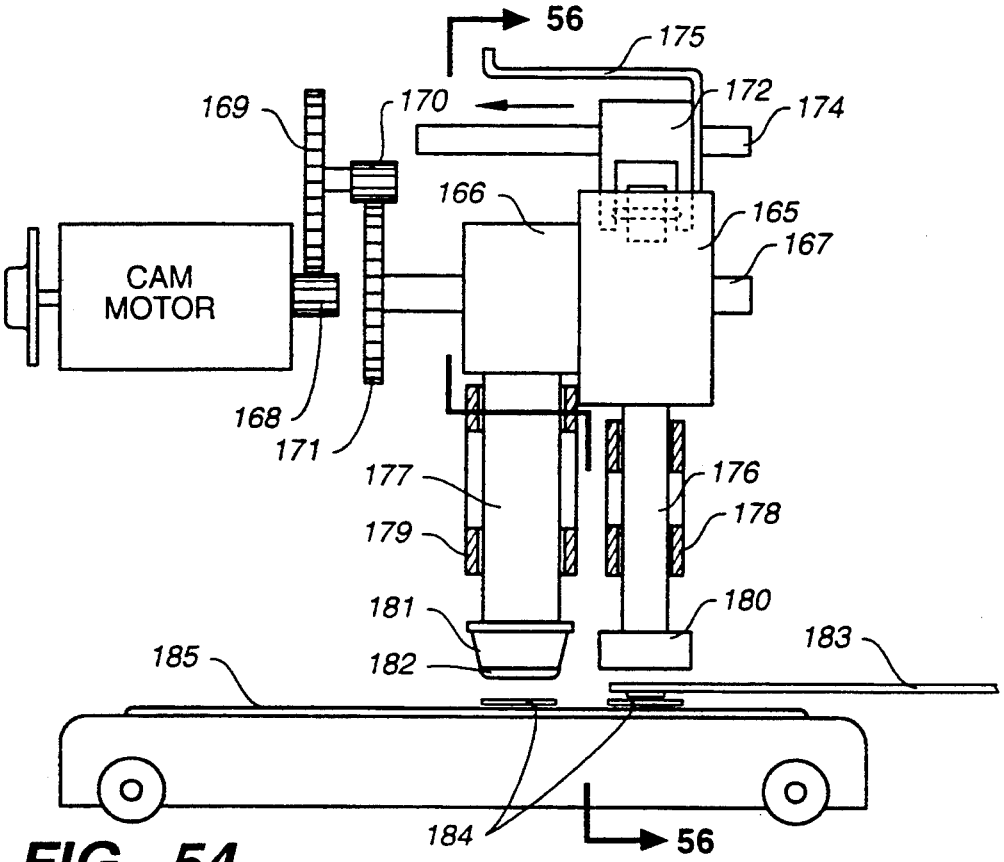
FIG. 54 is a schematic side view of a second single cartridge dual station embodiment of a debossment stamper showing the character wheel forcer and engaged print wheel.

FIG. 54 shows a side view of the force mechanism configured for printing characters. In this configuration, the rocker arm 172 is pushed to the right, along the rocker arm pivot shaft 174. The handle 175 is used to push the rocker arm to the right or to the left. The rocker arm has a roller follower 173 at the end that rides on the character cam 165. The radius of the cam increases linearly with angle. The cam is driven by the cam motor through a double reduction gear train comprised of motor pinion 168, first reduction gear 169, second pinion 170, and second reduction gear 171. The cam motor is a DC permanent magnet motor. The gear train drives the cam through cam shaft 167. The cam shaft rotates in rolling element antifriction bearings (not shown).

The character shaft 176 translates vertically and it is guided by character shaft bushing 178. Character heater 180 is attached to the bottom end of the character shaft. The character heater has an electrical resistance heating element inside. The character wheel 183 rotates in a horizontal plane under the character heater. The moving platen 185 is located under the character wheel, and the hot stamp ribbon 184 is located between the character wheel and the platen.

Figure 56:
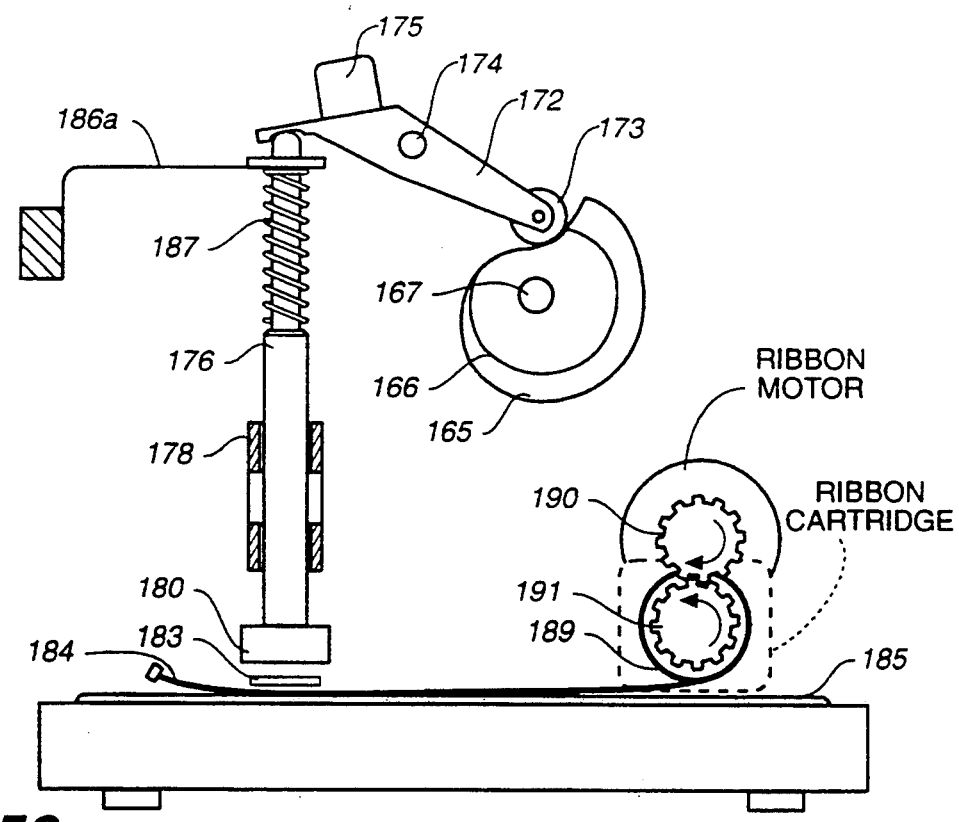
FIG. 56 is a partial schematic front view of the character wheel forcer UP showing a ribbon feed.

FIG. 56 shows a rear view of the force mechanism configured for printing characters. Return spring 187 holds the character shaft up against the bottom of the rocker arm. Anti-rotation spring 186*a* is a flat spring that allows the character shaft to translate vertically without allowing it to rotate. The mechanism is shown in the fully up position.

The hot stamp ribbon is fed from a supply reel (not shown). The ribbon travels from the supply reel, under the character wheel 183, around two bends and back to the take-up reel 189. The ribbon motor drives the take-up reel through the motor pinion 190 and take-up reel gear 191.

The character wheel is rotated to position a selected character under the character heater and forcer. If required, the ribbon motor is rotated to put fresh ribbon under the selected character. The cam motor is then run in a direction that rotates the character cam in a clockwise direction as seen in FIG. 56. This motion of the cam rotates the rocker in a counter clockwise direction. The rocker pushes the character shaft down. The character heater forces the selected character in the character wheel down against the back of the ribbon. The object to be printed on (not shown) is pinched between the ribbon and the platen for a predetermined amount of time. During this time interval, the character heater heats the selected character which heats the ribbon and transfers pigment to the workpiece.

The force on the character is controlled by controlling the current in the cam motor. The motor torque is proportional to the motor current. The cam with its linearly increasing radius provides a constant mechanical advantage independent of operating position. As a result, the force mechanism produces the required force independent of the thickness of the object to be printed on and independent of any deflection in the structures holding the force mechanism. This allows the printer to be less rigid and much lighter in weight. The ability to control the force also allows the printer to print characters over a very wide range of sizes.

After the time interval, the cam motor is rotated in the opposite direction. This retracts the character heater and shaft.

Figure 55:
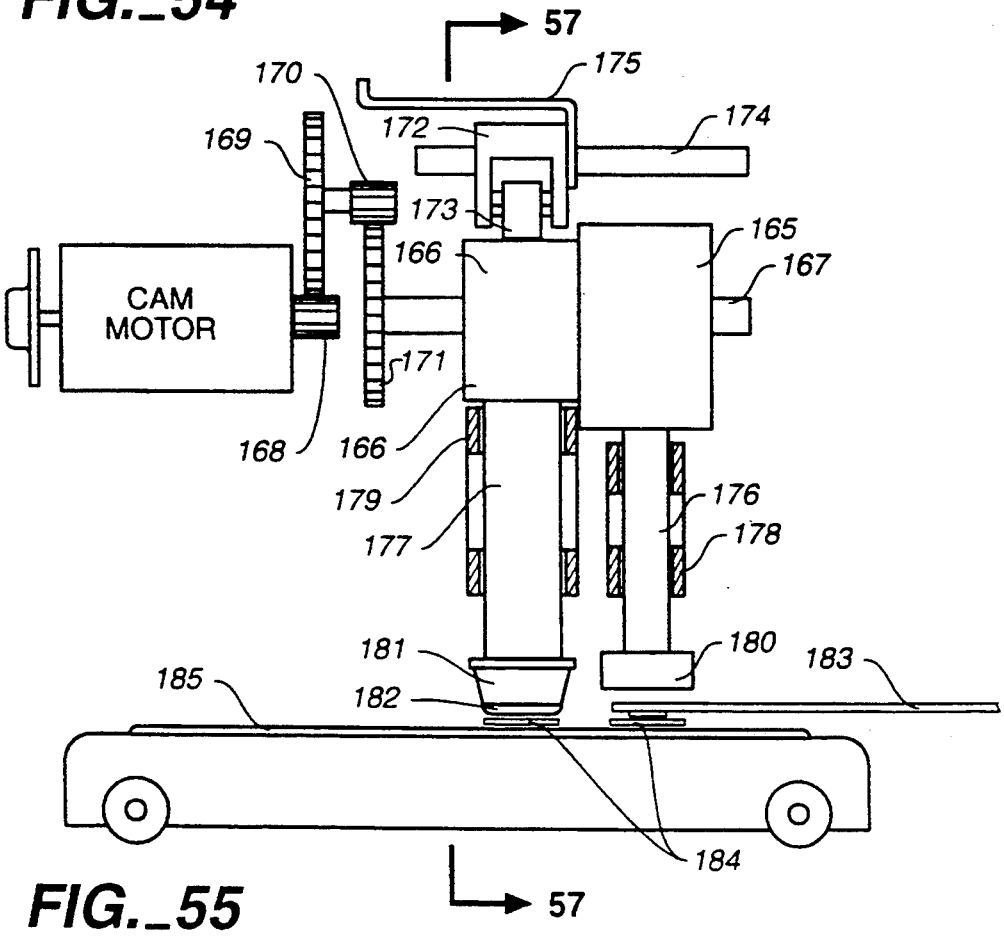
FIG. 55 is a schematic side view thereof showing the die forcer engaged.

FIG. 55 shows a side view of the force mechanism configured for printing logos. In this configuration, the rocker arm 172 is pushed to the left along the rocker arm pivot shaft 174. The roller follower 173 is now positioned to ride on the logo cam 166. The radius of the logo cam increases linearly with angle. The increase in radius is more gradual for the logo cam than for the character cam. This more gradual increase in radius gives the force mechanism a higher mechanical advantage in the logo printing configuration. As a result, the force mechanism cam produces higher forces required for printing logos. Logos typically have a larger area than characters.

The logo shaft 177 translates vertically in logo shaft bushing 179. Logo heater 181 is attached to the end of the logo shaft, and the logo stamp 182 is attached directly to the heater. The heater has an electrical resistance heating element inside. The moving platen 185 is located under the logo stamp. The hot stamp ribbon 184 is located between the logo stamp and the platen.

Figure 57:
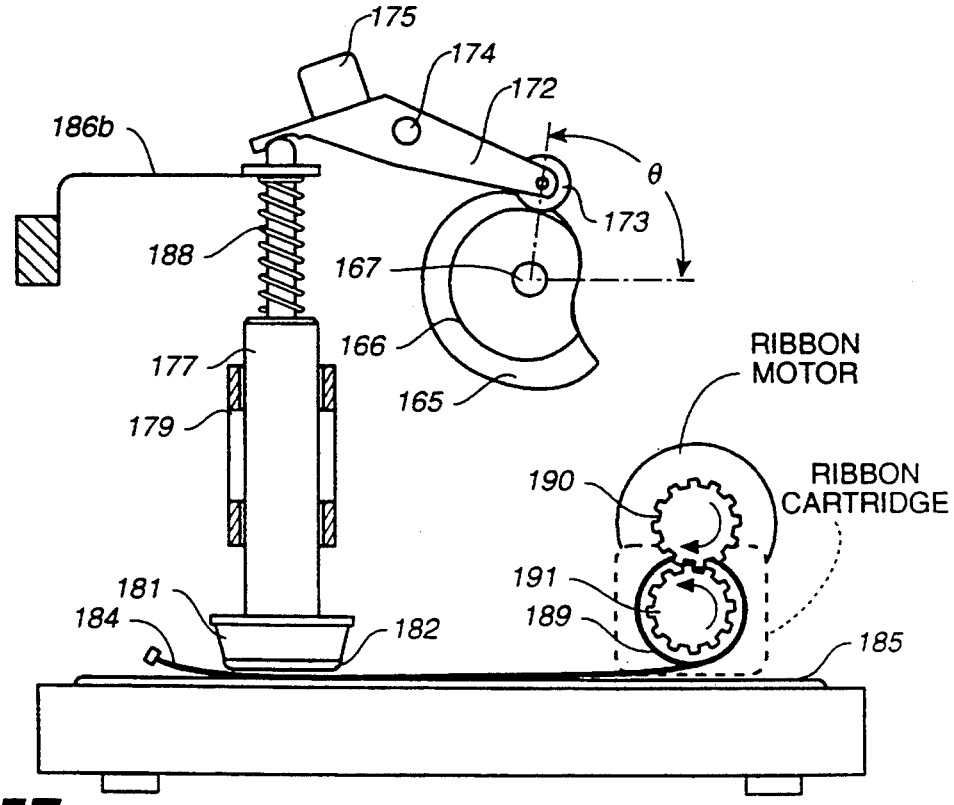
FIG. 57 is a partial schematic front view thereof with the die forcer UP.

FIG. 57 shows a rear view of the force mechanism configured for printing logos. Return spring 188 holds the logo shaft up against the bottom of the rocker arm. Antirotation spring **186*b*** is a flat spring that allows the shaft to translate but not rotate.

Note that the roller follower is riding on the logo cam 166 which is the smaller diameter cam. The mechanism is shown with the logo stamp part way down with the cam rotated through an angle Theta.

The hot stamp ribbon is fed from the supply reel (not shown). The ribbon travels from the supply reel, under the character wheel, around two 90° bends, under the logo stamp, and back to the take up reel 189. The ribbon motor drives the take up reel through the motor pinion 190 and take up reel gear 191.

If required, the ribbon motor is rotated to put fresh ribbon under the logo stamp. The cam motor is then run in a direction that rotates the logo cam in a clockwise direction as seen in FIG. 57. This motion of the cam rotates the rocker in a counter clockwise direction. The rocker pushes the logo shaft down. The logo stamp pushes down against the back of the ribbon. The object to be printed on (not shown) is pinched between the ribbon and the platen for a predetermined amount of time. During this time interval, the logo stamp heats the ribbon and transfers pigment to the object.

As in character printing, the motor current is controlled to control the force on the logo stamp. The force is independent of the thickness of the object and deflections in the printer. After the preset time interval, the cam motor is rotated in the opposite direction. This retracts the logo stamp, heater, and shaft.

Figure 58:
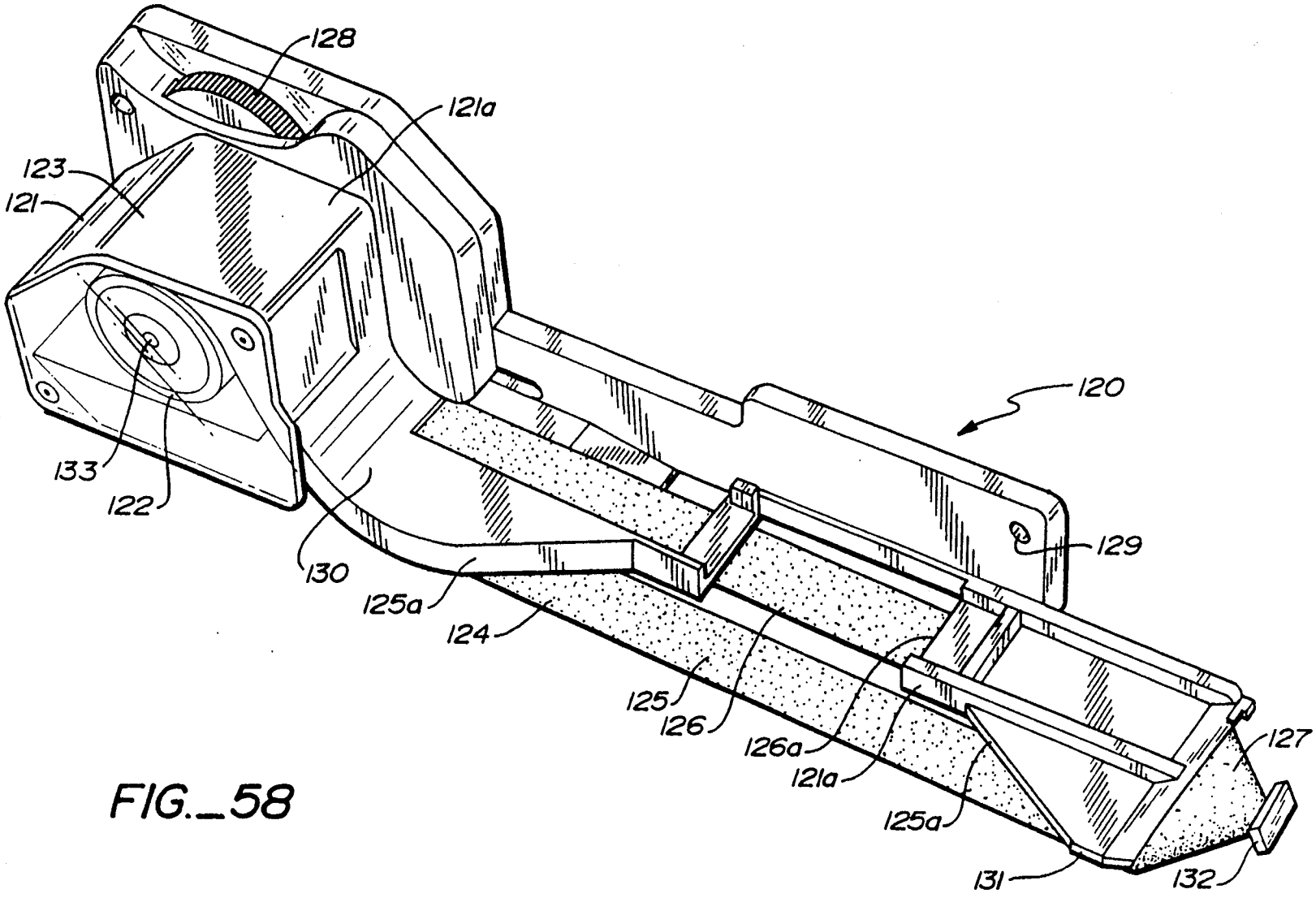
FIG. 58 is a perspective view of the single cartridge used in the FIG. 54 embodiment.

FIG. 58 shows a second embodiment of a cartridge 120 used with the second embodiment of the stamper, wherein the same dual stamping position single foil tape cartridge is employed both for the character wheel stamping and the logo or other indicia stamping. The cartridge 120 includes a casing 121 having a first hump end **121*a* housing a supply reel 122 and a take-up reel 123 aligned therewith in the same housing. The end plate of the housing is shown as transparent so the interior may be shown. The supply reel is mounted on a horizontal shift 133. A braking mechanism (not shown) or of the type shown in FIG. 40 hereof is connected to reel 122. The take-up reel is on a second driven shaft (not shown). Foil tape 124 from the supply reel is guided by a curved tape guide 130 to a pair of open portions 125 and 126 formed in a cantilevered extension 121*a*. The first open position 125 is formed in a side indentation 125*a* and the second open position by an open window 126*a* in the extension. A tape direction-reversal guide 127 is provided along with an outer peripheral guide 132 to turn the advancing tape 180° back to the take-up reel 123. The tape is further guided into the guide 127 by a baffle 131 at the guide entrance. A gear 128 operably connected to a cartridge drive stepper motor contacts and drives a gear attached to the take-up reel shaft (not shown). Upon insertion into the print engine (FIGS. 56–57) the tape portion 126 is aligned under the logo die debossment forcer hammer while the portion 125 is aligned under the character wheel forcer hammer. Movement of the foil tape reels and foil tape is controlled so that when a logo strike is to be made at position 126 fresh tape is advanced on the take-up reel so that a fresh undebossed tape portion is present at position 126. Aperture 129** aids in alignment of the cartridge into the print engine.

While the invention has been described to terms of the use of two cartridges or a single cartridge, the tape or debossable material supply to the debossment zones can be from a supply reel or reels per se or from other debossable material on a substrate positioned between the forcer hammer(s) and the workpiece.

The Operating Program

FIGS. 61 through 64 illustrate a program executed by the host computer that controls the printer. In some embodiments, the host computer is an IBM PC available from IBM Corporation. The operating system used is MS-DOS in some embodiments. In some embodiments, the Microsoft Windows operating system is used. In some embodiments, the computer is of type Macintosh available from Apple Corporation. Other computers and operating systems are used in other embodiments.

The program execution starts at step S1. At step S1, the program presents to the user a menu of four options. If the user selects the UPDATE DEFAULTS option, control passes to step S2 at which the user can set defaults for the printwheel I.D., the character ribbon color, and the logo ribbon color. The default can also be set for user preference of measurement units (inches, centimeters, or PICA/POINTS) for specifying media size and position of text and logos. The defaults can also be set for the logo I.D. and for text orientation—whether the text will be printed horizontally or vertically. The default can also be set for text justification—left/center/right or top/center/bottom depending on the text orientation selected. The default can also be set for the COMM PORT. COMM PORT is the host computer port through which the host computer communicates with the printer.

The default can also be set for the document path name which is the path name of a disk file containing the document to be printed.

If at step S1 the user selects OPEN AN EXISTING DOCUMENT, control passes to step S6 at which the user specifies a document to be printed, and then to step S3 ENTER DOCUMENT LAYOUT AND PRINTING MODE. Step S3 is described below.

If at step S1 the user selects the option CREATE A NEW DOCUMENT, control passes to step S4 at which the user specifies the size of the media to be used for printing the document. Then, at step S5, the host computer prepares a blank document of the specified size, and control passes to step S3.

Alternatively, at step S1 the user may choose to exit the program (see step S7).

FIGS. 62A through 62D illustrate a flow chart of step S3. At step S3.1, the user is presented with a number of options. If the user selects ENTER TEXT, control passes to step S3.2 at which the user types a line of text into the document. Then, at step S3.3, the user selects a method of specifying the position of the text line in the document. The user may choose visual positioning, that is, positioning the text on the host computer screen at a place corresponding to the position on the media. Alternatively, the user may choose the method of entering the X,Y coordinates for the appropriate point of the line, which point depends on the orientation and justification selected.

At step S3.4, the user specifies the text position by the method chosen at step S3.3. At step S3.5, the user may specify one or more of the following attributes for the text line: printwheel I.D., ribbon color, text orientation, and text justification. For each non-specified attribute, the default option will be used (see step S2). The user also specifies the letter spacing as either normal, compressed, or expanded. Alternatively, the user can specify the letter spacing in the units of 1/240 of an inch. The user may also change the positioning resolution via function keys at step S3.5. Each positioning resolution corresponds to an invisible grid. The objects on the screen are positioned at the grid resolution.

If at step S3.1 the user chooses ADD LOGO, control passes to step S3.6 at which the user picks a logo from the list of available logos. Control then passes to steps S3.7, S3.8, S3.9 which are similar to the respective steps S3.3, S3.4, S3.5.

Figures 62, 62D:
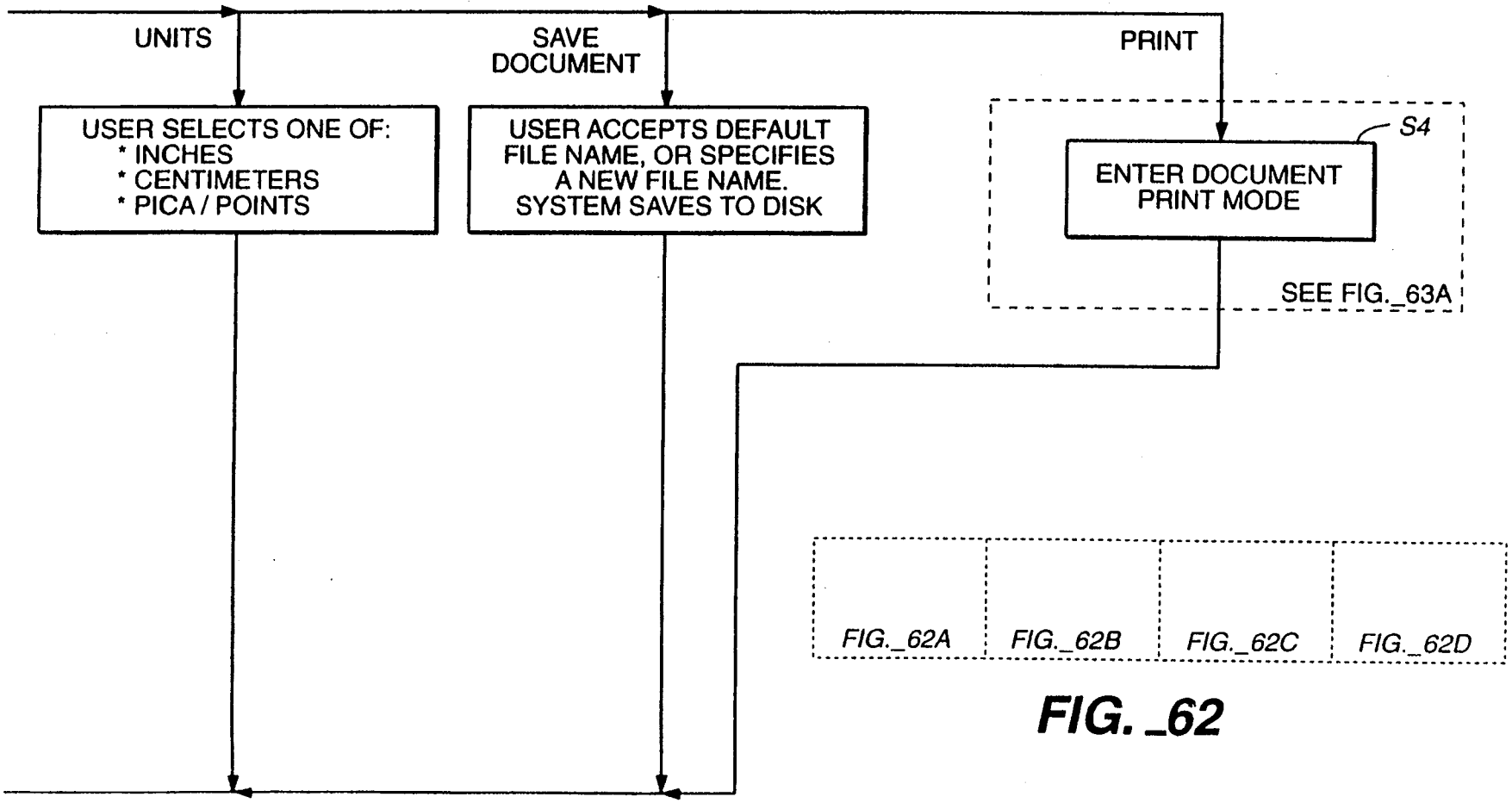
FIG. 62A through FIG. 62D is a flow chart illustrating a program executed by the host computer that allows the user to enter and edit text and logo objects to be printed.
Figure 62A:
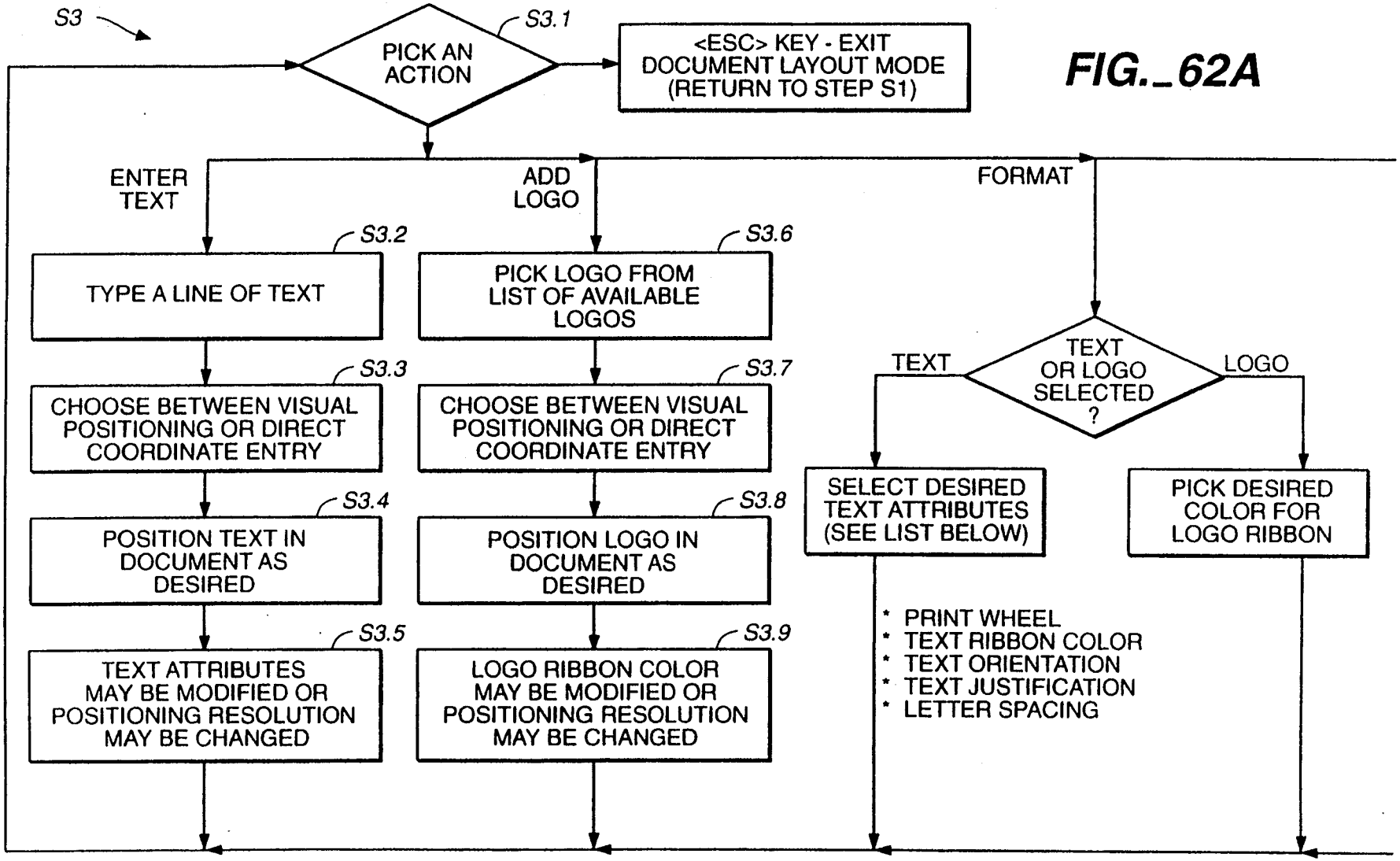
Figure 62B:
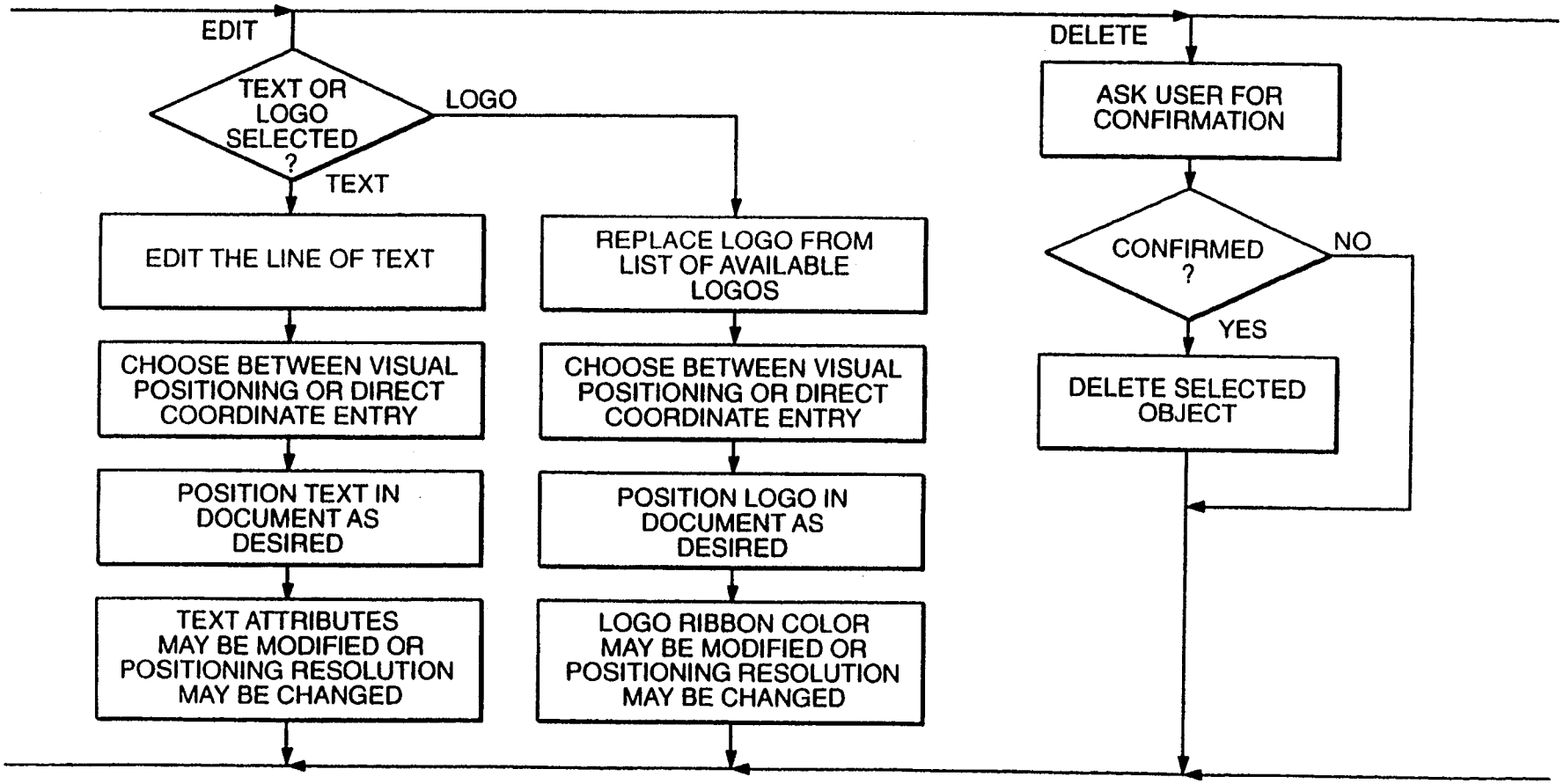
Figure 62C:
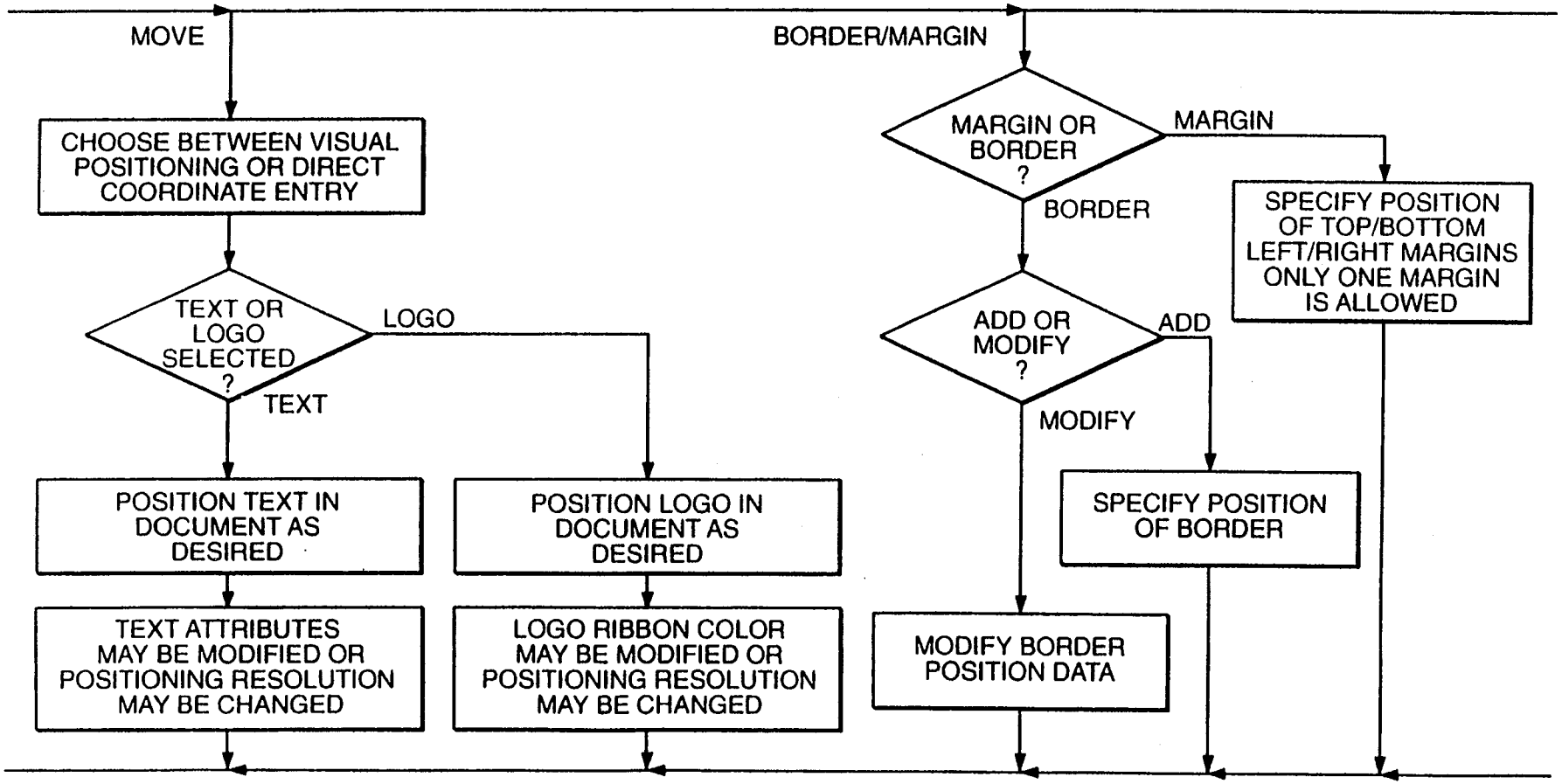

Other possible options at step S3.1 include FORMAT (FIG. 62A) and EDIT (FIG. 62B). Another option is DELETE (FIG. 62B) which allows the user to delete selected text characters or logos.

Option MOVE (FIG. 62C) allows the user to reposition selected text or a selected logo in the document.

Option BORDER/MARGIN allows specifying the border and margin positions. When the user specifies the margins, the host computer screen displays a margin box. The box will not be printed, but all the printing will be done within the margin box. When the user specifies a border, the host computer displays a box within which certain text and/or logos will be printed. The box itself will not be printed. The user can specify one margin and one or more borders for a document. Borders are computer screen simulations of, for example, preprinted lines on a cover; they are for user convenience. The stamper could be commanded, if desired by the user, to deboss over or through borders. Margins are also displayed on the computer screen, but represent a portion of the cover in which the machine is not allowed to deboss, for example, too close to the edge of a cover where a character pad could be half-on and half-off the cover.

Figure 61:
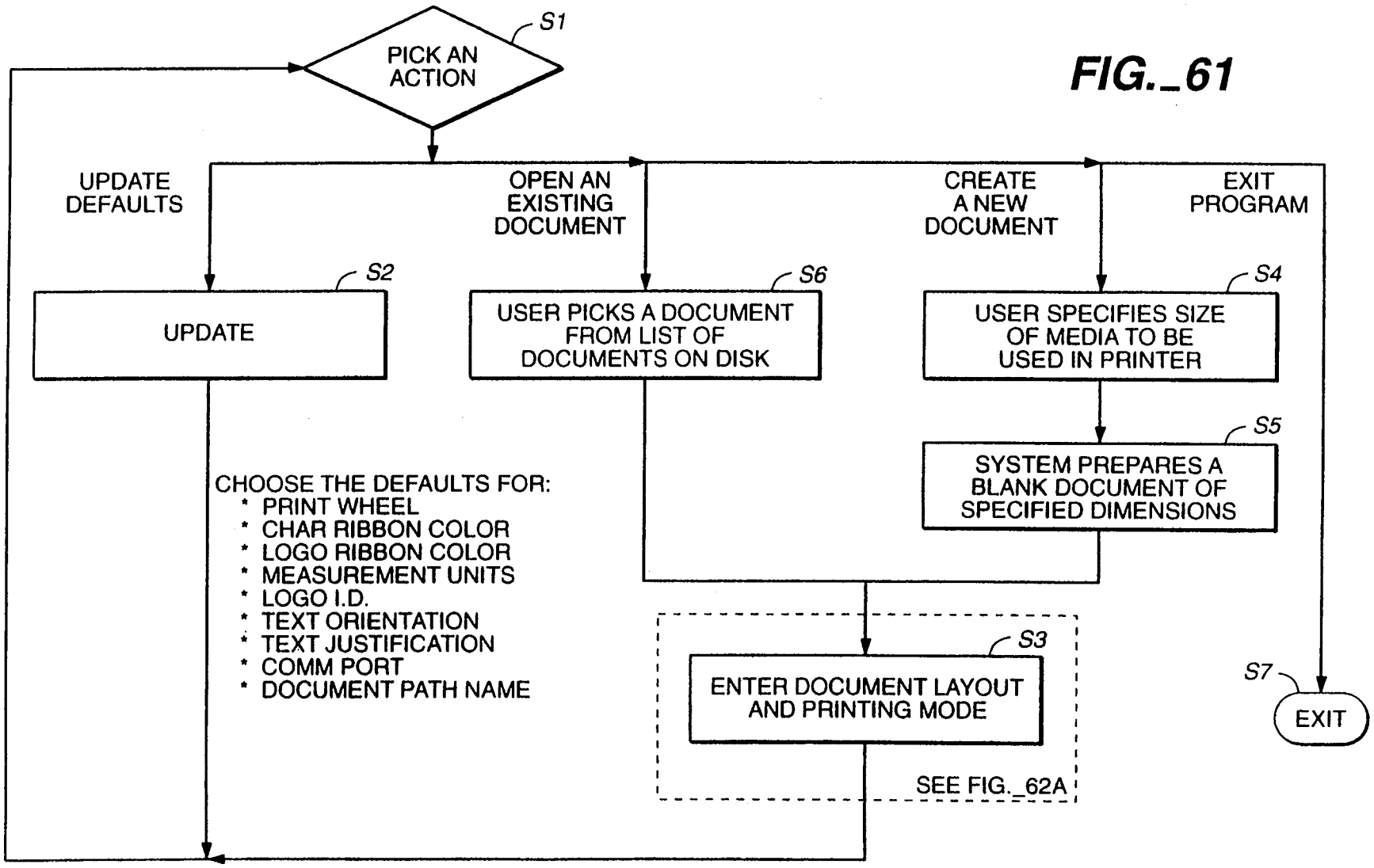
FIG. 61 is a flow chart illustrating a program, executed by the host computer, for selecting media (types of covers) and document parameters.

The UNITS option (FIG. 62D) allows the user to override, for the current document, the MEASUREMENT UNITS default set at step S2 (FIG. 61).

The option SAVE DOCUMENT allows the user to save the document in a disk file on the host computer. If the document has just been created and has not been assigned a disk file, the user specifies a disk file name. If the document pre-existed, the document is saved in the document's file.

If the user selects the PRINT option at step S3.1, control passes to step S4.

Figures 63, 63B:
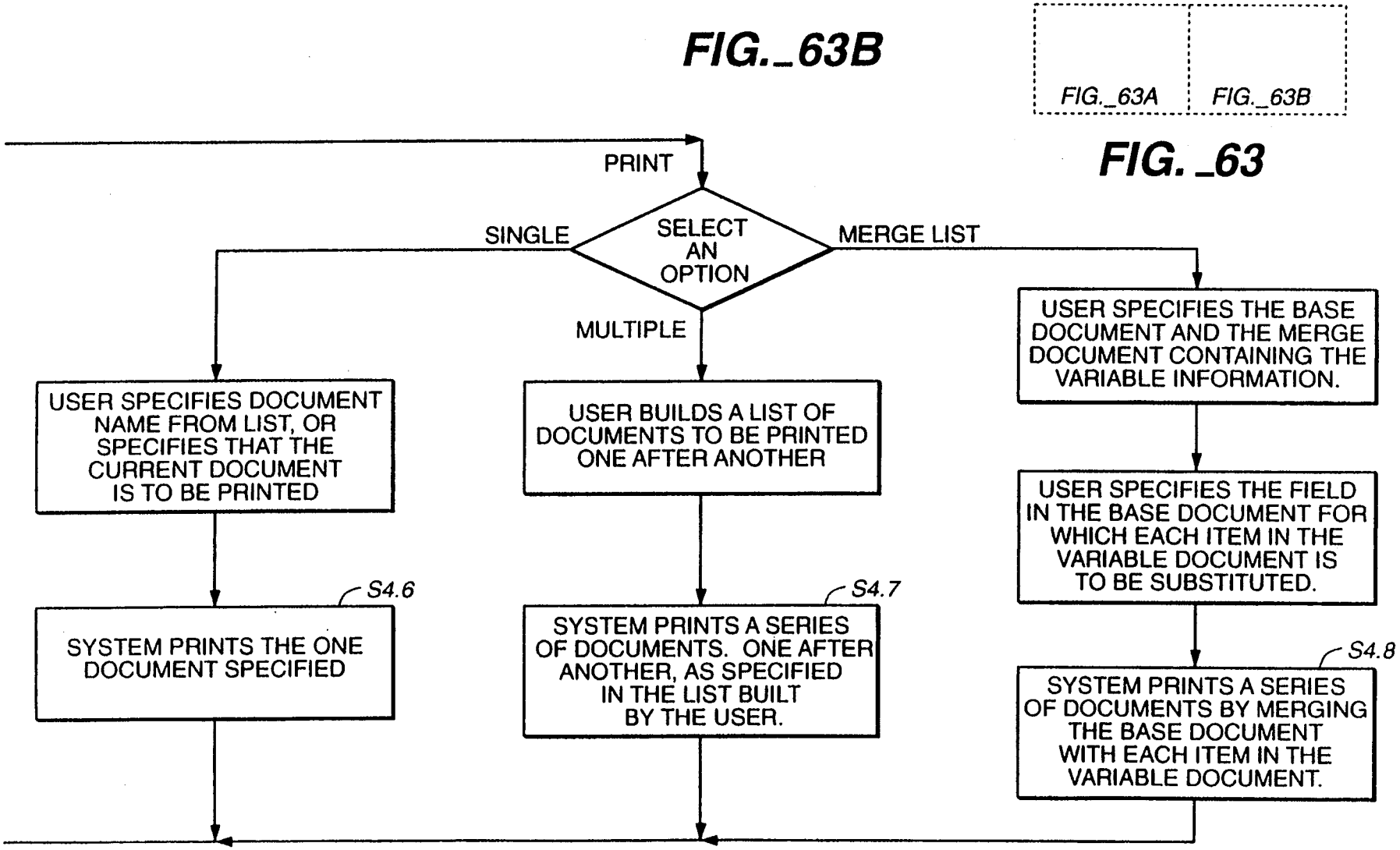
FIGS. 63A and 63B illustrate a program executed by the host computer for defining workpiece stock type, printer settings and merge data for printing.
Figure 63A:
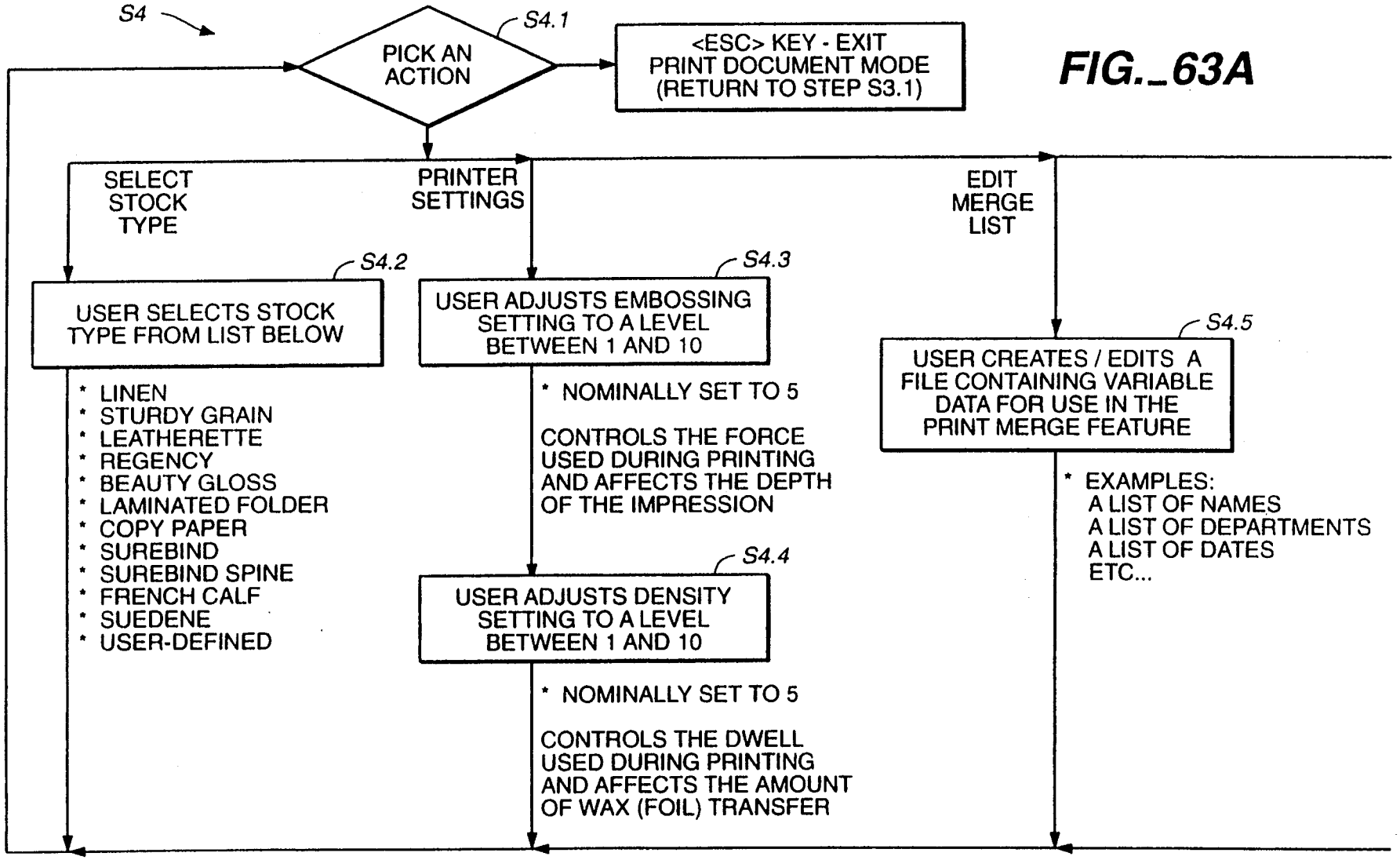

FIGS. 63A, 63B illustrate a flowchart of step S4. At step S4.1, the user selects one of several options. If the user selects SELECT STOCK TYPE, control passes to step S4.2 at which the user selects the type of media on which the printing will be done. This information is used by the host computer to determine the force to be applied by the printer to press the characters and logos against the media. The media type is also used to determine the dwell time, that is, the time during which the pressure is applied.

If at step S4.1 the user selects PRINTER SETTINGS, control passes to step S4.3. At step S4.3, the user selects a number between 1 and 10 which controls the force to be applied by the printer. The higher the number, the higher the force.

Control then passes to step S4.4 which allows adjusting the dwell time.

If the user selects EDIT MERGE LIST at step S4.1, control passes to step S4.5. At this step, the user creates or edits a file containing variable data for use with a base document. In one example, this file contains a list of names, and the base document will be printed with each name in the list.

If at step S4.1 the user selects the PRINT option (FIG. 63B), one or more documents are printed.

Before the printing occurs at one of steps S4.6, S4.7, S4.8, the host computer need not be connected to the printer. When the user enters information as described above, the host computer stores the information in its memory or disk. To perform any one of steps S4.6, S4.7, S4.8, the host computer is connected to the printer.

Figure 64:
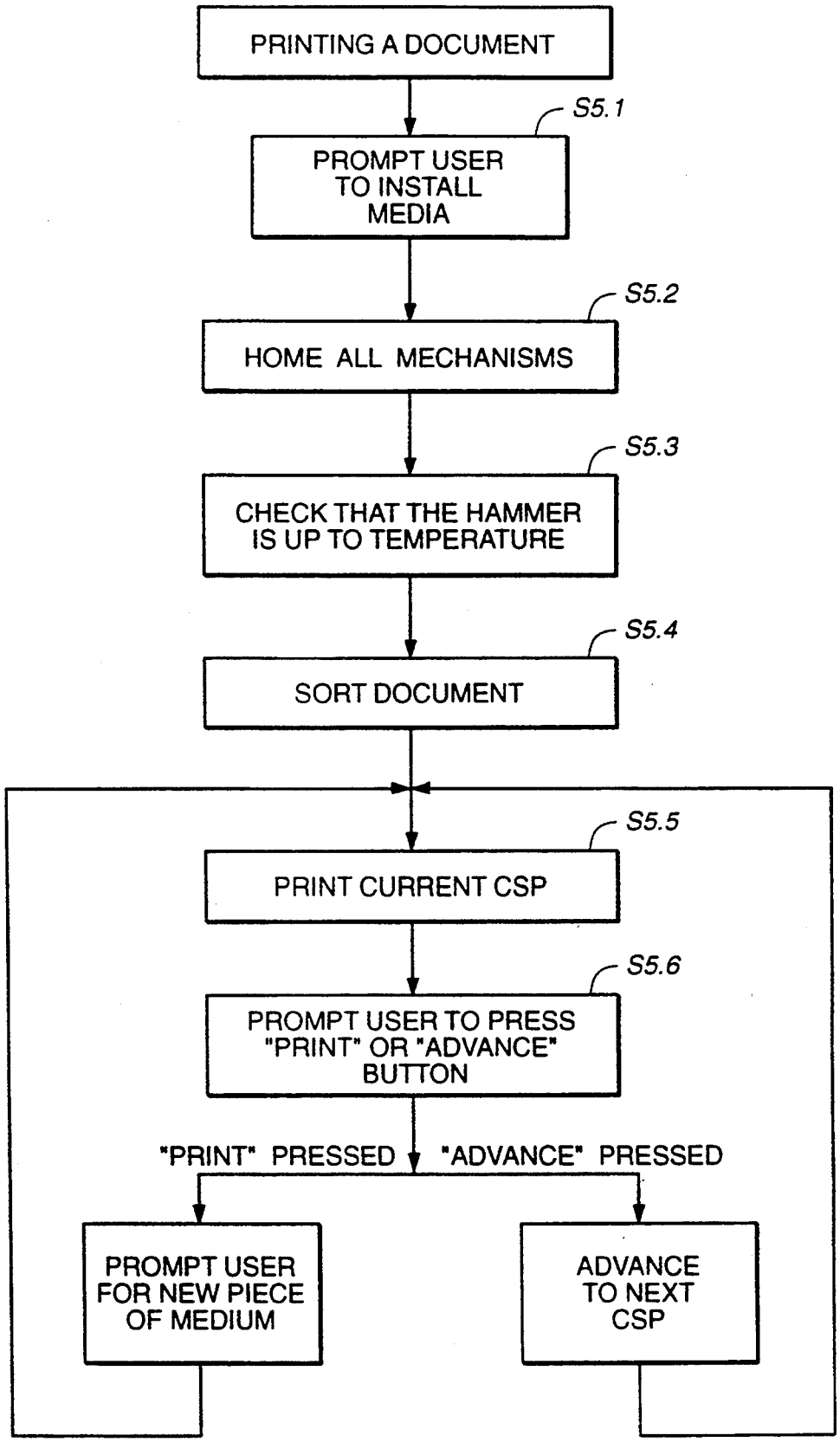
FIG. 64 is a flow chart illustrating a program executed by the host computer to print a document.

Printing a document at step S4.6, S4.7 or S4.8 is illustrated by FIG. 64. At step S5.1, the user is prompted to install a piece of media like the one specified at step S4.2 (FIG. 63A). At step S5.2, the host computer establishes communication with the printer and instructs it to "home all mechanisms" by issuing the "home mechanisms" command described below. This causes the printer to first move the character or logo forcer hammer, depending on the ribbon cartridge installed, to the respective home sensor establishing the home position for that hammer. The printer then moves the platen and the carriage to their home sensors in order to establish the "0,0" reference point. At the same time as the platen and carriage are moving, the printwheel also spins to locate the home petal and to read the encoded strip which contains a binary 8-bit code identifying the printwheel.

At step S5.3, the host computer requests the heater status from the printer to ensure that the appropriate hammer is up to print temperature. See the "request status" command below. The appropriate hammer is the character or logo hammer depending on the type of ribbon installed. If the hammer is not up to temperature, a status message is posted by the host computer telling the user that printing will start as soon as the hammer reaches the proper temperature.

At step S5.4, the document is sorted. At the steps of FIGS. 61 through 63B, the document could have been created by placing text and/or logos anywhere in the document, formatting text characters and logos with different ribbon colors and, for text, with different printwheels. If the document were simply printed in the order in which the text and logo objects were entered, the printing process would be inefficient, stopping to ask the user to change to one printwheel, then to another, then back to the original printwheel, etc., and the same with different ribbon colors.

In order to streamline the process and minimize the need for changing supplies, the host computer sorts the document prior to printing. Essentially, all text items are placed before all logo items. Within the text, all items which use the same printwheel are grouped together. Within the text using the same printwheel, all items using the same ribbon color are grouped together. Logo items are similarly sorted. Thus, this is a three-level sort as shown below:

```
TEXT ITEMS
    PRINTWHEEL #1
        RIBBON COLOR #1 (first CSP object printed)
        RIBBON COLOR #2
        :
    PRINTWHEEL #2
        RIBBON COLOR #1
```

-continued

```
        RIBBON COLOR #2
    :
LOGO ITEMS
    LOGO #1
        RIBBON COLOR #1
        RIBBON COLOR #2
    LOGO #2
        RIBBON COLOR #1
        RIBBON COLOR #2
    :
        RIBBON COLOR #N (last CSP object printed)
```

Each subgroup within this sort order is called a "common supplies packet", or CSP. All items with a given CSP share a common printwheel or logo plate and a common ribbon color.

Once the document has been sorted, the printing process begins. The printing process, at step S5.5, consists of the following steps:

1) Prompt the user to install the supplies (see below).

2) Compile into memory all print commands necessary to print the current CSP.

3) Transmit the compiled print commands to the printer in real time.

Step 1) above involves prompting the user to install the current printwheel or logo plate and the ribbon. For instance, if the current CSP consists of text objects formatted as 24-point Times & Gold ribbon, the user will be prompted to install the 24-point Times printwheel, a gold text ribbon, then press a key to continue. After the key is pressed, the host computer can request the printwheel I.D. from the printer. If the wrong printwheel is installed, the user is so informed and prompted to check the printwheel. In some embodiments, no feedback is available from the printer indicating the color of the ribbon installed, it is up to the user to ensure that the proper color is actually installed in the machine. Feedback exists in some embodiments to determine whether the correct type of ribbon is installed (character vs. logo ribbon).

The reason for compiling the print commands into memory is that the process of encoding the document into print commands need only be done once for multiple copies of a CSP. (Multiple copies can be created by using the "PRINT" button as described below.)

Once a CSP has completed printing, the user has the option of:

1) installing a new piece of media and reprinting the same CSP, or 2) simply advancing to the next CSP on the same piece of media.

If the user decides to do 1), the "PRINT" button on the printer's control panel should be pressed. See step S5.6 in FIG. 64. If the user decides to do 2), the "ADVANCE" button on the printer's control panel should be pressed. The user has the option of pressing certain keys on the host computer's keyboard in lieu of pressing the "PRINT" or "ADVANCE" buttons on the printer's control panel. If a document consists only of one CSP (i.e., only one printwheel/ribbon combination was used in the document creation), then pressing "PRINT" generates another copy of the document, and pressing "ADVANCE" simply ends the printing process.

During printing at step S5.5, the host computer computes the force and dwell time values and sends them to the printer via respective commands "set force value" and "set dwell time". These commands are described below.

For characters, the force and dwell time values are derived in some embodiments empirically via a process known as "print physics investigation". For any particular media, all characters of the same font are assigned the same "cold strike" dwell time. (The "cold strike" refers to the dwell time at the beginning of which the character is cold. If the character had been printed recently and still retains residual heat, the dwell time is reduced. The reduced dwell time is referred to as "hot strike" dwell time.) For example, all the characters on the Times 24 point printwheel when printing on Beauty Gloss are assigned a cold strike dwell time of 600 milliseconds.

The force values vary between characters of the same font. Normally, the period (.) is struck with the lowest force, and the character with the largest font surface area (typically the uppercase "W") is struck with the highest force. All characters in between these two extremes are assigned force values commensurate with their relative surface areas. In the above example, using a Times 24 printwheel on Beauty Gloss, the smallest character is hit with a force value of 25 lbs, and the largest character is hit with a force value of 240 lbs.

At this point, the force and dwell time for any character can be determined, given the following information:

1) cold strike dwell time for the font, 2) force used for the smallest character in the font, 3) force used for the largest character in the font, 4) relative font surface area for the character in question.

These four pieces of information are contained in data files on the host computer for each character and for each print wheel/media combination. In the event that these force/dwell parameters do not produce optimal print quality (due to printing on user-defined media types, for example), the user has the ability to modify these parameters via scale factors. As mentioned previously in the host software description of steps S4.3 and S4.4, the user can adjust the embossing setting and/or the density setting to a number between 1 and 10. Adjusting the embossing setting effects the calculated force value. Adjusting the density affects the calculated dwell time. For each increment away from the nominal value of "5", the associated parameter is adjusted by 10% of its calculated value. As an example, if the embossing setting is placed at "6", the calculated force values are multiplied by 110% prior to being output to the printer. If the density setting is placed at "3", the calculated dwell time are multiplied by 80% prior to being output to the printer. Any adjusted parameter is, of course, truncated at overall minimum and maximum allowable values if necessary.

Figure 59:
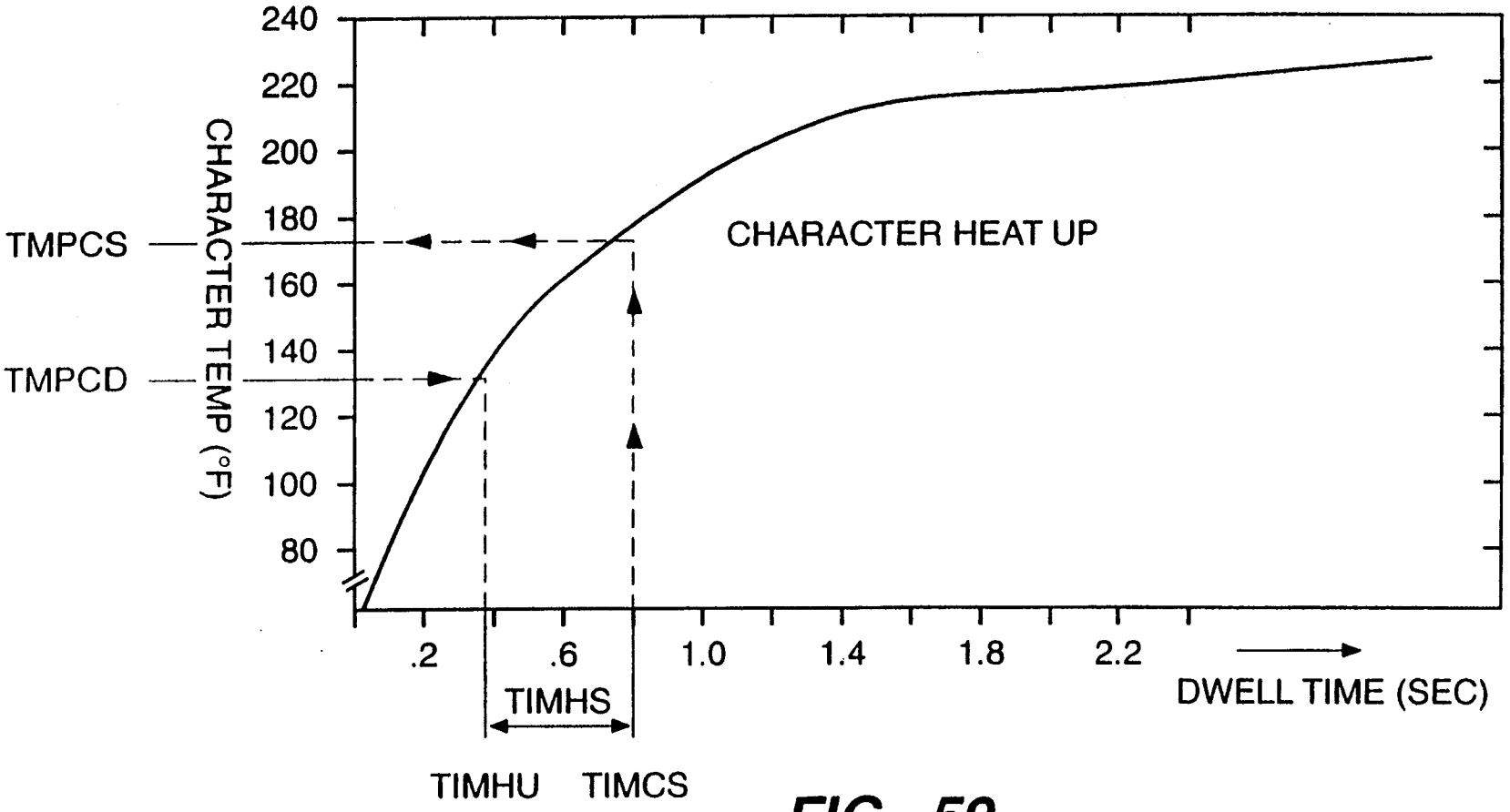
FIG. 59 is a graph showing a character heat-up and dwell curve.
Figure 60:
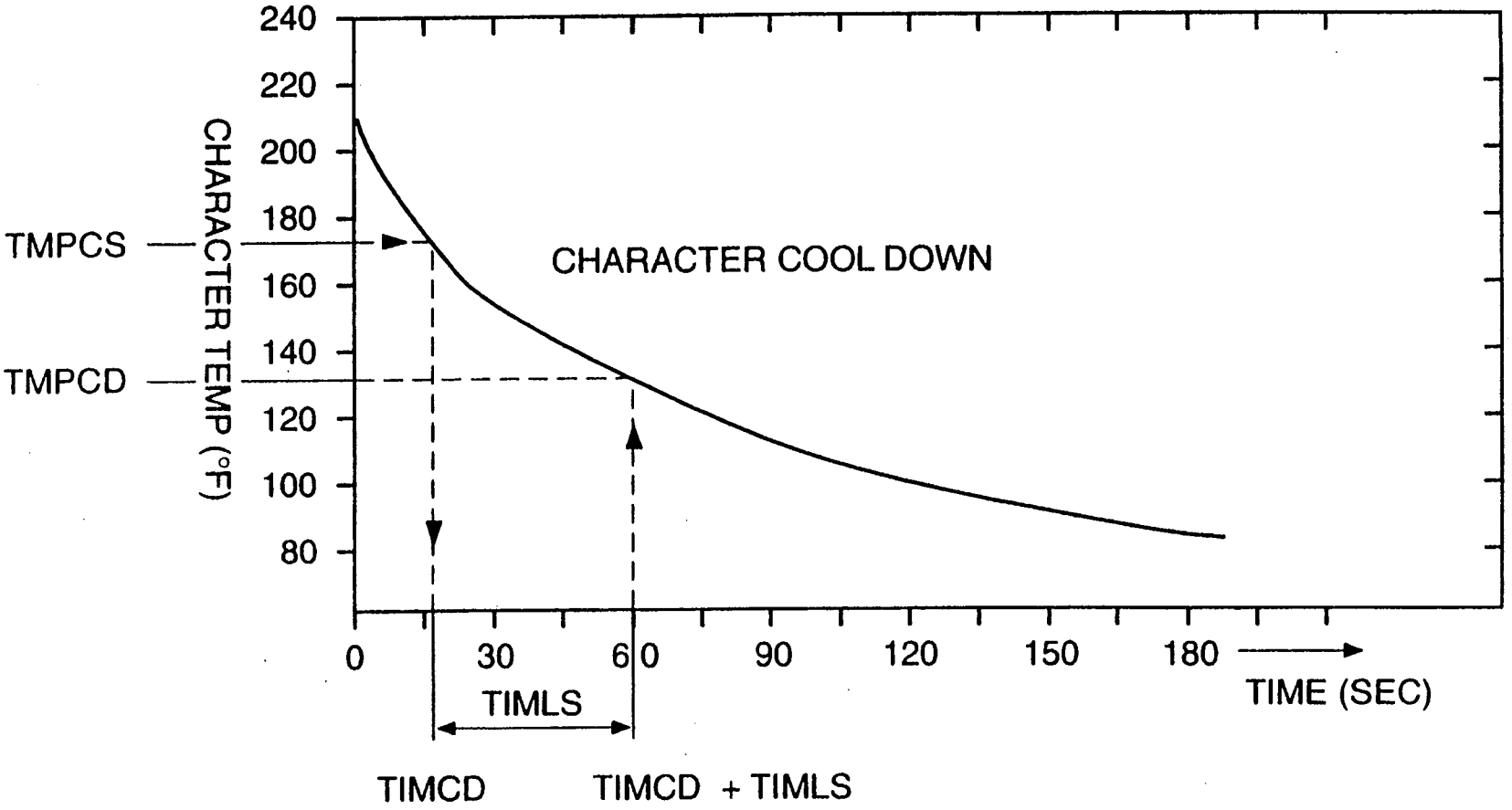
FIG. 60 is a graph showing a character cool-down or heat decay curve.

The "hot strike" dwell time is computed as follows. The host computer software maintains an array of 80 timers, each dedicated to one petal on the printwheel. Each petal's timer contains the information about how long it has been since that particular petal was hit with the hammer. The petals retain some heat for several minutes. A dynamic calculation is made at print time, diminishing the cold strike dwell time as a function of "time since last strike". This calculation algorithm uses empirically constructed curves such as shown in FIGS. 59 and 60. The curve of FIG. 59 is a Character Heat Up curve generated by measuring the character temperature as a function of hammer dwell time. The curve of FIG. 60 is a Character Cool Down curve generated by measuring the character temperature as a function of time after the heated hammer is removed.

The hot strike algorithm first takes the cold strike dwell time (TIMCS) and accesses the Heat Up curve to find the print temperature (TMPCS). Next the algorithm takes the print temperature (TMPCS) and accesses the Cool Down curve to find the offset time (TIMCD). The Character Cool Down curve is next accessed with the sum of TIMCD and the time since last strike (TIMLS) to obtain the character cool down temperature (TMPCD). The Character Heat Up curve is accessed with TMPCD to obtain the offset time (TIMHU). The minimum hot strike dwell time is then TIMCS-TIMHU. The algorithm outputs the hot strike dwell time as a percentage of the cold strike dwell time.

The host computer then compares the hot strike dwell time produced by the algorithm with the minimum dwell time parameter TIMHS(MIN) and selects the largest of the two. The host computer uses values of TIMHS(MIN) that range from 0.3 to 0.5 sec, depending on the character and the type of media.

The benefits of the hot strike algorithm include 1) minimizing foil tape overheating which results in bleeding and 2) improving the print speed.

For the logos, the force and dwell values are determined as follows. Logos are characterized by their "percentage surface area". The maximum logo size in some embodiments is 2" wide by 1.5" high, or a total of 3.0 square inches. A given logo's font surface area is calculated and divided by 3.0 (the area) to determine the "percentage surface area". Typical logos have between 5% and 35% surface areas.

Given the media being used, and the logo's percentage surface area, the proper force and dwell values are looked up from a data file table in the host computer. The table force and dwell values are determined empirically. Since the logo is maintained at a constant temperature, "cold strike" and "hot strike" dwell times are not relevant for logo stamping.

When at step S5.5 the print commands are compiled into memory, the "set dwell time" commands for characters are not compiled due to the hot-strike algorithm. Rather, the dwell time for these commands is calculated immediately before the command is transmitted to the printer.

As soon as the compilation process for the current CSP is complete, the commands are transmitted to the printer across a serial communication link. The host computer transmits the commands one by one. After each command transmission, the host computer waits for a "ready prompt" (described below) from the printer before proceeding with the next command. If any command generates a printer error, that error is reported back to the host computer as part of the next "ready prompt". The host computer interprets the error and either takes corrective action or prompts the user to take some action to correct the problem.

Figure 65A:
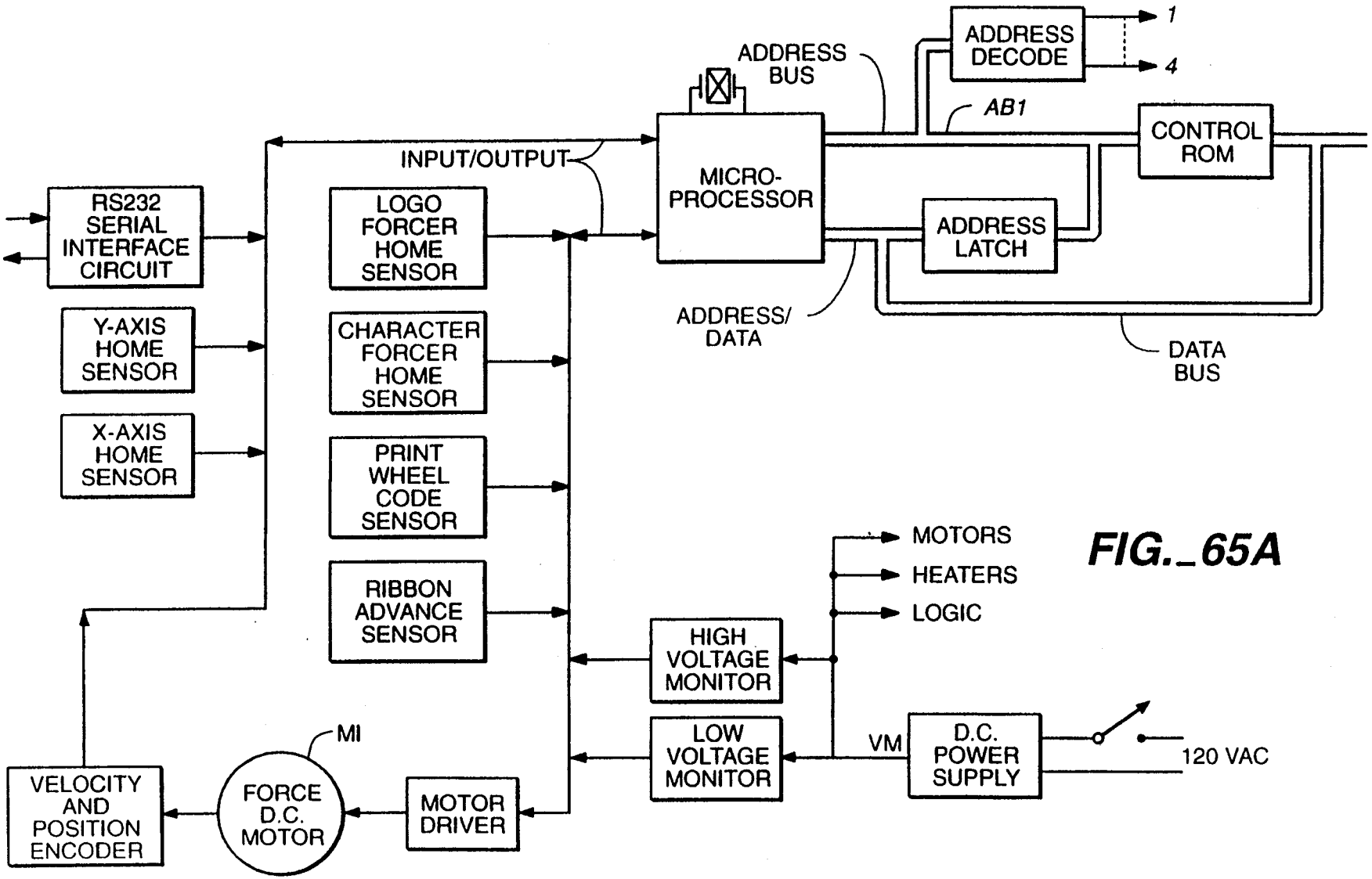
Figure 67:
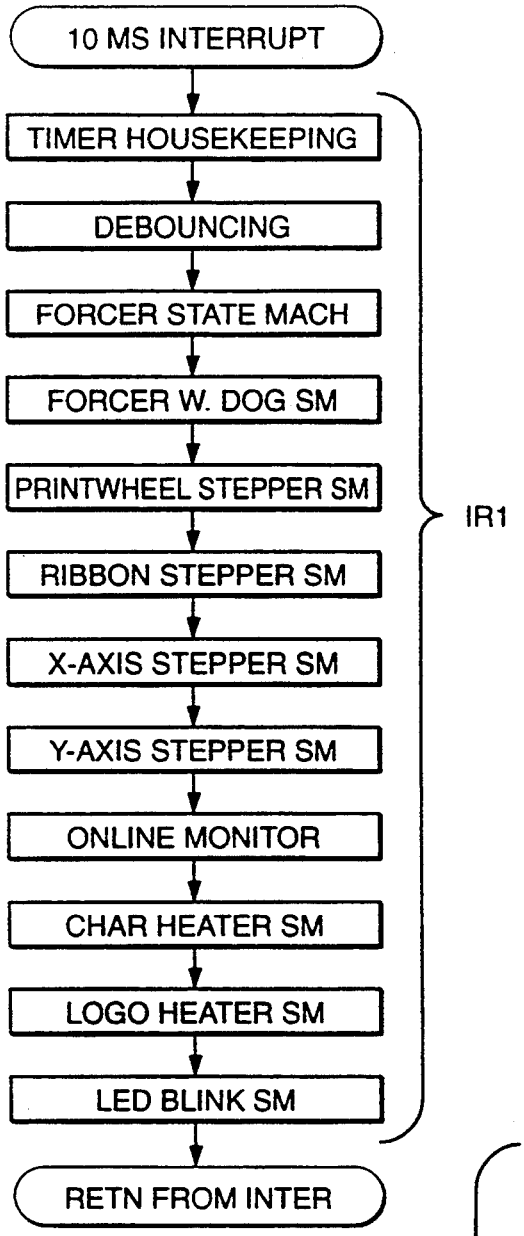
FIGS. 67, 68, 69 and 70 represent interrupt service routines executed by the stamper microprocessor.
Figure 68:
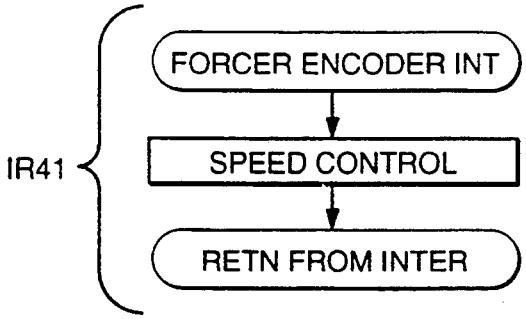

FIGS. 65A, 65B illustrate the printer electronics. The RS232 Serial Interface Circuit (FIG. 65A), the Y-axis Home Sensor, the X-axis Home Sensor, the Velocity and Position Encoder, the Logo Forcer Home Sensor, the Character Forcer Home Sensor, the Printwheel Code Sensor, the Ribbon Advance Sensor, the Motor Driver, the High Voltage Monitor and the Low Voltage Monitor are each connected to a separate pin of the Microprocessor controlling the printer.

The printer force subsystem consists of a D.C. Motor M1 which is mechanically coupled either to the character forcer cam or to the logo forcer cam (one motor, two mutually exclusive outputs) via a spur gear transmission. The logo forcer cam drives a follower roller, logo shaft, and heated logo hammer/logo. The character forcer cam drives a follower roller, character shaft, and heated character hammer/V notch detent.

The Logo Forcer Home Sensor is used to initialize the position of the logo cam and thereby the logo hammer. This logo sensor consists of an optical slot switch, which senses an interrupter flag attached to the logo cam drive shaft. Following the logo print, the logo cam is returned to a predefined position relative to the logo home position.

The Character Forcer Home Sensor is used to initialize the position of the character cam and thereby the character hammer. This character sensor consists of an optical slot switch which senses an interrupter flag attached to the character cam drive shaft. Following a character print, the character cam is returned to a predefined position relative to the character home position.

The Print Wheel (PW) Code Sensor is an optical reflective sensor. It senses the presence or absence of reflective strips on the PW assembly. This sensor is used for two functions: 1) home the print wheel and 2) read the PW identification code from the printwheel.

The PW subsystem consists of a 200 step/revolution 4 phase (ABCDAB . . . ) stepper motor, which is geared 4.8:1 to the 80 spoke PW assembly (12 motor steps/PW spoke). The home pattern consists of reflective strips placed on the PW encoder ring to correspond with a given phase of the stepper motor (Phase A). The home pattern is used by the firmware to synchronize the PW spoke centerline with a particular PW motor phase A. Note that between spokes there are 12 motor steps (ABCDABCDABCDA). Therefore it is not sufficient to stop on phase A, since phase A occurs not only on the desired spoke centerline, but also at the $\frac{1}{3}$ and $\frac{2}{3}$ spoke separation points. Once synchronization occurs, the PW code information is read by the printer firmware. The reading of the home pattern and the PW code is a dynamic process, in that the PW is rotating during the operation.

The PW code region of the PW encoder ring consists of the presence or absence of reflective strips placed on the PW encoder ring to represent a binary code. The PW identification code is used by the printer firmware to identify the font size and font style of the particular installed PW assembly. The home function results in positioning the PW spoke centerline of a selected character to coincide with the printer character hammer centerline.

Figures 71, 71A:
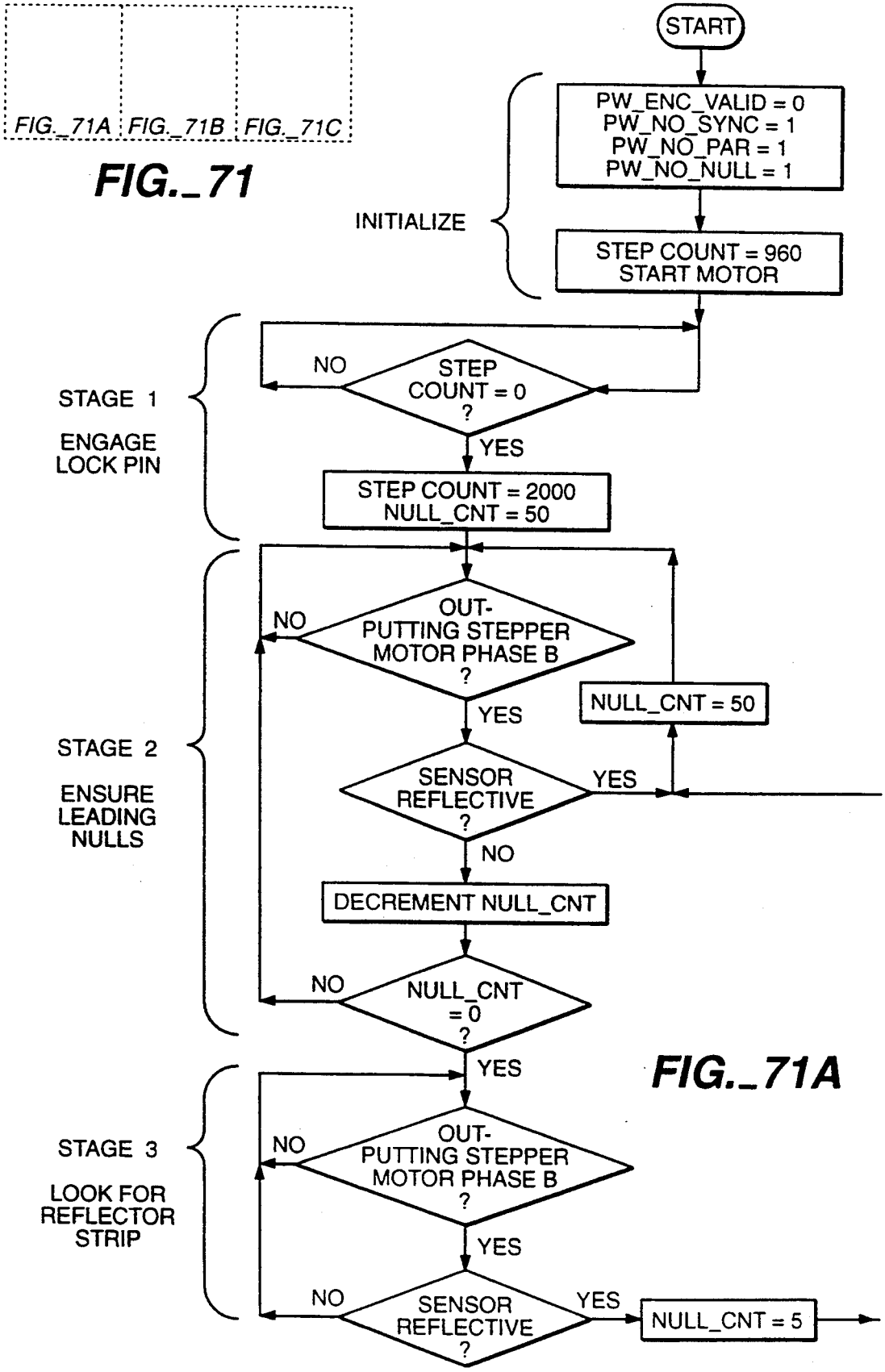
FIG. 71 is a flow chart illustrating a program executed by the host computer for reading the print wheel encoder strip.
Figure 71B:
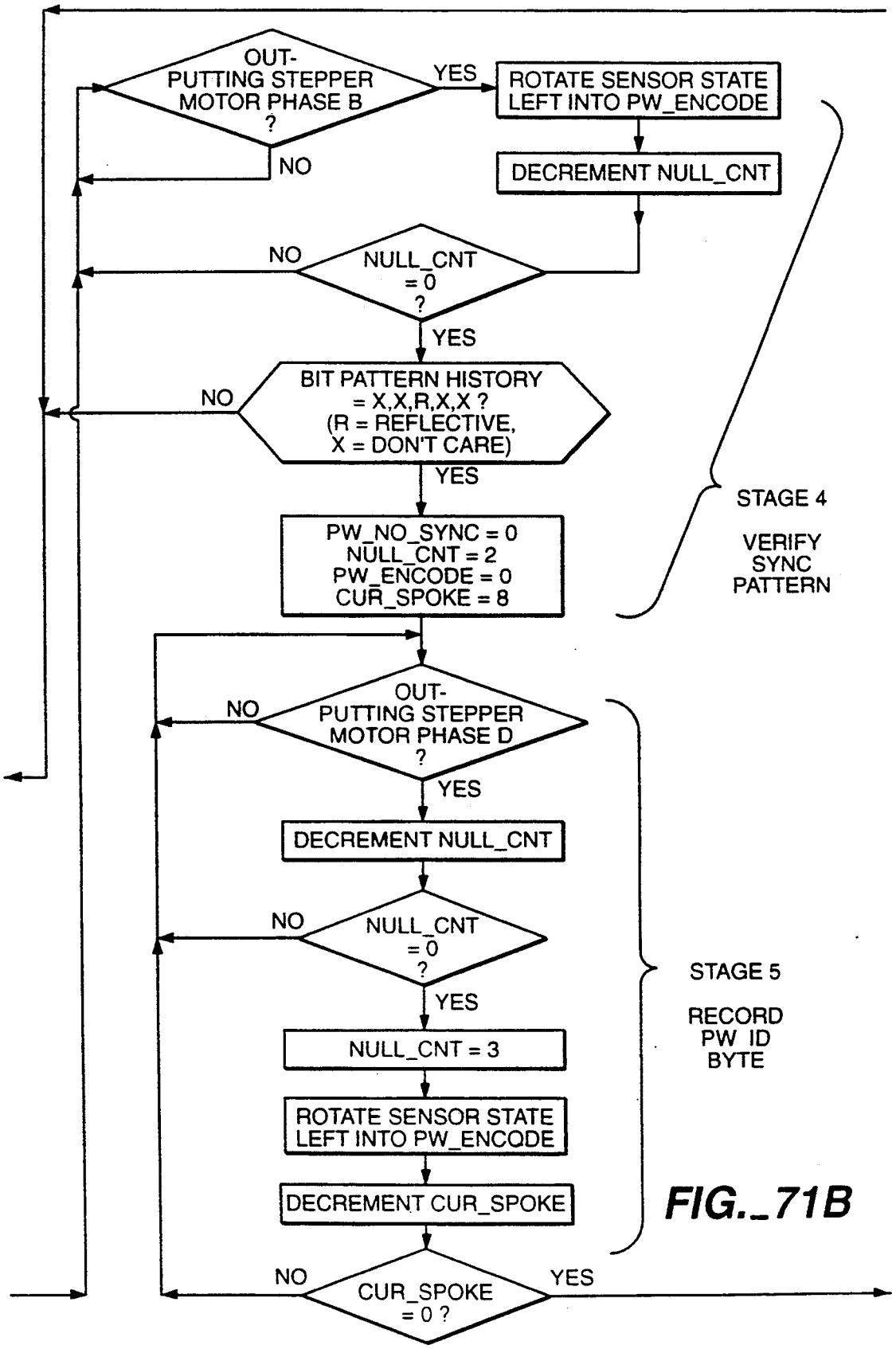
Figure 71C:
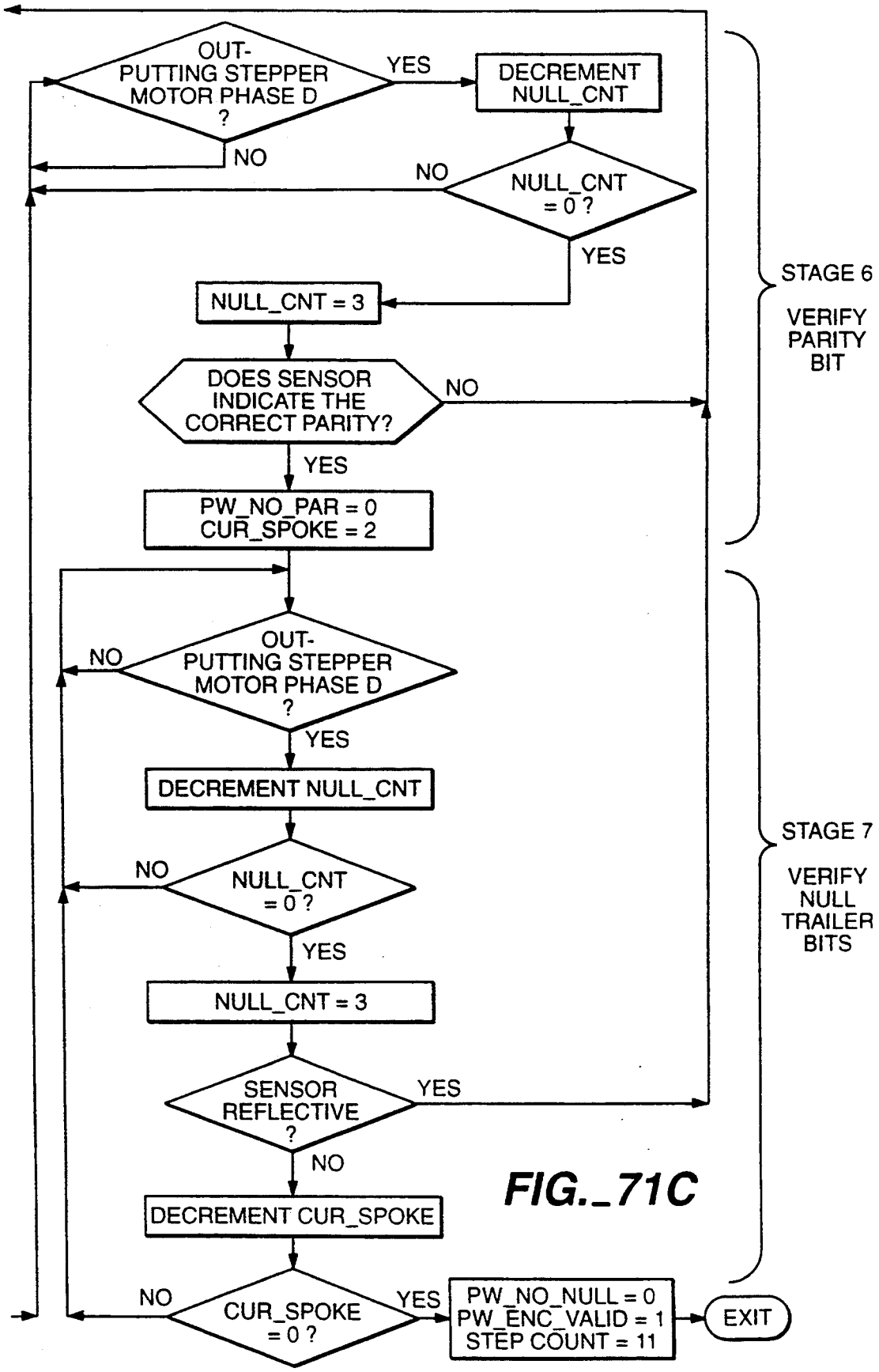

FIG. 71 illustrates a flowchart of the printer firmware portion that reads the PW identification code. The firmware operates as follows.

STAGE 1—ENGAGE LOCK PIN

The printwheel motor is spun for one revolution before looking at the encoder disk to ensure that the lock pin engages into the printwheel. Since there are 12 motor steps between petals and 80 petals, one revolution is equivalent to 960 motor steps. As the printwheel makes its first revolution (after being installed), the pin on the rotating gear eventually slides down the ramp on the printwheel hub and engages into the hole at the bottom of that ramp. From this point on, the printwheel motor and printwheel are tightly coupled. This relationship ensures when a particular phase A of the stepper motor is energized, the elements are statically aligned with the centerline of the printwheel petals. At the end of this first revolution, the printwheel lock pin has become engaged. At this point, a set up allows up to maximum of 2000 motor steps to occur during recalibration. This allows approximately two rotations of the print wheel to find and correctly read the encoder strip.

STAGE 2—ENSURE LEADING NULLS

So as not to start trying to decode data starting from the middle of the encoder strip, it is first made sure that 50 consecutive NULLs (i.,e., non-reflective strips), or 50 consecutive B-phases of the motor have been seen with no reflective feedback. This ensures that when a reflective strip is seen one can be assured that it is the start of the encoder sequence. One chooses to read phase B of the motor because phase B (when spinning) represents approximately the same mechanical position as phase A (when stopped).

STAGES 3 AND 4—FIND THE SYNC BITS

After the minimum 50 NULLs are "seen" the sensor looks for the sequence R X X R X X, that is, the sequence "reflective, don't care, don't care, reflective, don't care, don't care". This sync-bit sequence is used for synchronization purposes, no encoding information is contained in it. The sensor is read once each time we output phase B to the stepper motor.

Locating these sync-bits fixes our stopping position, i.e., a stop occurs after a fixed number of motor steps.

As indicated in FIG. 71, the sync-bit sequence is detected by locating a reflective strip (stage 3), then reading five bits into the variable PW_ENCODE and checking that the five bits are X X R X X.

At this point, the sensor is ready to read the remainder of the encoding information. All further reads of the sensor are made when phase D of the stepper motor is output rather than when phase B is output. The reason for doing this is that it serves to better center on the reflective strips.

STAGE 5—READ THE PRINTWHEEL I.D. BIT PATTERN

Recording the sensor data starts at every third phase D of the motor. Every third phase D is equivalent to one petal separation. Eight consecutive reflective/non-reflective states (in the form of zeroes and ones) are recorded to form the 8-bit binary code for the printwheel. A reflective state is recorded as binary "0" while a non-reflective (or dark) state is recorded as a binary "1". The first bit encountered is the most significant bit (with a weight of 2 $7=2^7=128$.) The eighth bit recorded is the least significant with a weight of 2 0, or 1. If these eight values are added together, the printwheel I.D. value results.

STAGE 6—VERIFY PARITY

As an added safeguard, a parity bit follows the eight data bits. The parity bit is chosen such that there will always be an odd number of "1" states when the 9 bits (i.d. plus parity) are considered. If the parity test fails, one can retry one additional time to read the printwheel.

STAGE 7—VERIFY TRAILING NULLS

A second safeguard exist in that it is required the parity bit be followed by 2 spokes of non-reflective states, or NULLs. Should this condition fail, one can retry one additional time to read the printwheel.

BRINGING PRINTWHEEL TO A STOP ON THE HOME PETAL

Finding the sync-bits (STAGE 4 above) fixes the stopping position. When the printwheel comes to a stop, theoretically it will be on the home petal. A reflective strip is located on that petal as verification. From this point on, should the firmware believe that the device is positioned on the home petal, yet the reflective flag is not seen, an error is reported to the host computer and the printer must be recalibrated before printing can continue.

As an aide to discovering "lost printwheel" and "printwheel removed" conditions, the printwheel is automatically returned to the home petal anytime more than 1 second elapses between print commands.

Since there are 3 phase A's between each petal, it is possible to completely satisfy the above homing requirements, yet end up ⅓ of a petal away from the proper position. The printwheel encoder sensor block must be properly aligned at the time of machine assembly in order to preclude this from occurring.

The Ribbon Advance Sensor is an optical reflective sensor. It is used by the printer firmware to monitor the ribbon supply spool encoder pattern of either the character ribbon or logo ribbon cartridge. This sensor can detect 1) ribbon malfunction (jam, ribbon out, ribbon breakage) or 2) estimate the amount of ribbon remaining in the cartridge.

Some printer embodiments use the following sensors:

Optical slot sensors:
MFG/MODEL
OMRON, MODEL # EE-SG3
USE:
Logo Forcer Home Sensor, Character Forcer Home Sensor, Mode Sensor (FIG. 65B), X-axis Home Sensor, Y-axis Home Sensor Optical reflective sensors:
MFG/MODEL
OMRON, MODEL # EE-SB5
USE:
PW Code Sensor, Ribbon Advance Sensor Mechanical switch:
MFG/MODEL:
CHERRY, MODEL # D44C-R1RC
USE:
Safety Interlock/Ribbon Cartridge Present Sensor (FIG. 65B)

The printer utilizes an unregulated D.C. power supply (VM) to power the motors. Therefore the VM voltage will vary directly with the normal variation of the A.C. line voltage.

The printer uses the concept of a constant current in a D.C. motor to create a constant torque, which results in a constant force for both the character and the logo embossing functions.

The constant current control is created by the printer firmware via 1) PWM (pulse width modulation) of the motor voltage and 2) utilizing course feedback from the unregulated power supply. (Otherwise PWM would not provide a constant current when the motor power supply varies.)

The High and Low Voltage Monitor Circuits threshold the motor voltage (VM) and provide feedback to the microprocessor. The feedback is coarse, in that the information is simply an indication of low, nominal, or high motor voltage. If the feedback indication is low, the microprocessor compensates by increasing the percent of PWM above the nominal value. If the feedback indication is high, the microprocessor compensates by decreasing the percent of PWM below the nominal value.

The Motor Driver of FIG. 65A is the logic that controls Force D.C. Motor M1. The Velocity and Position Encoder provides the information on the motor velocity and position to the microprocessor.

The X-axis Home Sensor senses whether the platen is at its home position. The Y-axis Home Sensor senses whether the carriage is at its home position. The RS232 circuit provides a communication interface between the microprocessor and the host computer.

The microprocessor data bus is multiplexed with a portion of the address bus. The multiplexed address-/data bus is shown as ADDRESS DATA in FIG. 65A. The address signals on bus ADDRESS DATA are latched by the Address Latch and provided to the Control ROM together with the address signals on address bus AB1. The Control ROM stores the firmware executed by the microprocessor. The address signals on bus AB1 are decoded by the Address Decoder whose outputs control output latches L1, L2, L3 (FIG. 65B) and input buffer L4.

In some embodiments, the following device models are used in the printer.

| DEVICE | MODEL NUMBER | MANU-FACTURER |
|---|---|---|
| Microprocessor | 80C51FA | Intel |
| Address Decoder | 74LS139 | Texas Instruments (TI) |
| Address Latch | 74LS373 | TI |
| Control ROM | 27128 | Intel |
| Output Latch | 74LS174 | TI |
| Stepper Motor Driver | ULN2023 | TI |
| Input Buffer | 74LS244 | TI |
| Logo, Character Heater Control | SG3524 | National Semiconductor |
| High, Low Voltage Monitor | LM339 | National Semiconductor |
| RS232 Interface Circuit | MAX232 | Maxim |
| Force Motor Driver | TIP126, TIP121, ULN2023 | TI |
| D.C. Power Supply | MC34063A, L387 | Motorola, SGS |

The platen position has a range of 0 to 2470, where each unit corresponds to 1/240 inches (the resolution of the stepper motor driving the platen). This means that the platen can move from its home position (X=0) to a maximum position of 10.29 inches (2470/240 inches). In a similar vein the maximum carriage position is 2484 or 10.35 inches. The carriage resolution is also 1/240 inches.

When the printer powers up, both X and Y destinations are initialized to zero. From that point on, the host computer sends sequences of commands, "set Y destination" commands and "set Y destination," followed by a "go" command in order to move the platen and carriage respectively (these commands are described below).

Anytime the use presses the "ONLINE/OFFLINE" button on the printer's control/status panel, the printer firmware moves the platen to a point close to its maximum position (X=2400) and moves the carriage close to its mid-print position (Y=1250) in order to facilitate changing supplies and media. The ONLINE LED on the control and status panel is then extinguished. When the user presses the "ONLINE/OFFLINE" button again, the printer moves the platen and carriage back to their original locations (where they were just before it was taken offline), and lights the ONLINE LED. Any "go" commands received from the host computer while the printer is offline are ignored and the printer responds to the host with an error indicating that the printer is currently "offline."

FIG. 66 shows the pseudocode description of the printer firmware.

Below is a list of host computer commands to the printer. Each command is carried out by a command handler which is part of the printer firmware.

Command="force a measurement stroke".

Action=set microprocessor flags indicating a measurement stroke is needed.

Since the printer accepts media of various thicknesses, it performs a "measurement stroke" during the first print stroke after a new piece of media has been installed. A measurement stroke is done in some embodiments for all the three cam surfaces, i.e. character-low-force, character-high-force, and logo.

More particularly, during printing, the character hammer has to be in contact with the surface of the media under a specific force for a specific amount of time called dwell time. The dwell timer is started when the hammer is just right above the surface of the media. A measurement stroke helps determine the position of the top surface of the media relative to the hammer.

A measurement stroke is performed when the media is first installed in the printer before the first character is printed. During the measurement stroke, the hammer moves down slowly until it stalls into the media. The hammer moves down with a very low force, lower than any force normally used for printing a character. The stall condition is detected by looking at the slots in the encoder on the back of the servo motor. When a new slot is not seen for 100 milliseconds, it is assumed that the motor has stalled and that the hammer is buried into the media to some extent.

In some embodiments, it is assumed that the media surface is at the stall position. In other embodiments, for margin purposes, the surface is assumed to be at the position one revolution of the forcer motor back from the stall position. For example, if the hammer traveled down 120 slots before the motor stalled, and each revolution of the motor is 10 slots, it is assumed that the "preprint position" is at 120−10=110 slots down from the hammer home position. During subsequent character printing, the hammer is moved quickly down 110 slots with a predetermined, gradually decreasing velocity, then stopped momentarily, and then a predetermined force is applied for the required dwell time.

The character cam has two surfaces. One surface is used for low-force printing and the other surface is used for high-force printing. Accordingly, one measurement stroke is performed before the first low-force printing of a character and one measurement stroke is performed before the first high-force printing of a character.

When a measurement stroke is performed by a character cam before printing a character, the character petal pressed down during the measurement stroke is the same petal that is imprinted during the subsequent normal (non-measurement) stroke.

The measurement strokes are performed only when it is detected that a new piece of media may have been installed. For example, if a printer has been taken off line, measurements strokes are performed when the printer returns on line.

In some embodiments, the measurement strokes are not performed for logos during printing. Instead, the measurement strokes on logos are performed during a one-time calibration procedure before printing. This is done to improve the logo print quality. Before printing, the host computer executes a setup utility which includes a calibration routine that sends to the printer "force a measurement stroke" commands for the logo for different types of media. These measurement strokes are normally performed on scratch media samples. The printer reports the corresponding preprint position to the host computer in response to a "report logo gap distance" command (described below). The host computer stores the logo preprint positions on its disk. During normal printing, the host computer retrieves the preprint position for the media defined by step S4.2 (FIG. 63A) and sends the preprint position to the printer via a "set logo gap distance" command (described below). This obviates the need to perform a logo measurement stroke during normal printing.

Command="set logo gap distance".

Action=record supplied gap distance to be used in lieu of a measurement stroke.

Command="report logo gap distance".

Action=transmit current logo gap distance to host computer.

Command="set dwell time".

Action=record supplied dwell time to be used in the next print stroke. Dwell times range from 100 ms to 5 sec in 20 ms increments.

Command="set force value".

Action=record supplied force number to be used in the next print stroke. Force numbers range from 1 to 40. The actual force value applied depends upon the cam surface selected (see the "select print mode" command below). For example, in some embodiments, the force number of 5 corresponds to the force of: 5 lbs. for character-low-force, 16 lbs. for character-high-force, and 125 lbs. for logo; the force number of 31 corresponds to: 100 lbs. for character-low-force, 240 lbs. for character-high-force, and 1583 lbs. for logo. The force number is converted into a PWM value using a table in the printer firmware. The printer's electronics integrates the PWM signal to apply the current to the forcer motor. Different look-up tables are used to convert the force number to a PWM value for different line voltage conditions (LO, NOMINAL, HI) so that a drop in the line voltage (which also drops the motor voltage) is compensated by applying a higher than normal PWM value.

Command="go".

Action=execute a print stoke or motion command. If any of the commands "set force value," "set dwell time" or "select print mode" have been received since the last "go" command, a print stoke is executed.

Then any commands "set X destination" "set Y destination" "set printwheel spoke number" and "set ribbon advance" that have been received since the last "go" command are executed.

The ribbon motion performed by the "set ribbon advance" command may generate feedback that helps the host computer track the amount of ribbon remaining in the ribbon cartridge. More particularly, four reflector strips are placed around the circumference of the ribbon supply spool such that the printer firmware receives feedback each quarter-revolution of the ribbon supply spool. The feedback is provided by the Ribbon Advance Sensor (FIG. 65A). The printer firmware tracks the number of ribbon motor steps that are taken between each occurrence of feedback (thus tracking the number of motor steps required to rotate the supply spool $\frac{1}{4}$ turn). Each time the printer firmware receives feedback, it supplies the corresponding number of motor steps to the host computer in the format described below. Supplying this number to the host computer allows the host computer to calculate the approximate amount of ribbon that remains on the spool. A non-linear equation (which is approximated by a linear equation in the software) takes into account several variables in order to convert the "number of motor steps required to rotate the supply spool $\frac{1}{4}$ turn" into the "amount of ribbon remaining on the supply spool". The specific variables taken into account are: (1) the ribbon supply spool core diameter, (2) the take-up spool core diameter, and (3) the total ribbon length. The host computer uses the calculation to warn the user of a "low ribbon" condition.

Multiplying the ribbon's length by its thickness yields the edge-wise area of the entire ribbon. This 'edge-wise' area is split between the supply and take-up spools at any given time. This "total edge-wise area" is thus the summation of:

(1) The edge-wise area of the supply spool (PI times the current supply spool radius squared minus PI times the supply spool core radius squared), and (2) the edge-wise area of the take-up spool (PI times the current take-up spool radius squared minus PI times the take-up spool core radius squared).

The ribbon stepper motor drives the take-up spool through a gear reduction. Knowing the number of motor steps required to rotate the supply spool $\frac{1}{4}$ turn allows us to calculate the amount of ribbon remaining on the supply spool. This is done mathematically by combining the equations generated in points (1) and (2) above along with the fact that the total ribbon length is fixed. The resulting non-linear equation yields the "ribbon length remaining on the supply spool" as a function of the "number of motor steps required to rotate the supply spool $\frac{1}{4}$ turn" assuming fixed values for the various core radii, motor gear ratios, total ribbon length, etc. For example, a maximum number of motor steps will be required to rotate the supply spool of a new ribbon cartridge $\frac{1}{4}$ turn. With a geared direct drive ribbon advance system, as the ribbon is used up (the supply spool radius decreases and the take-up spool radius increases), fewer and fewer motor steps will be required to rotate it that same $\frac{1}{4}$ turn.

In addition to determining the amount of ribbon remaining on the supply spool, the software also determines the amount of ribbon present on the take-up spool and uses this information to calculate the number of steps necessary to obtain the desired ribbon advance and compensate for the variation in the diameter of the take-up spool.

A conventional direct drive ribbon advance system, without this feature, would use a constant advance equal to a fixed number of steps, based on the minimum advance required at the start of a new ribbon cartridge. This fixed number of steps (variable ribbon length advance) technique would result in ribbon waste as a function of cartridge usage.

The number of motor steps required to rotate the supply spool ¼ turn is supplied by the printer as follows. Each time a "G" ("go") command is executed, if a new number of motor steps is available upon completion of that command (i.e., if the printer firmware receives feedback), the new number is returned by the printer as a 5-digit ASCII string in the range of 0 . . . 65535 preceded by a " ¦ " character. The number is returned prior to sending the ready prompt, for example,

```
>G
¦ 00532
>
```

Here, the new number 532 of ribbon motor steps is available upon completion of the 'G' command and is returned prior to the ready prompt.

The firmware also detects a ribbon "jammed" condition should 1600 motor steps elapse without feedback. This condition is reported to the host computer in the form of an error message.

Command="home mechanisms".

Action=move carriage, platen, forcer hammers, and printwheel to their "home" positions.

Command="report printwheel i.d.".

Action=transmit encoded bit pattern of the currently installed printwheel to the host computer. If no printwheel is installed, transmit "000".

Command="select print mode".

Action=record supplied mode setting to be used in the next print stroke (in the next "go" command). The mode is one of: character low force, character high force, or logo. If the mode conflicts with the type of ribbon (character or logo) currently installed in the printer, the printer responds with an error that is interpreted by the host to mean "mode command conflicts with ribbon type installed". The host computer program puts up an error message to the user informing the user that the wrong ribbon is installed. The printer knows which type of ribbon is installed by monitoring the Mode Sensor (FIG. 65B) on the transmission gear box.

Command="set printwheel spoke number".

Action=record supplied printwheel spoke number. Upon receipt of the next "go" command, the printwheel will move to this spoke (after any pending print stroke takes place).

Command="set ribbon advance".

Action=record supplied ribbon advance amount. Upon receipt of the next "go" command, the ribbon will be advanced by this number of motor steps (after any pending print stroke takes place).

Command="request status".

Action=transmit to the host computer a bit-encoded value representing the current status of the printer. Among the information encoded in this value are:

bit 0—1="ADVANCE" button has been down since last report.

bit 1—1="PRINT" button has been down since last report.

bit 2—1=printer is currently on line.

bit 3—1=printer has been offline since last report.

bit 4—1=printer is in character mode, that is, in character high force mode or character low force mode.

bit 5—1=heater is up to temperature. The heater is the character heater or the logo heater as determined by the Mode Sensor. When the logo ribbon is installed, the logo hammer is brought to print temperature and the character heater is taken to idle temperature. When the logo ribbon is removed, the opposite takes place.

bit 6—1=ribbon has been removed since last status check.

The printer includes an interlock microswitch which closes whenever a ribbon cartridge is installed in the machine. This switch serves two purposes: 1) it tells the firmware that a ribbon cartridge is installed; and 2) it completes the electrical circuit to the forcer motor. If this microswitch opens, the firmware posts the "ribbon cartridge has been removed since last status check" status bit (bit 6).

Command="flash the ONLINE LED slowly".

Action=causes the ONLINE LED on the status panel to blink at an approximate 1 Hz rate. Used by the host computer to indicate some operator action is required, such as changing supplies.

Command="flash the ONLINE LED quickly".

Action=causes the ONLINE LED on the status panel to blink at an approximate 5 Hz rate. Used by the host computer to indicate some error condition exists.

Command="stop flashing the ONLINE LED".

Action=returns the ONLINE LED to its state prior to flashing.

Command="set X (horizontal) destination".

Action=records supplied horizontal destination. Upon receipt of the next "go" command, the platen will be moved to this location (after any pending print stroke takes place).

Command="set Y (vertical) destination".

Action=records supplied vertical destination. Upon receipt of the next "go" command, the carriage will be moved to this location (after any pending print stroke takes place).

Command="go into diagnostic mode".

Action=the printer enters a diagnostic mode intended for a manufacturing functional test of the circuit board only. The printer remains in this mode until power is removed.

In order to print a character, the host computer typically issues commands to perform the following sequence of operations:

Set force, dwell, cam mode.

Specify next platen, carriage, and printwheel destinations.

Specify amount of ribbon to advance.

"GO".

More particularly, the sequence of commands may look as follows:

-continued

| |
|---|
| M 1 |
| X 1200 |
| Y 1434 |
| P 40 |
| R 126 |
| G |

The commands listed above are interpreted to mean execute a print stroke at the present location using a force of 12 (maximum motor current would be a force of a dwell of 1500 milliseconds, using the character cam mode 1 (character-high-force). Then move the platen to position X=1200, the carriage to position Y=1434, and the printwheel to petal #40. Advance the ribbon 126 motor steps. No physical motion occurs until the "G" (Go) command is transmitted.

Printing a logo is similar. When a logo is printed, the parameter to the "M" command ("select print mode") is 2 indicating the logo cam. Also, when the next object to be printed is also a logo, the "P" command ("set printwheel spoke number") may be omitted.

FIGS. 67–70 illustrate interrupt service routines executed by the printer microprocessor. Interrupt service routine IR1 is executed every 10 milliseconds at a signal from a hardware timer. Routine IR1 takes about 2 ms to execute. The tasks performed by this interrupt service routine are as follows.

TIMER HOUSEKEEPING

Keeps track of software timers. These timers are maintained by decrementing certain memory locations every 10 ms. These timers are used for a variety of purposes, including controlling the flash rate of the "online" LED, controlling the forcer and motor actions, and creating delays.

INPUT DEBOUNCING

Electrical sensor inputs are debounced. Each digital input line (for example, the pushbuttons on the control/status panel and the optical and mechanical sensors throughout the printer) are scanned by this task every 10 ms. If one of these sensors changes states, that state change is not recorded until it has been stable for at least two consecutive scans. This protects the printer against spurious noise spikes which last less than 10 ms.

FORCER (DC MOTOR CONTROLLING HAMMER) STATE MACHINE

Responsible for scheduling the operation of the forcer motor, i.e., operations such as calibration, measurement print strokes, and normal (non-measurement) print strokes.

FORCER WATCHDOG STATE MACHINE

Responsible for monitoring the operation of the forcer motor and shutting it off in case a certain watchdog timer ever expires. The forcer motor is allowed certain maximum times to execute certain actions. Should the forcer motor ever become mechanically jammed, this state machine will remove current to the motor and place the forcer state machine back into its idle state.

More particularly, when the forcer motor is commanded to move, a motion profile is pre-calculated to determine the number of slots to move. Each revolution of the forcer motor causes the microprocessor to see 10 slots via a hardware interrupt. Therefore, for example, to move the forcer motor 12 revolutions, the firmware would pre-calculate a 120 slot move.

Now suppose that the motor current is applied to move the motor but the motor is jammed mechanically. If the firmware waited to see 120 slots, it would wait forever and burn up the motor due to high current being applied in a stalled condition. Therefore, anytime a forcer motor move is made, the watchdog timer is set at the same time. This timer is set so as to allow sufficient time for the forcer motor to complete its move under worst case conditions. Should this worst case time ever elapse (due to a mechanical jam, for example), the watchdog timer will expire and abort the attempted move. The current will be shut off to the forcer motor, and the printer will post an error to the host computer, which will then prompt the user that the problem exists.

PRINTWHEEL STEPPER MOTOR STATE MACHINE

Responsible for scheduling operation of the printwheel stepper motor to perform actions such as recalibration (the encoding strip is read and recorded during recalibration), and moving to a specific petal number.

Recalibration is performed to place the printwheel and other mechanisms into a known position. More particularly, home sensors exist only at one point in the mechanism range of travel. At power up, the firmware does not know where a mechanism is until the mechanism finds the respective sensor. The firmware then sets the sensor position to 0000, and all futures moves are based on that position.

The home sensors also help detect fault conditions. If at any time the mechanism is positioned at the 0000 position and does not see the home sensor, the firmware assumes that the mechanism is no longer calibrated (maybe, for example, someone manually moved the carriage). The printer then posts an error message to the host computer. The host computer then commands the printer to recalibrate (by issuing the command "home mechanisms" described above) before issuing any more print commands.

TO control the printwheel, the PRINTWHEEL STEPPER MOTOR STATE MACHINE task uses multiple ramp profiles depending upon how far the wheel must be rotated. Generally speaking, a stepper motor ramp profile describes the timing sequence of issuing step commands to the motor. There are four stepper motors in the printer—the print wheel stepper motor, the X-axis (platen) stepper motor, the Y-axis (carriage) stepper motor, and the ribbon stepper motor. To obtain a given speed, each stepper motor is accelerated gradually. Further, the stepper motor is decelerated gradually to a stop. The term "ramp" describes the timing of the acceleration and deceleration pulse trains applied to the stepper motor.

The ramp necessary to control a stepper motor is a function of: 1) the motor itself (its torque), 2) the maximum speed to be obtained, and 3) the characteristics of the mechanical load that the motor is driving. Each stepper motor in the printer drives a different load, and some stepper motors drive the same load at different speeds depending upon the action taking place (for example, recalibration moves are generally slower than normal moves). Thus controlling the stepper motor requires accessing the proper ramp table in the firmware, and creating step pulse trains as described in that table.

The print wheel rotates bi-directionally, moving in the most efficient direction. Thus no seek greater than 40 petals is done during normal operation.

This task also deals with timing requirements that prevent ribbon motion from interfering with hammer motion. More particularly, at the end of the dwell time, the hammer is firmly down against the media. No mechanisms move until the hammer gets up out of the way. As the hammer starts back up to its home position, various mechanisms are "clear" of the hammer at different times. The first mechanisms to get clear of the hammer are the platen and carriage. As soon as sufficient pressure is released, the platen and the carriage are free to move. Next, the hammer clears the ribbon, then the printwheel. As soon as a mechanism becomes clear, it is moved to its next position even before the hammer gets to its home position. This substantially improves the print speed.

RIBBON STEPPER MOTOR STATE MACHINE

Responsible for advancing the ribbon the required number of motor steps as specified by the host computer. The timing requirements which prevent ribbon motion from interfering with hammer motion are handled here.

X-AXIS (PLATEN) STEPPER MOTOR STATE MACHINE

Responsible for recalibrating and moving the platen to the proper destination as specified by the host computer. The timing requirements which prevent platen motion from interfering with hammer motion are handled here.

Y-AXIS (CARRIAGE) STEPPER MOTOR STATE MACHINE

Responsible for recalibrating and moving the carriage to the proper destination as specified by the host computer. The timing requirements which prevent carriage motion from interfering with hammer motion are handled here.

ONLINE/OFFLINE MONITOR STATE MACHINE

Responsible for monitoring the status panel pushbuttons, communicating their state to the foreground process, and flagging the need to re-measure print strokes when the printer is taken offline and then placed back online.

CHARACTER HEATER STATE MACHINE

Responsible for monitoring the mode sensor which indicates whether the printer is in a character mode or the logo mode. If the printer is in logo mode, the character heater is placed at idle temperature (approximately 170 deg. F.). If the printer is in a character mode, the character heater is brought up print temperature (approximately 250 deg. F.).

This state machine also monitors feedback for fault detection disabling the character heater entirely for the overtemp/loss of feedback condition. A watchdog timer is used for this purpose (see the description of the TIMER HOUSEKEEPING task above). Once the electrical signals are applied necessary to bring a heater up to a given temperature, only certain amount of time is allowed for the heater to get to that temperature. If the heater does not get there within that time as detected by the watchdog timer expiring, it is assumed that something is wrong with the heater or the control electronics and all the voltage to the heater is shut off. An error is then posted to the host computer which then informs the user that the problem exists with the heater.

More particularly, the Heater Control circuit of each heater (FIG. 65B) includes a feedback element which is a thermistor whose resistance decreases as the temperature increases. A loss of feedback (an open circuit) would look like infinite resistance, or a very cold heater. Thus, if full voltage is applied to the heater and the thermistor is an open circuit, a "hammer at temperature" indication would never be seen. Therefore, after the thermistor circuit has been open for a certain amount of time as indicated by the watchdog timer, the heater is shut off. If the heater were not shut off, full current to the heater would cause it to reach excessive temperatures.

One other responsibility of this state machine is to bring the character heater to idle temperature should 4 hours elapse with no "go" command from the host computer.

LOGO HEATER STATE MACHINE

Responsible for monitoring the Mode Sensor which indicates whether the printer is in a character mode or the logo mode. If the printer is in a character mode, the logo heater is placed at idle temperature (approximately 170 deg. F.). If the printer is in logo mode, the logo heater is brought up print temperature (approximately 220 deg. F.). This state machine also monitors feedback for fault detection, disabling the logo heater entirely for overtemp/loss of feedback conditions.

One other responsibility of this state machine is to bring the logo heater to idle temperature should 4 hours elapse with no "go" command from the host computer.

LED BLINK STATE MACHINE

Responsible for implementing the ONLINE RED blink function. Two blink rates are supported: 1 Hz and 5 Hz.

Interrupt handlers IR41, IR42, IR43 (FIGS. 68–70) perform as follows.

SERVO SLOTTED DISK EDGE INTERRUPT HANDLER IR41

When the forcer motor is running, its encoder disk rotates through an optical beam sensor. At a rate of 10 interrupts per motor revolution, this interrupt service routine calculates the motor speed and adjusts the motor drive current (via PWM) to maintain a predetermined velocity profile.

STEPPER MOTOR PULSE WIDTH CONTROL IR42

Figure 69:
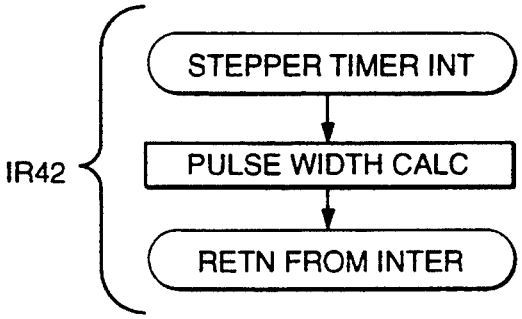
Figure 70:
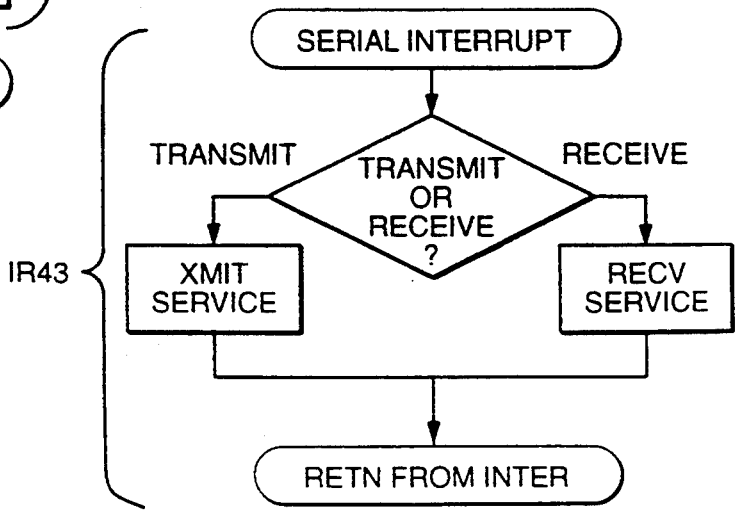

Handler IR42 in FIG. 69 represents four similar interrupt handlers, one for each stepper motor. The printer can run multiple stepper motors simultaneously. When a stepper motor is in motion, this interrupt service routine serves to look up and schedule the next motor step pulse width. Each stepper motor uses a unique "ramp profile" based upon its torque characteristics and the load that it is moving.

SPECIAL INTERRUPT HANDLER IR43

Serial communications are maintained at a 2400 Baud rate. Each time a byte is received from the host computer, this interrupt service routine captures it and places it into a buffer for later use by the foreground process. In addition to handling the reception of data from the host computer, this interrupt service routine also handles the transmission of data to the host computer by transmitting a byte at a time from a transmission buffer which was loaded by the foreground process.

The above description of embodiments of this invention is intended to be illustrative and not limiting. Other embodiments of this invention will be obvious to those skilled in the art in view of the above disclosure.

We claim:

1. In combination a dual station flat bed daisy wheel hot debossing stamper comprising:

a chassis having a flat platen for mounting a workpiece to be debossed;

a gantry connected to said chassis said gantry including a gantry frame having an upper load beam, a lower anvil load beam and pair of tensionable spaced side plates connecting said load beams; and a debossment print engine movable with respect to said upper load beam for debossing the workpiece mounted on a portion of said platen, said chassis, said gantry and said engine forming a debossment assembly comprising:

means for moving said print engine with respect to said upper load beam parallel to an Y-axis of said platen;

a daisy wheel first debossment station in said engine including a rotating character wheel generally extending in a plane parallel to said platen and having a series of character fingers thereon individually movable out of a plane of storage, means including a motor for rotating said wheel, said wheel being removable from said first debossment station;

a high force second debossment station in said engine including a debossment die;

a foil tape having a heat and pressure transferable material thereon, said tape being on a tape reel in at least one cartridge mounted in said assembly such that said transferable material extends between a workpiece on said platen and a character on an end of a finger of said character wheel or the debossment die at a debossment zone;

first heating means for individually heating said character on said wheel;

second heating means for heating said debossment die;

first force means operable for exerting force on said finger end, on said heated character and on said transferable material to transfer said transferable material from said foil tape to the workpiece and to deboss said transferable material representative of said character onto the workpiece on said platen;

second force means operable for exerting high force on said debossment die and said transferable material to simultaneously transfer said transferable material from said foil tape to the workpiece and to deboss said transferable material representative of indicia on said debossment die into the workpiece; and a keyboard and control unit for controlling debossment of a line of individual character debossments across the workpiece; for controlling relative movement of the workpiece and said assembly line-by-line; for controlling movement of said character wheel with respect to said first force means; and for controlling movement of said first and second force means interchangeably to deboss said transferable material from said tape.

2. The stamper of claim 1 including wheels on said engine, said wheels being rollable on said upper load beam in an engine travel position and being movable out-of-contact with said upper load beam when said first or second force means is operable and exceeds the weight of said engine.

3. The stamper of claim 2 wherein said upper load beam includes spaced wheel guides.

4. The stamper of claim 1 including means for pivoting said engine and said upper load beam with respect to said pair of side plates.

5. The stamper of claim 4 including a curved slot in each of said side plates, and bolt means extending through said slots for variously affixing said upper load beam to said side plates and for allowing pivoting of said upper load beam.

6. The stamper of claim 1 wherein said engine includes a central casting; means in said casting for supporting said first and said second force means, each of said force means including a rotary cam, a vertical forcer and a heater forming said heating means, each of said force means being operable independent of the other.

7. The stamper of claim 6 including a first gear train connected to and for driving said first force means, a second gear train connected to and for driving said second force means.

8. The stamper of claim 7 wherein said at least one cartridge includes a first tape cartridge insertable into said assembly to a position for transferring transferable material from tape in said first tape cartridge upon operation of said first force means; means for removing said first tape cartridge from said assembly; and a second tape cartridge insertable into said assembly to a position for transferring transferable material from tape in said second tape cartridge upon operation of said second force means.

9. The stamper of claim 8 further including means actuatable by insertion of said second tape cartridge for interconnecting said second gear train to said second force means.

10. The stamper of claim 6 wherein said rotary cam of said first force means is controllable to vary the force and dwell time of said forcer and heater on an end of a finger and dependent on the size and shape of a particular character.

11. The stamper of claim 10 further comprising means for decreasing the dwell time on a character dependent on a previous and remaining heated condition of that character.

12. The stamper of claim 6 further including a fork adjacent a bottom end of said forcer of said first force means and an upstanding center detent on each of each fingers, said fork upon operation of said forcer of said first force means contacting said center detent to center the debossment of said character on the bottom end of said forcer and on the workpiece.

13. The stamper of claim 6 wherein said motor is a single servo motor for interchangeable driving the rotary cam in each of said first and said second force means; each of said rotary cams being shaft-driven by said servo motor and having a cam contour to force a respective one of said vertical forcers downwardly; and means to actuate a respective one of said heater means to conductively heat a selected character on said character wheel or the indicia on said debossment die.

14. The stamper of claim 13 wherein said debossment die indicia is a logo and wherein said debossment die includes a logo frame having a heat transfer pad between said logo and an end of said vertical forcer in said second force means wherein said end includes said second heating means.

15. The stamper of claim 14 wherein said logo frame includes mounting means for releasably mounting said logo frame on a bottom end of said vertical forcer of said second force means.

16. The stamper of claim 15 in which said forcer bottom end includes hook means for holding said mounting means.

17. The stamper of claim 16 further including a spring for releasing said logo frame from said forcer bottom end, said spring being actuated by a logo frame loading and unloading tool insertable into a position immediately below said casting.

18. The stamper of claim 6 wherein each of said forcers includes a return compression spring for returning said forcers to an unforcing position upon removal of a caming force on a selected one of said forcers.

19. The stamper of claim 6 wherein each of said forcers includes a vertical shaft having a cam follower roller on a top end.

20. The stamper of claim 1 wherein said rotating character wheel is encased in a hollow substantially circular casing, said casing including a bottom-side peripheral open window allowing for movement of a character finger from said plane of storage to said debossment zone.

21. The stamper of claim 20 wherein said casing includes a top-side engagement ramp for engagement by a stepper motor-driven drive member.

22. The stamper of claim 20 wherein said casing includes a top-side second window and said character wheel includes a top-side reflectance strip for monitoring the rotational position of said character wheel, said first debossment station including an optical sensor positionally directed to said second window and to said reflectance strip for determining the rotational position of said character wheel.

23. The stamper of claim 20 wherein said casing includes a peripherally sloped bottom-side for aligned entry into said stamper and into a back section of said first tape cartridge.

24. The stamper of claim 20 further including a machine-readable indicia on said character wheel for indicating the character type and size of the characters on said character wheel.

25. The stamper of claim 20 wherein said casing includes a peripheral radially-extending handle.

26. The stamper of claim 1 wherein said at least one cartridge comprises a first tape cartridge insertable into said assembly to a position for transferring transferable material from tape in said first tape cartridge upon operation of said first force means; means for removing said first tape cartridge from said assembly; and a second tape cartridge insertable into said assembly to a position for transferring transferable material from tape in said second tape cartridge upon operation of said second force means.

27. The stamper of claim 26 wherein said motor is a single servo motor and where said engine includes, a first gear train normally drivable by said servo motor to drive said first force means, a second gear train drivable by said servo motor to alternatively drive said second force means and means, actuatable by insertion of said second tape cartridge, for interconnecting said second gear train to said second force means.

28. The stamper of claim 27 further including means in said engine for reinterconnecting said first gear train to said first force means upon removal of said second tape cartridge from said assembly.

29. The stamper of claim 28 wherein each of said cartridges includes latching means for latching said cartridges into said assembly.

30. The stamper of claim 28 wherein each of said cartridges includes interlock means for electrically disconnecting said servo motor upon removal of a cartridge and for reconnecting said servo motor upon insertion of a cartridge into said assembly.

31. The stamper of claim 26 including at least one slot and boss combination at a selected position on each of said cartridges and a corresponding selected position in said assembly for aligned entry of particular cartridges into a particular assembly.

32. The stamper of claim 1 wherein said first force means is controllable to vary the force and dwell time on a selected character on the end of a finger on said character wheel and dependent on the size and shape of a selected character.

33. The stamper of claim 1 further comprising means for decreasing the dwell time on a character dependent on a previous and remaining heated condition of that character.

34. The stamper of claim 1 wherein a first stepper motor drives said character wheel and wherein a second stepper motor advances said foil tape in said at least one cartridge after each debossment of said transferable material from said foil tape.

35. The stamper of claim 34 wherein relative movement of the said at least one cartridge and the flat bed with a clamped workpiece, breaks free said tape from said debossed workpiece prior to said foil tape being advanced.

36. The stamper of claim 34 wherein said at least one tape cartridge contains at least one anti-back rotation means to hold tape when being broken free from said debossed workpiece.

37. The stamper of claim 1 wherein said at least one cartridge includes indicating means for determining the remaining length of tape on said reel, said indicating means comprising means for sensing the rotation of said reel.

38. The stamper of claim 1 wherein said debossment die is operable after removal of said character wheel from said engine.

39. The stamper of claim 1 wherein said debossment die is removable from said second station.

40. The stamper of claim 1 wherein said character and finger is heated only in the immediate vicinity of said finger end.

41. The stamper of claim 1 wherein said platen includes a platen frame and a removable insert, said platen frame being adopted to receive inserts of various thickness to accommodate workpieces of various thicknesses.

42. The stamper of claim 41 wherein said platen frame includes a slidable front extension for supporting extending margins of a workpiece.

43. The stamper of claim 1 wherein said chassis includes a front recess below said platen for receipt of rings of a ring-binder when a cover workpiece of the binder is positioned on said platen to be stamped.

44. In combination a dual station flat bed daisy wheel hot debossing stamper comprising:

a chassis having a flat platen for mounting a workpiece to be debossed;

a gantry connected to said chassis; a debossment print engine movable with respect to said gantry for debossing the workpiece mounted on a portion of said platen, said chassis, said gantry and said engine forming a debossment assembly comprising:

means for moving said engine with respect to said gantry;

a daisy wheel first debossment station in said engine including a rotating character wheel above said platen and having a series of character fingers thereon individually movable out of a plane of storage and means including a first motor for rotating said wheel;

a second debossment station in said engine including a debossment die;

a foil tape having a heat and pressure transferable material thereon, said tape being on a tape reel in a cartridge mounted in said assembly such that said transferable material extends between a workpiece on said platen and a character on an end of a finger of said character wheel in a first debossment zone or the debossment die at a second debossment zone;

first heating means for individually heating said character on said wheel;

second heating means for heating said debossment die;

first force means operable for exerting force on said finger end, on said heated character and on said transferable material to transfer said transferable material from said foil tape to the workpiece and to deboss said transferable material representative of said character onto the workpiece on said platen;

second force means operable for exerting force on said debossment die and said transferable material to transfer said transferable material from said foil tape to the workpiece and to deboss said transferable material representative of indicia on said debossment die into the workpiece;

a motor means for driving said first and second force means; and a keyboard and control unit for controlling debossment of a line of individual character debossments across the workpiece; for controlling relative movement of the platen and said assembly line-by-line; for controlling movement of said character wheel with respect to said first pressure means; and for controlling movement of said first and second force means interchangeably to deboss said transferable material from said foil tape.

45. The stamper of claim 44 wherein said motor means includes gear means for driving said first and second force means and further including a manually-operated gear shift lever for connecting one or the other of said first and second force means to said gear means.

46. The stamper of claim 44 wherein said cartridge is a single cartridge having a first tape portion under said first force means and a second tape portion under said second force means.

47. The stamper of claim 46 wherein said single cartridge includes means for cross-overing said tape to have a first tape portion along side and spaced from said second tape portion.

48. The stamper of claim 44 wherein said cartridge is a pair of separate cartridges, including a first tape cartridge insertable into said assembly to a position for transferring transferable material from tape in said first tape cartridge upon operation of said first force means; means for removing said first tape cartridge from said assembly; and a second tape cartridge insertable into said assembly to a position for transferring transferable material from tape in said second tape cartridge upon operation of said second force means.

49. The stamper of claim 48 wherein said motor means is a single servo motor and where said engine includes, a first gear train normally drivable by said servo motor to drive said first force means, a second gear train drivable by said servo motor to alternatively drive said second force means and means, actuatable by insertion of said second tape cartridge, for interconnecting said second gear train to said second force means.

50. The stamper of claim 49 wherein said servo motor is a D.C. servo motor.

51. The stamper of claim 49 further including means in said engine for reinterconnecting said first gear train to said first force means upon removal of said second tape cartridge from said assembly.

52. The stamper of claim 44 wherein said engine includes means for supporting said first and said second force means, each of said force means including a rotary cam, a vertical forcer and a heater forming said heating means, each of said force means being operable independent of the other.

53. The stamper of claim 52 wherein said rotary cam of said first force means is controllable to vary the force and dwell time of said forcer on an end of a character finger and dependent on the size and shape of a particular character thereon.

54. The stamper of claim 44 including a first gear train connected to and for driving said first force means, a second gear train connected to and for driving said second force means.

55. The stamper of claim 44 further comprising means for decreasing the dwell time on a character dependent on a previous and remaining heated condition of that character.

56. The stamper of claim 52 wherein said debossment die indicia is a logo and wherein said debossment die includes a logo frame having a heat transfer pad interfacing with said logo and wherein an end of said vertical forcer in said second force means includes said second heating means.

57. The stamper of claim 56 wherein said logo frame includes mounting means for releasably mounting said logo frame on a bottom hammer of said vertical forces.

58. The stamper of claim 44 wherein said rotating character wheel is encased in a hollow substantially circular casing, said casing including a bottom-side peripheral open window allowing for movement of a character finger from said plane of storage to said debossment zone; and wherein said casing includes a top-side engagement ramp and slot for engagement by a drive member operated by said first motor.

59. The stamper of claim 58 further comprising means for decreasing the dwell time on a character dependent on a previous and remaining heated condition of that character.

60. In combination, a hot stamper daisy character wheel including a central hub; a cover extending at least in part over said wheel, said wheel and hub being rotatable with respect to said cover when in an inserted position in a stamper and when not inserted in the stamper, said cover including a bottom-side peripheral opening allowing, in the wheel and casing inserted position, for movement of a selected one of a series of character fingers extending from said wheel and from a plane of storage of said series of fingers; and wherein said central hub includes a top-side circular arc engagement ramp and a slot along said ramp for engagement by a stamper driven spring-pressed pin upon rotation of said wheel and hub in the inserted position such that said wheel is positionable at a home position when the spring-pressed pin engages said slot.

61. The combination of claim 60 wherein said cover includes a peripheral radially-extending handle.

62. The combination of claim 60 wherein said cover includes a top-side opening and said character wheel includes a top-side reflectance strip for monitoring the rotational position of said wheel through said opening.

63. A hot stamper die loader/unloader comprising:

an elongated tool base having a bottom;

an elongated angular handle having an intermediate portion pivotably secured across said tool base by a handle pivot pin and extending longitudinally of said base;

a die-mounting pad hingedly connected to a pad pivot pin connected to a distal end of said handle, the other end of said handle being pivoted about said handle pivot pin, and spring means on said pad pivot pin for angulating said pad with respect to said base, upon angular vertical movement of said handle with respect to said base.

64. The loader/unloader of claim 63 including rear and front recesses in said base and wherein said other handle end is pivotable into and out of said rear recess and said pad is angularly movable in said front recess.

65. The loader/unloader of claim 63 wherein said spring means includes a coil spring around said pad pivot pin, said spring having a first distal end in contact with a portion of said handle, and a second distal end extending under and in contact with said pad in all angulations of said pad.

66. The loader/unloader of claim 65 wherein said pad includes means for mounting a debossment die frame, said means including stop means for preventing forward sliding of the die frame mounted on the pad, and wherein angulation of said pad by movement of said handle, moves the frame into connection with a forcer hammer of a hot stamper and subsequent angulations of the pad by movement of the handle removes the frame from the force hammer.

67. A daisy wheel character finger centering device for centering a character on a character pad at a distal end of each of the fingers of a daisy wheel wherein a forcer hammer end strikes and dwells on said pad to transfer a character image to a workpiece, said device comprising a spring-pressed probe attached to a side and offset from the hammer end, said probe having a notched bottom end normally extending below said hammer end; said character pad having an undersurface from which the character extends; said finger having a detent extending upwardly from a top surface of said finger radially offset from the character, said probe notched end being generally aligned with said detent and wherein in downward motion of said hammer end said probe notched end captures and centers said detent at a predetermined central position with respect to said hammer and prior to contact of the hammer end with the said character pad top surface spaced from said detent.

68. The centering device of claim 67 wherein said detent is a triangular ridge extending upwardly from said character pad.

69. The centering device of claim 67 wherein upon completion of a prescribed dwell time the hammer end rises to a home position pulling said probe off said detent allowing said finger to return upwardly to a plane of transferable material thereon, said substrate being mounted in said assembly such that said transferable material extends between a workpiece on said platen and a character on an end of a finger of said character wheel;

heating means for individually heating said character on said wheel;

force means operable for exerting force on said finger end, on said heated character and on said transferable material to transfer said transferable material from said substrate to the workpiece and to deboss said transferable material representative of said character onto the workpiece on said platen;

a keyboard and control unit for controlling debossment of a line of individual character debossments across the workpiece; for controlling relative movement of the workpiece and said assembly line-by-line; for controlling movement of said character wheel with respect to said force means.

70. In combination a flat bed daisy wheel hot debossing stamper comprising:

a chassis having a flat platen for mounting a workpiece to be debossed;

a gantry connected to said chassis said gantry including a gantry frame having an upper anvil load beam, a lower anvil load beam and a pair of tensionable spaced side plates connecting said load beams forming a rigid box frame; and a debossment print engine movable with respect to said upper load beam for debossing the workpiece mounted on a portion of said platen, said chassis, said gantry and said engine forming a debossment assembly comprising:

means for moving said print engine with respect to said upper load beam parallel to a Y-axis of said platen;

at least one debossment station in said engine including a daisy wheel first debossment station in said engine including a rotating character wheel generally extending in a plane parallel to said platen and having a series of character fingers thereon individually movable out of a plane of storage, means including a motor for rotating said wheel;

a foil substrate having a heat and pressure transferable material thereon, said substrate being mounted in said assembly such that said transferable material extends between a workpiece on said platen and a character on an end of a finger of said character wheel;

heating means for individually heating said character on said wheel;

force means operable for exerting force on said finger end, on said heated character and on said transferable material to transfer said transferable material from said substrate to the workpiece and to deboss said transferable material representative of said character onto the workpiece on said platen wherein said force means supplies a force which bottoms out said print engine and said platen between anvils of said lower and upper load beams;

a keyboard and control unit for controlling debossment of a line of individual character debossments across the workpiece; for controlling relative movement of the workpiece and said assembly line-by-line; for controlling movement of said character wheel with respect to said force means.

71. The stamper of claim 70 including wheels on said engine, said wheels being rollable on said upper load beam in an engine travel position and being movable out-of-contact with said upper load beam when said force means is operable and exceeds the weight of said engine.

72. The stamper of claim 70 including means for pivoting said engine and said upper load beam with respect to said pair of side plates.

73. The stamper of claim 72 including a curved slot in each of side plates, and bolt means extending through said slots for variously affixing said upper load beam to said side plates and for allowing pivoting of said upper load beam.

74. The stamper of claim 72 including a high force second debossment station in said engine including a debossment die;

a second heating means for heating said debossment die;

second force means operable for exerting high force on said debossment die and said transferable material to simultaneously transfer said transferable material from said foil substrate to the workpiece and to deboss said transferable material representative of indicia on said debossment die into the workpiece; and;

wherein said foil substrate is foil tape in a pair of cartridges including a first tape cartridge insertable into said assembly to a position for transferring transferable material from tape in said first tape cartridge upon operation of said first force means; means for removing said first tape cartridge from said assembly; and a second tape cartridge insertable into said assembly to a position for transferring transferable material from tape in said second tape cartridge upon operation of said second force means.

75. A daisy wheel casing locking apparatus for locking the casing in a print engine comprising:

a linear ramp extending from a peripheral edge of said casing;

a lock slot on said casing adjacent to said ramp;

a pivoted locking tang in said print engine, said tang, upon insertion of said casing into said print engine, engageable with said ramp and when fully insertable into said engine being engageable with said lock slot;

means for spring-biasing said tang into said lock slot; and means extending from said print engine for pivoting said tang out of said slot and permitting withdrawal of said casing from said print engine.

76. The stamper of claim 70 wherein said wheel includes a central hub, said hub including a engagement ramp and a locking slot adjacent to an end of the ramp;

a first drive gear connected to said motor for rotating said wheel;

a print wheel gear shaft vertically movable into and out of a central aperture in said hub;

a print wheel drive gear fixedly attached to said shaft and being rotatable by said first gear;

a spring-biased locking pin depending from said drive gear and movable by rotation into said engagement ramp and said slot to a down position in said slot to permit rotation of said wheel by said shaft; and means for lifting said shaft out of said hub aperture and lifting said pin out of said slot.

77. A rotation device for driving a print wheel having a central hub and hub aperture, said hub including an engagement ramp and a first locking slot adjacent to an end of the engagement ramp;

a motor for rotating said wheel;

a first drive gear connected to said motor;

a print wheel drive gear fixedly attached to a shaft insertable into said hub aperture and being rotatable by said first gear;

a spring-biased locking pin depending from said print wheel drive gear and movable by rotation into said engagement ramp and said first locking slot to a down position to permit rotation of said print wheel by said shaft; and means for lifting said shaft out of said hub aperture and lifting said pin out of said first locking slot.

78. The rotating device of claim 77 further including a casing around said wheel;

a linear ramp extending from a peripheral edge of said casing;

a second lock slot on said casing adjacent to said linear ramp;

a print wheel release lever attached to said shaft;

a tang pivotally attached to said lever, wherein said tang, upon insertion of said casing against said tang, is engageable with said linear ramp and second lock slot; and wherein movement of said lever releases said tang from said second locking slot and said pin from said first locking slot.

79. In combination a dual station flat bed hot debossing stamper comprising:

a chassis having a flat movable platen for mounting a workpiece to be debossed;

a gantry connected to said chassis; and a debossment print engine movable with respect to said gantry for debossing the workpiece mounted on a portion of said platen, said chassis, said gantry and said engine forming a debossment assembly comprising:

a first debossment station in said engine including a series of character fingers thereon individually movable out of a plane of storage;

a second debossment station in said engine including a debossment die;

a foil tape having a thermal and pressure transferable material thereon, said tape being positionably mounted in said assembly such that said transferable material extends between a workpiece on said platen and a character on a character finger or the debossment die at a debossment zone;

at least one heater for heating said character and for heating said debossment die;

at least one forcer operable for exerting force on said heated character and on said transferable material to transfer the transferable material from said foil tape to the workpiece and to deboss said transferable material representative of said character into the workpiece on said platen and operable for exerting force on said heated debossment die and the transferable material to transfer said transferable material from said foil tape to the workpiece and to deboss the transferable material representative of indicia on said debossment die into the workpiece.

80. The stamper of claim 79 in which each of said series of character fingers includes a cantilevered end and character pad, said character pad having an angular orientation from a horizontal line prior to operation of said forcer.

81. The stamper of claim 80 in which the angular orientation is 11°.

82. The stamper of claim 79 in which said series of character fingers are on a daisy wheel having characters representing alphabetical large capital letters and smaller capital letters such that the wheel can deboss all large capital letters or all small capital letters or all capital letters with the first letter of a group of letters being a large capital letter and the other letters being small capital letters.

83. The stamper of claim 79 wherein said forcer includes first and second forcers, each of said first and second forcers including a vertical forcer and a heater, each of said first and second forcers being operable independent of the other.

84. The stamper of claim 83 wherein said foil tape is in a first tape cartridge insertable into said assembly to a position for transferring the transferable material from the tape in said first tape cartridge upon operation of said first forcer; means for removing said first tape cartridge from said assembly; and wherein a second foil tape is in a second tape cartridge insertable into said assembly to a position for transferring transferable material from said second foil tape in said second tape cartridge upon operation of said second forcer.

85. The stamper of claim 83 wherein said first forcer is controllable to vary the force and dwell time of said first forcer and associated heater on a finger dependent on the size and shape of a particular character.

86. The stamper of claim 85 further comprising means for decreasing the dwell time on a character dependent on a previous and remaining heated condition of that character.

87. The stamper of claim 83 further including a fork adjacent a bottom end of said first forcer and an upstanding center detent on each of said fingers, and wherein said fork upon operation of said first forcer contacts said center detent to center the debossment of said character with respect to the bottom end of said first forcer and on the workpiece.

88. The stamper of claim 83 including a servo motor for interchangeable driving said first and said second forcers; and means for actuating one of said heaters to conductively heat a selected character on a finger of said series of character fingers or the indicia on said debossment die.

89. A hot stamper debossing system comprising a debossment engine including a tape advance sensor and a tape cartridge including, a tape supply spool, a tape take-up spool and a drive motor for said take-up spool, said supply spool including a series of spaced reflector pads on a periphery of said supply spool;

a host computer;

means for tracking the number of revolutions of said supply spool;

means, including said reflector pads and said sensor, for providing a feedback to said computer as to a number of motor steps required to rotate the supply spool over a fixed turn; and means in said host computer for calculating, based on said number of revolutions and said feedback, the approximate amount of tape remaining on said spool.

90. In combination, a hot stamper daisy character wheel including a central hub; a cover extending at least in part over said wheel, said wheel and hub being rotatable with respect to said cover, said wheel including a series of character fingers;

a stepper motor;

a wheel drive shaft insertable into said hub;

a gear train extending from said stepper motor to rotate said shaft; and a linkage to allow raising of said drive shaft to disengage the drive shaft from said hub.

91. The combination of claim 90 wherein said gear train comprises a spur gear attached to said stepper motor and a central toothed gear attached to said drive shaft and meshing with the spur gear teeth, and wherein the gear teeth of the central gear slide upwardly on the meshing spur gear teeth when said drive shaft is raised.

92. The combination of claim 91 including a locator pin downwardly extending from the central gear and being engageable with said hub and disengageable from said hub when said drive shaft and said central gear are raised.

93. The combination of claim 92 wherein said locator pin in the hub engageable position homes said wheel, and wherein the hub and the wheel are drivable in either rotational direction so as to position a character finger at a print position in the shortest elapsed time.

94. In combination a flat bed daisy wheel hot debossing stamper comprising:

a chassis having a flat platen for mounting a workpiece to be debossed;

a debossment print engine movable with respect to said platen and said chassis, said engine forming a debossment assembly comprising:

a debossment station in said engine including a rotating character wheel generally extending in a plane parallel to said platen and having a series of character fingers thereon individually movable out of a plane of storage;

a foil substrate having a heat and pressure transferable material thereon, said substrate being mounted in said assembly such that said transferable material extends between a workpiece on said platen and a character on an end of a finger of said character wheel;

a heater for heating said character on said wheel;

a forcer operable for exerting force on said finger end, on said heated character and on said transferable material to transfer said transferable material from said substrate to the workpiece and to deboss said transferable material representative of said character onto the workpiece on said platen; and means for centering a character on a character pad at a distal end of each of the fingers of the character wheel wherein a forcer hammer end strikes and dwells on said pad to transfer a character image to a workpiece.

95. The stamper of claim 94 wherein said means for centering comprises a spring-pressed probe attached to a side of and offset from the hammer end, said probe having a notched bottom end normally extending below said hammer end; said character pad having an undersurface from which the character extends; said finger having a detent extending upwardly from a top surface of said finger radially offset from the character, said probe notched end being generally aligned with said detent and wherein in downward motion of said hammer end, said probe notched end captures and centers said detent at a predetermined central position with respect to said hammer end prior to contact of the hammer end with the said character pad top surface spaced from said detent.

96. The combination of claim 94 further including a control unit for controlling movement of said print engine, said character wheel and said platen and to issue a print command, including means for bringing the heater to an idle temperature should the control unit gives no print command for a predetermined amount of elapsed time.

97. The combination of claim 60 further comprising a linear ramp extending from a first peripheral edge of said cover toward a second peripheral edge of the cover; and a second lock slot on said linear ramp for locking said wheel and cover into a print engine.

98. The combination of claim 97 wherein said linear ramp is within a linear guide rail extending across a top surface of said cover, said guide rail being receivable into the print engine.

99. A hot stamper daisy character wheel comprising a central hub;

a series of radially character fingers extending from said hub, a selected one of said fingers being depressible from a plane of storage; wherein each of said fingers are constructed of a low thermal conductivity material and wherein a character pad of high thermal conductivity material is attached to each of said fingers and forms a distal end of each of said fingers; each of said pads containing a particular character to be printed.

100. The character wheel of claim 99 wherein each of said character pads is constructed of beryllium copper.

101. A hot stamper daisy character wheel comprising:

a central hub;

a series of radial character fingers extending from the hub, a selected one of said fingers being depressible from a plane of storage;

a character extending from an underside of a distal end of each of said fingers; and wherein each finger has a detent on a top side of said distal end radially offset from the character on the finger such that an associated probe attached to a forcer depressing said fingers can capture and center said detent with respect to said probe.

102. The wheel of claim 101 in which each of said fingers are constructed of a low thermal conductivity material and wherein each finger includes a character pad of high thermal conductivity material attached to a distal end of each finger, each of said pads containing a character to be printed and wherein said detent extends upwardly from each of said pads.

* * * * *

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al

It is certified that error appears in the above-indentified patent and that said Letters Patent is hereby corrected as shown below:

On the title page, item [75] Inventors, last line, change the name "Usitale" to --Usitalo--.

In the drawings, delete drawing sheets "9/58; 10/58; 11/58 and 13/58" and substitute the attached new sheets --9/58; 10/58; 11/58 and 13/58-- which should be included in this patent.

UNITED STATES PATENT AND TRADEMARK OFFICE

CERTIFICATE OF CORRECTION

PATENT NO. : 5,441,589 Page 2 of 9

DATED : August 15, 1995

INVENTOR(S) : Charles T. Groswith, et al.

It is certified that error appears in the above-identified patent and that said Letters Patent is hereby corrected as shown below:

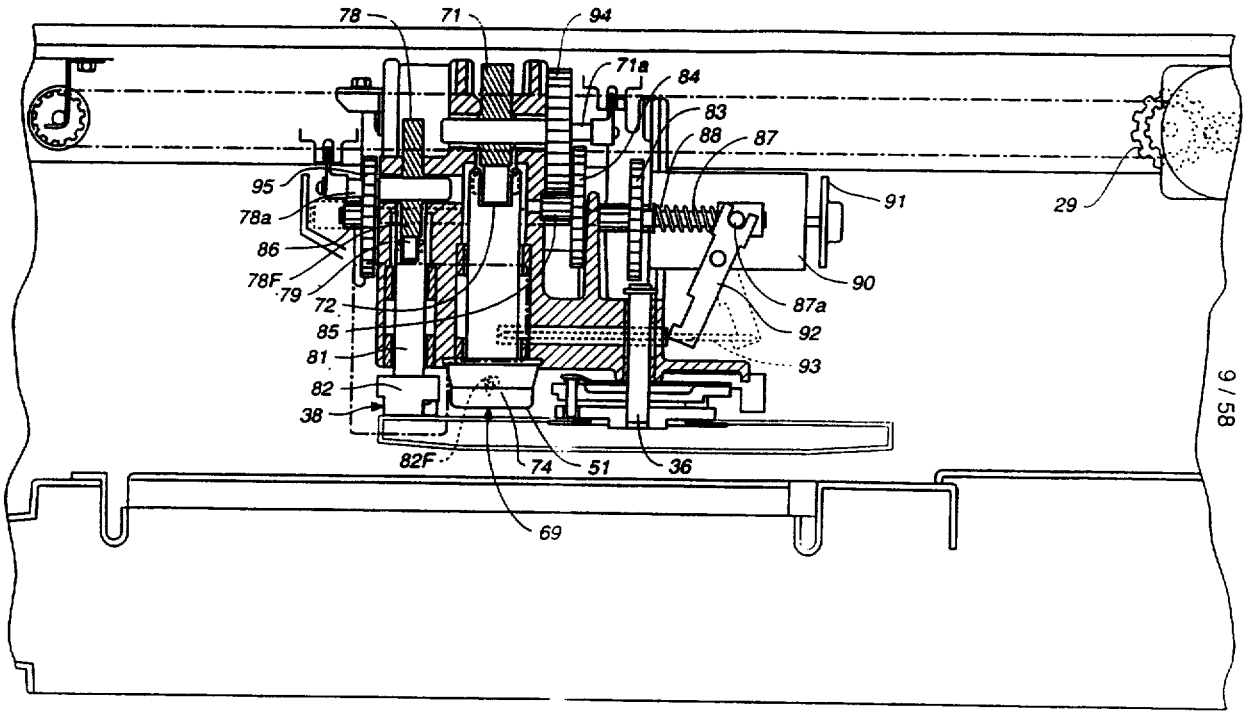

FIG._11

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al

It is certified that error appears in the above-indentified patent and that said Letters Patent is hereby corrected as shown below:

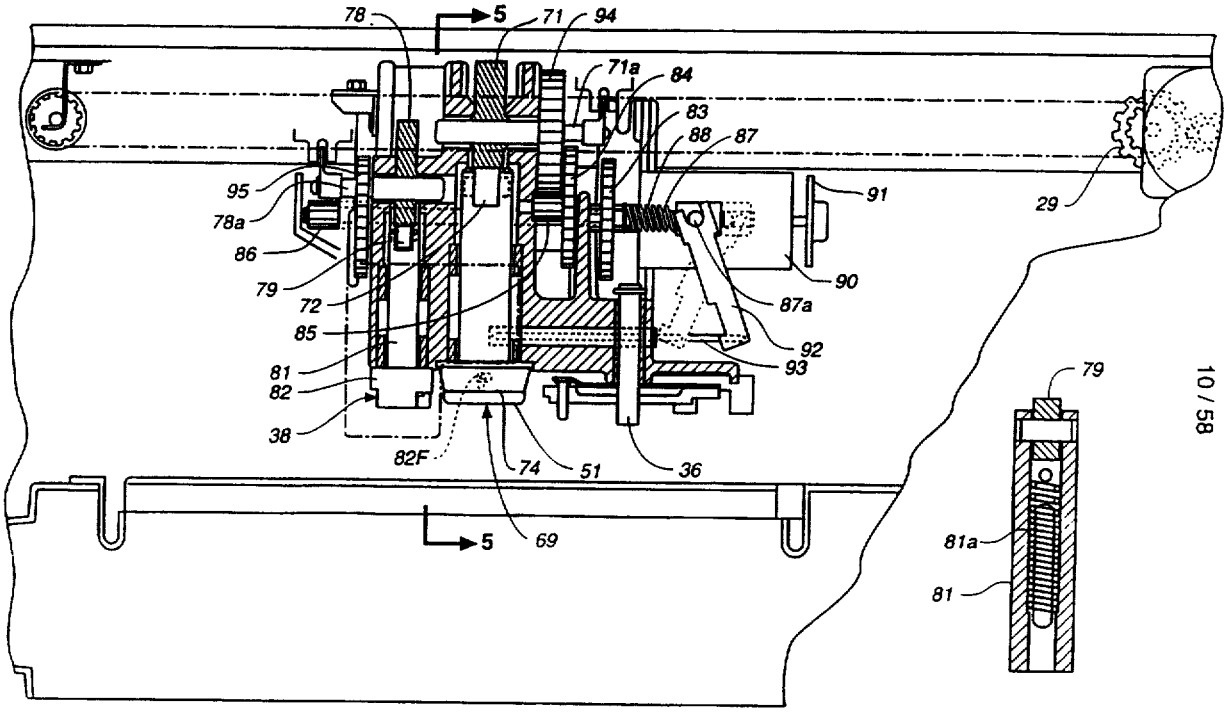

FIG._12

FIG._11A

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al.

It is certified that error appears in the above-identified patent and that said Letters Patent is hereby corrected as shown below:

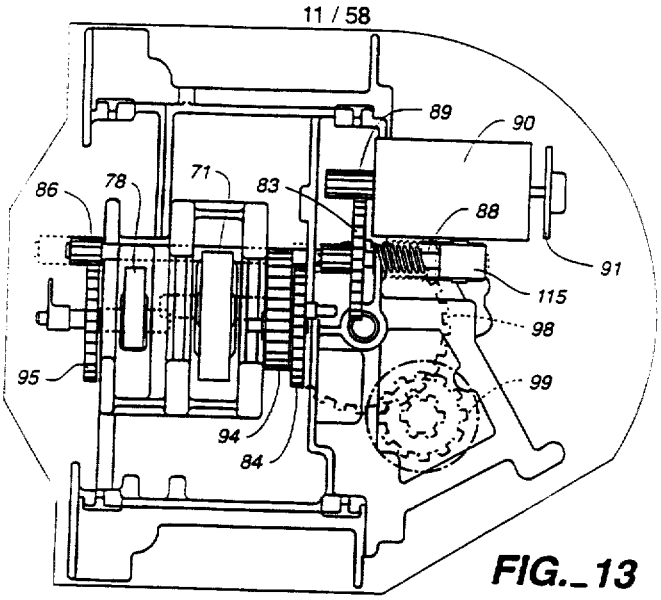

FIG._13

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al

It is certified that error appears in the above-indentified patent and that said Letters Patent is hereby corrected as shown below:

Cont.

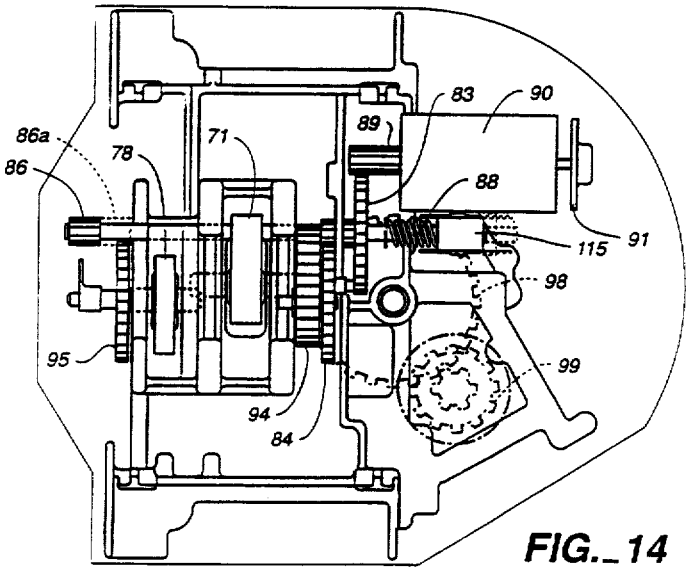

FIG._14

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al.

It is certified that error appears in the above-identified patent and that said Letters Patent is hereby corrected as shown below:

13 / 58

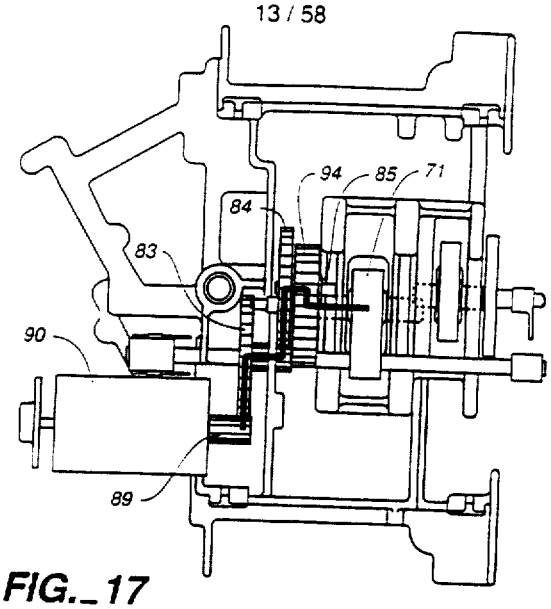

FIG._17

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al.

It is certified that error appears in the above-identified patent and that said Letters Patent is hereby corrected as shown below:

CONT.

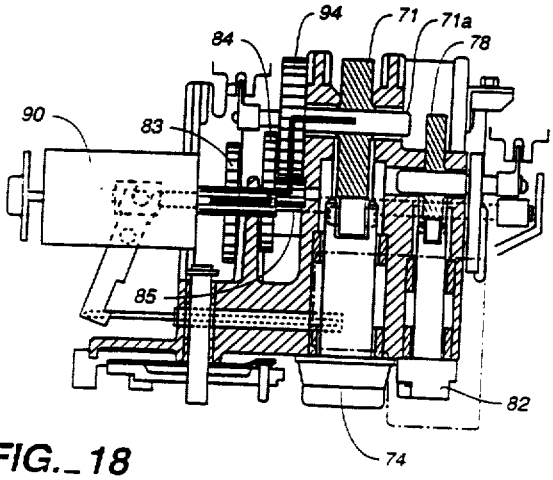

FIG._18

UNITED STATES PATENT AND TRADEMARK OFFICE

CERTIFICATE OF CORRECTION

PATENT NO. : 5,441,589 Page 8 of 9

DATED : August 15, 1995

INVENTOR(S) : Charles T. Groswith, et al.

It is certified that error appears in the above-indentified patent and that said Letters Patent is hereby corrected as shown below:

Col. 5, line 37, delete "11" and insert --12--

Col. 8, line 67, after "31d", insert --(Fig. 30)--

Col. 10, line 32, delete "12" and insert --11--

Col. 11, line 15, delete "and 84"

Col. 12, line 14, delete "indicate" and insert --indicates--

Col. 12, line 24, delete "12" and insert --11--; line 29, delete "82F".

Col. 29, line 51, delete "2 7+$2^7$=128" and insert --2^7=$2^7$=128--.

Col. 29, line 52, delete "20" and insert --2^0--

Col. 35, line 10, the formula should appear as follows:

>G

|00532

>

UNITED STATES PATENT AND TRADEMARK OFFICE

CERTIFICATE OF CORRECTION

PATENT NO. : 5,441,589

DATED : August 15, 1995

INVENTOR(S) : Charles T. Groswith, et al/

It is certified that error appears in the above-indentified patent and that said Letters Patent is hereby corrected as shown below:

Col. 46, line 51, in Claim 57, delete "forces" and insert --forcer--

Signed and Sealed this

Fourth Day of June, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,441,589
DATED : August 15, 1995
INVENTOR(S) : Charles T. Groswith, et al It is certified that error appears in the above-indentified patent and that said Letters Patent is hereby corrected as shown below:

Col. 10, line 7, delete "consist" and insert --consists --.

Col. 21, line 46, delete "shift" and insert --shaft --.

Col. 49, line 63, in Claim 76, delete "a" and insert --an --.

Col. 53, line 16, in Claim 96, delete "gives" and insert --give--.

Signed and Sealed this

First Day of October, 1996

Bruce Lehman

*Attest:*

BRUCE LEHMAN

*Attesting Officer*

*Commissioner of Patents and Trademarks*